US008096867B2

(12) United States Patent
Okada

(10) Patent No.: US 8,096,867 B2
(45) Date of Patent: Jan. 17, 2012

(54) GAMING MACHINE AND DISPLAY DEVICE WITH FAIL-TOLERANT IMAGE DISPLAYING

(75) Inventor: Kazuo Okada, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1197 days.

(21) Appl. No.: 10/697,281

(22) Filed: Oct. 31, 2003

(65) Prior Publication Data

US 2004/0209683 A1 Oct. 21, 2004

(30) Foreign Application Priority Data

Nov. 20, 2002 (JP) ..... 2002-337131
Nov. 20, 2002 (JP) ..... 2002-337132
Nov. 20, 2002 (JP) ..... 2002-337133
Nov. 20, 2002 (JP) ..... 2002-337134
Nov. 20, 2002 (JP) ..... 2002-337135
Feb. 28, 2003 (JP) ..... 2003-054664
Feb. 28, 2003 (JP) ..... 2003-054665

(51) Int. Cl.
*A63F 9/24* (2006.01)
*A63F 13/00* (2006.01)
*G06F 17/00* (2006.01)
*G06F 19/00* (2011.01)

(52) U.S. Cl. ..... 463/20

(58) Field of Classification Search ..... 463/20
See application file for complete search history.

(56) References Cited

U.S. PATENT DOCUMENTS 4,206,920 A * 6/1980 Weatherford et al. ..... 463/18
4,306,768 A 12/1981 Egging ..... 350/174
4,371,870 A 2/1983 Biferno ..... 340/716
4,454,670 A 6/1984 Bachmann et al. ..... 194/350
4,517,558 A 5/1985 Davids ..... 340/700
4,518,225 A 5/1985 Fredrickson et al. ..... 350/338
4,562,433 A 12/1985 Biferno ..... 340/716
4,568,928 A 2/1986 Biferno ..... 340/716
4,718,672 A 1/1988 Okada ..... 273/143
4,732,454 A * 3/1988 Saito et al. ..... 359/585
4,756,414 A 7/1988 Mott ..... 206/328
4,826,296 A 5/1989 Yoshimura ..... 350/338
4,976,429 A 12/1990 Nagel ..... 273/1

(Continued)

FOREIGN PATENT DOCUMENTS

AU 1999-043488 3/2000

(Continued)

OTHER PUBLICATIONS

EP Search report for 04004728.4-1238, dated Dec. 13, 2004.

(Continued)

*Primary Examiner* — Melba Bumgarner
*Assistant Examiner* — Jason Pinheiro
(74) *Attorney, Agent, or Firm* — Nixon Peabody LLP

(57) ABSTRACT

A slot machine 10 is provided with a display device 30 for displaying an image and display control means for causing the display device 30 to display an image relating to a game. The slot machine 10 is further provided with a subsidiary control board 74 having the display control means packaged therein, and a scale board 76 having control means packaged therein for accepting image signals fed from the display control means, to convert the image signals into enlarged image signals having a larger display size than that displayed by the image signals, thereby to feed the enlarged image signals to the display device 30.

10 Claims, 19 Drawing Sheets

U.S. PATENT DOCUMENTS

| | | | | |
|---|---|---|---|---|
| 4,998,804 | A | 3/1991 | Horiuchi | 350/334 |
| 5,146,354 | A | 9/1992 | Plesinger | 359/49 |
| 5,152,529 | A | 10/1992 | Okada | 273/143 |
| 5,258,844 | A | 11/1993 | Nakayama et al. | 358/209 |
| 5,283,560 | A | 2/1994 | Bartlett | 345/113 |
| 5,351,966 | A | 10/1994 | Tohyama et al. | 273/311 |
| 5,372,745 | A | 12/1994 | Yoshinaga | 252/299 |
| 5,375,043 | A | 12/1994 | Tokunaga | 362/31 |
| 5,393,061 | A | 2/1995 | Manship et al. | 273/143 R |
| 5,546,296 | A | 8/1996 | Savignac et al. | 363/60 |
| 5,580,055 | A | 12/1996 | Hagiwara | 273/143 R |
| 5,605,506 | A * | 2/1997 | Hoorn et al. | 463/42 |
| 5,636,101 | A | 6/1997 | Bonsall et al. | 361/681 |
| 5,667,439 | A | 9/1997 | Okada | 463/20 |
| 5,673,128 | A | 9/1997 | Ohta et al. | 349/62 |
| 5,691,788 | A | 11/1997 | Kim | 349/96 |
| 5,695,188 | A | 12/1997 | Ishibashi | 273/143 R |
| 5,697,843 | A | 12/1997 | Manship et al. | 463/20 |
| 5,722,891 | A | 3/1998 | Inoue | 463/20 |
| 5,725,210 | A | 3/1998 | Yamaguchi et al. | 273/121 |
| 5,725,428 | A | 3/1998 | Achmuller | 463/20 |
| 5,745,199 | A | 4/1998 | Suzuki et al. | 349/95 |
| 5,752,881 | A | 5/1998 | Inoue | 463/20 |
| 5,768,095 | A | 6/1998 | Nakamura et al. | 361/681 |
| 5,810,665 | A | 9/1998 | Takemoto et al. | 463/31 |
| 5,826,882 | A * | 10/1998 | Ward | 273/309 |
| 5,836,819 | A | 11/1998 | Ugawa | 463/30 |
| 5,890,962 | A | 4/1999 | Takemoto | 463/20 |
| 5,920,256 | A | 7/1999 | Toffolo | 340/461 |
| 5,934,672 | A | 8/1999 | Sines et al. | 273/143 R |
| 5,980,384 | A | 11/1999 | Barrie | 463/16 |
| 6,027,115 | A | 2/2000 | Griswold et al. | 273/143 R |
| 6,036,188 | A | 3/2000 | Gomez et al. | 273/118 R |
| 6,038,188 | A | 3/2000 | Akamatsu | 365/226 |
| 6,056,642 | A | 5/2000 | Bennett | 463/20 |
| 6,086,066 | A | 7/2000 | Takeuchi et al. | 273/143 R |
| 6,089,977 | A | 7/2000 | Bennett | 463/20 |
| 6,095,921 | A | 8/2000 | Walker et al. | 463/20 |
| 6,108,186 | A * | 8/2000 | Yokoi | 361/115 |
| 6,135,884 | A | 10/2000 | Hedrick et al. | 463/20 |
| 6,135,885 | A | 10/2000 | Lermusiaux | 463/20 |
| 6,141,067 | A | 10/2000 | Ikka | 349/65 |
| 6,151,169 | A | 11/2000 | Kim | 359/640 |
| 6,157,529 | A * | 12/2000 | Ahuja | 361/111 |
| 6,159,097 | A | 12/2000 | Gura | 463/20 |
| 6,164,645 | A | 12/2000 | Weiss | 273/138.2 |
| 6,174,233 | B1 | 1/2001 | Sunaga et al. | |
| 6,174,234 | B1 | 1/2001 | Seibert, Jr. et al. | |
| 6,181,301 | B1 | 1/2001 | Inoguchi et al. | 345/5 |
| 6,190,255 | B1 | 2/2001 | Thomas et al. | 463/20 |
| 6,193,606 | B1 | 2/2001 | Walker et al. | 463/20 |
| 6,219,228 | B1 | 4/2001 | Sun | 361/683 |
| 6,224,482 | B1 | 5/2001 | Bennett | 463/20 |
| 6,251,013 | B1 | 6/2001 | Bennett | 463/13 |
| 6,261,177 | B1 | 7/2001 | Bennett | 463/16 |
| 6,270,411 | B1 | 8/2001 | Gura et al. | 463/20 |
| 6,290,600 | B1 | 9/2001 | Glasson | 463/20 |
| 6,299,170 | B1 * | 10/2001 | Yoseloff | 273/292 |
| 6,315,663 | B1 | 11/2001 | Sakamoto | 463/20 |
| 6,317,128 | B1 | 11/2001 | Harrison et al. | 345/629 |
| 6,339,418 | B1 | 1/2002 | Kitagawa | 345/102 |
| 6,343,161 | B2 * | 1/2002 | Uchida | 382/309 |
| 6,364,766 | B1 | 4/2002 | Anderson et al. | 463/16 |
| 6,368,216 | B1 | 4/2002 | Hedrick et al. | 463/20 |
| 6,375,568 | B1 | 4/2002 | Roffman et al. | 463/26 |
| 6,377,339 | B1 | 4/2002 | Westerman | 355/75 |
| 6,406,159 | B1 | 6/2002 | Yamamoto | 362/31 |
| 6,419,579 | B1 | 7/2002 | Bennett | 463/20 |
| 6,439,994 | B2 | 8/2002 | Tsukahara | |
| 6,475,087 | B1 | 11/2002 | Cole | 463/20 |
| 6,517,432 | B1 | 2/2003 | Jaffe | 463/16 |
| 6,517,433 | B2 * | 2/2003 | Loose et al. | 463/20 |
| 6,575,833 | B1 * | 6/2003 | Stockdale | 463/29 |
| 6,600,527 | B1 | 7/2003 | Basturk et al. | 349/74 |
| 6,623,006 | B2 | 9/2003 | Weiss | 273/138 |
| 6,638,165 | B2 | 10/2003 | Uchiyama et al. | 463/20 |
| 6,642,975 | B2 | 11/2003 | Chino et al. | 349/65 |
| 6,651,985 | B2 * | 11/2003 | Sines et al. | 273/309 |
| 6,695,696 | B1 | 2/2004 | Kaminkow | 463/16 |
| 6,705,611 | B2 | 3/2004 | Kato | 273/143 R |
| 6,720,021 | B2 | 4/2004 | Wong et al. | 426/633 |
| 6,720,961 | B2 | 4/2004 | Tracy | 345/419 |
| 6,734,927 | B2 | 5/2004 | Sato | 349/58 |
| 6,790,140 | B1 | 9/2004 | Niwa | 463/20 |
| 6,802,575 | B1 | 10/2004 | Lee | 312/72 |
| 6,811,273 | B2 | 11/2004 | Satoh et al. | 362/27 |
| 6,817,946 | B2 | 11/2004 | Motegi et al. | 463/31 |
| 6,820,875 | B1 | 11/2004 | Hedrick et al. | 273/138.1 |
| 6,824,466 | B1 | 11/2004 | Hirota | 463/20 |
| 6,837,790 | B1 | 1/2005 | Kaminkow | 463/31 |
| 6,853,410 | B2 | 2/2005 | Matsuda et al. | 349/67 |
| 6,893,345 | B2 | 5/2005 | Motegi et al. | 463/31 |
| 6,923,721 | B2 | 8/2005 | Luciano et al. | 463/24 |
| 6,937,298 | B2 | 8/2005 | Okada | 349/58 |
| 6,942,571 | B1 | 9/2005 | McAllister et al. | 463/20 |
| 6,954,238 | B2 | 10/2005 | Liu et al. | 349/65 |
| 6,976,915 | B2 | 12/2005 | Baker et al. | 463/1 |
| 7,054,129 | B2 * | 5/2006 | Aida et al. | 361/220 |
| 7,092,048 | B2 | 8/2006 | Jeong | 349/58 |
| 7,097,560 | B2 | 8/2006 | Okada | 463/20 |
| 7,115,033 | B1 | 10/2006 | Timperley | 463/20 |
| 7,140,963 | B2 | 11/2006 | Kojima | 463/20 |
| 7,159,865 | B2 | 1/2007 | Okada | 273/143 |
| 7,160,187 | B2 | 1/2007 | Loose et al. | 463/20 |
| 7,166,029 | B2 | 1/2007 | Enzminger | 463/20 |
| 7,169,048 | B2 | 1/2007 | Nozaki et al. | 463/30 |
| 7,204,753 | B2 | 4/2007 | Ozaki et al. | 463/16 |
| 7,207,883 | B2 | 4/2007 | Nozaki et al. | 463/24 |
| 7,219,893 | B2 | 5/2007 | Tanimura et al. | 273/143 |
| 7,220,181 | B2 | 5/2007 | Okada | 463/32 |
| 7,234,697 | B2 | 6/2007 | Okada | 273/143 |
| 7,255,643 | B2 | 8/2007 | Ozaki et al. | 463/20 |
| 7,278,068 | B1 * | 10/2007 | Crowder, Jr. | 714/100 |
| 7,281,980 | B2 | 10/2007 | Okada | 463/20 |
| 7,322,884 | B2 | 1/2008 | Emori et al. | 463/16 |
| 7,329,181 | B2 | 2/2008 | Hoshino et al. | 463/20 |
| 7,355,660 | B2 | 4/2008 | Ikeda | 349/60 |
| 7,374,258 | B2 * | 5/2008 | Bowron | 312/7.2 |
| 7,390,259 | B2 | 6/2008 | Okada | 463/20 |
| 7,404,766 | B2 | 7/2008 | Adachi et al. | 463/31 |
| 7,458,890 | B2 | 12/2008 | Loose et al. | 463/16 |
| 7,465,228 | B2 | 12/2008 | Okada | 463/20 |
| 7,479,061 | B2 | 1/2009 | Okada | 463/20 |
| 7,479,066 | B2 | 1/2009 | Emori | 463/46 |
| 7,485,039 | B2 | 2/2009 | Okada | 463/20 |
| 7,510,475 | B2 | 3/2009 | Loose et al. | 463/31 |
| 7,510,476 | B2 | 3/2009 | Kobayashi | 463/31 |
| 7,520,812 | B2 | 4/2009 | Okada | 463/31 |
| 7,585,220 | B2 | 9/2009 | Loose et al. | 463/20 |
| 7,695,364 | B2 | 4/2010 | Okada | 463/20 |
| 7,730,413 | B1 | 6/2010 | Engel et al. | 715/764 |
| 2001/0000636 | A1 | 5/2001 | Weiss | 273/138.2 |
| 2001/0013681 | A1 | 8/2001 | Bruzzese et al. | 273/143 |
| 2001/0019479 | A1 | 9/2001 | Nakabayashi et al. | 362/31 |
| 2001/0031658 | A1 | 10/2001 | Ozaki et al. | |
| 2001/0050736 | A1 | 12/2001 | Lee et al. | 349/65 |
| 2001/0052955 | A1 | 12/2001 | Nagatani | 349/65 |
| 2002/0032051 | A1 * | 3/2002 | Stockdale | 463/29 |
| 2002/0063816 | A1 | 5/2002 | Nakamura et al. | 349/65 |
| 2002/0142830 | A1 | 10/2002 | Adams | 463/20 |
| 2002/0175466 | A1 | 11/2002 | Loose et al. | 273/143 |
| 2003/0016313 | A1 | 1/2003 | Jeong | 349/58 |
| 2003/0060269 | A1 | 3/2003 | Paulsen et al. | 463/20 |
| 2003/0087689 | A1 | 5/2003 | Adams | 463/20 |
| 2003/0087690 | A1 | 5/2003 | Loose et al. | 463/20 |
| 2003/0130028 | A1 | 7/2003 | Aida et al. | 463/20 |
| 2003/0157980 | A1 | 8/2003 | Loose et al. | 463/20 |
| 2003/0162579 | A1 | 8/2003 | Gauselmann | 463/16 |
| 2003/0166417 | A1 | 9/2003 | Moriyama et al. | 463/46 |
| 2003/0184690 | A1 | 10/2003 | Ogiwara et al. | 349/61 |
| 2003/0214471 | A1 | 11/2003 | Topelberg | 345/87 |
| 2003/0224852 | A1 * | 12/2003 | Walker et al. | 463/20 |
| 2003/0234489 | A1 | 12/2003 | Okada | 273/236 |
| 2003/0236118 | A1 | 12/2003 | Okada | 463/20 |
| 2004/0014520 | A1 | 1/2004 | Okada | 463/20 |
| 2004/0021705 | A1 | 2/2004 | Baker et al. | 347/2 |
| 2004/0029636 | A1 | 2/2004 | Wells | 463/32 |

| | | | | |
|---|---|---|---|---|
| 2004/0048646 | A1 | 3/2004 | Visocnik | 463/16 |
| 2004/0048673 | A1* | 3/2004 | Kaminkow | 463/46 |
| 2004/0052078 | A1 | 3/2004 | Hosaka | 362/302 |
| 2004/0062025 | A1 | 4/2004 | Satoh et al. | 362/27 |
| 2004/0063490 | A1 | 4/2004 | Okada | 463/20 |
| 2004/0116178 | A1 | 6/2004 | Okada | 463/20 |
| 2004/0147303 | A1 | 7/2004 | Imura et al. | 463/16 |
| 2004/0150162 | A1 | 8/2004 | Okada | 273/292 |
| 2004/0152501 | A1 | 8/2004 | Okada | 463/16 |
| 2004/0152502 | A1 | 8/2004 | Okada | 463/16 |
| 2004/0166925 | A1 | 8/2004 | Emori et al. | 463/20 |
| 2004/0166926 | A1 | 8/2004 | Adachi et al. | 463/20 |
| 2004/0171418 | A1 | 9/2004 | Okada | 463/20 |
| 2004/0192441 | A1 | 9/2004 | Nonaka | 463/31 |
| 2004/0198485 | A1 | 10/2004 | Loose et al. | 463/20 |
| 2004/0207154 | A1 | 10/2004 | Okada | 273/138.1 |
| 2004/0209666 | A1 | 10/2004 | Tashiro et al. | 463/20 |
| 2004/0209667 | A1 | 10/2004 | Emori et al. | 463/20 |
| 2004/0209668 | A1 | 10/2004 | Okada | 463/20 |
| 2004/0209670 | A1 | 10/2004 | Adachi et al. | 463/20 |
| 2004/0209671 | A1 | 10/2004 | Okada | 463/20 |
| 2004/0209672 | A1 | 10/2004 | Okada | 463/20 |
| 2004/0209676 | A1 | 10/2004 | Onishi et al. | 463/29 |
| 2004/0209678 | A1 | 10/2004 | Okada | 463/30 |
| 2004/0209679 | A1 | 10/2004 | Nonaka | 463/30 |
| 2004/0209681 | A1 | 10/2004 | Emori et al. | 463/31 |
| 2004/0209682 | A1 | 10/2004 | Okada | 463/31 |
| 2004/0209683 | A1 | 10/2004 | Okada | 463/31 |
| 2004/0214635 | A1 | 10/2004 | Okada | 463/30 |
| 2004/0214636 | A1 | 10/2004 | Nonaka | 463/30 |
| 2004/0214637 | A1 | 10/2004 | Nonaka | 463/31 |
| 2004/0219965 | A1 | 11/2004 | Okada | 463/16 |
| 2004/0224747 | A1 | 11/2004 | Okada | 463/16 |
| 2004/0224758 | A1 | 11/2004 | Okada et al. | 463/31 |
| 2004/0227286 | A1 | 11/2004 | Tanimura et al. | 273/143 |
| 2004/0227866 | A1 | 11/2004 | Okada | 349/58 |
| 2004/0229680 | A1 | 11/2004 | Hoshino et al. | 463/20 |
| 2004/0229686 | A1 | 11/2004 | Tanimura et al. | 463/30 |
| 2004/0229693 | A1* | 11/2004 | Lind et al. | 463/37 |
| 2004/0242323 | A1 | 12/2004 | Okada | 463/31 |
| 2004/0266510 | A1 | 12/2004 | Kojima | 463/16 |
| 2004/0266515 | A1 | 12/2004 | Gauselmann | 463/20 |
| 2004/0266521 | A1 | 12/2004 | Kojima | 463/20 |
| 2005/0020349 | A1 | 1/2005 | Tachikawa | 463/20 |
| 2005/0032571 | A1 | 2/2005 | Asonuma | 463/20 |
| 2005/0049030 | A1 | 3/2005 | Tachikawa | 463/20 |
| 2005/0049032 | A1 | 3/2005 | Kobayashi | 463/20 |
| 2005/0054433 | A1 | 3/2005 | Iwamoto | 463/25 |
| 2005/0140088 | A1 | 6/2005 | Randall | 273/143 |
| 2005/0153775 | A1 | 7/2005 | Griswold et al. | 463/30 |
| 2005/0170879 | A1 | 8/2005 | Tachikawa | 463/16 |
| 2005/0187003 | A1 | 8/2005 | Adachi et al. | 463/16 |
| 2005/0187006 | A1 | 8/2005 | Tachikawa | 463/20 |
| 2005/0187007 | A1 | 8/2005 | Kuroiwa | 463/20 |
| 2005/0187009 | A1 | 8/2005 | Osawa | 463/20 |
| 2005/0192083 | A1 | 9/2005 | Iwamoto | 463/20 |
| 2005/0192084 | A1 | 9/2005 | Iwamoto | 463/20 |
| 2005/0192085 | A1 | 9/2005 | Iwamoto | 463/20 |
| 2005/0192090 | A1 | 9/2005 | Muir et al. | 463/30 |
| 2005/0255908 | A1 | 11/2005 | Wells | 463/20 |
| 2005/0272500 | A1 | 12/2005 | Tanimura et al. | 463/20 |
| 2005/0282616 | A1 | 12/2005 | Tanimura et al. | 463/20 |
| 2005/0282617 | A1 | 12/2005 | Sekiguchi et al. | 463/20 |
| 2006/0014580 | A1 | 1/2006 | Hawthorn | 463/20 |
| 2006/0089192 | A1 | 4/2006 | Okada | 463/20 |
| 2006/0128467 | A1 | 6/2006 | Thomas | 463/31 |
| 2006/0135248 | A1 | 6/2006 | Anderson et al. | 463/22 |
| 2006/0252496 | A1 | 11/2006 | Rasmussen | 463/20 |
| 2006/0281530 | A1 | 12/2006 | Seelig et al. | 463/20 |
| 2007/0004513 | A1 | 1/2007 | Wells et al. | 463/31 |
| 2007/0054730 | A1 | 3/2007 | Mattice et al. | 463/16 |
| 2007/0060296 | A1 | 3/2007 | Yoshizawa | 463/20 |
| 2007/0123348 | A1 | 5/2007 | Nozaki | 463/30 |
| 2007/0149281 | A1 | 6/2007 | Gadda et al. | 463/34 |
| 2007/0184893 | A1 | 8/2007 | Fujimoto | 463/20 |
| 2008/0020820 | A1 | 1/2008 | Iwamoto | 463/20 |
| 2008/0125210 | A1 | 5/2008 | Iwamoto | 463/20 |
| 2008/0176653 | A1 | 7/2008 | Kishi | 463/31 |
| 2008/0261674 | A9 | 10/2008 | Okada | 463/16 |
| 2008/0311977 | A1 | 12/2008 | Okada | 463/20 |
| 2009/0131148 | A1 | 5/2009 | Loose et al. | 463/20 |
| 2009/0181758 | A1 | 7/2009 | Loose et al. | 463/20 |
| 2009/0247276 | A1 | 10/2009 | Okada | 463/20 |

FOREIGN PATENT DOCUMENTS

| | | | |
|---|---|---|---|
| AU | 2000-030185 | | 11/2000 |
| CA | 2282782 | | 3/2000 |
| EP | 0060019 | | 9/1982 |
| EP | 0789338 | | 8/1997 |
| EP | 0 978 809 | A2 | 2/2000 |
| EP | 0 997 857 | A2 | 5/2000 |
| EP | 1260928 | | 11/2002 |
| EP | 1376494 | | 1/2004 |
| EP | 1376495 | | 1/2004 |
| EP | 1424663 | | 6/2004 |
| GB | 2124505 | A | 2/1984 |
| GB | 2165074 | A | 4/1986 |
| GB | 2242052 | A | 9/1991 |
| GB | 2253299 | A | 9/1992 |
| GB | 2349494 | A | 11/2000 |
| JP | 60-061079 | | 4/1985 |
| JP | 61-279272 | | 12/1986 |
| JP | 01-185741 | A | 7/1989 |
| JP | 2019182 | | 1/1990 |
| JP | 03-72313 | B2 | 11/1991 |
| JP | 04-109977 | | 4/1992 |
| JP | 04-114676 | | 4/1992 |
| JP | 1992-220275 | | 8/1992 |
| JP | 04-341288 | | 11/1992 |
| JP | 05-123441 | | 5/1993 |
| JP | 05-177043 | | 7/1993 |
| JP | 2001-198316 | | 7/1993 |
| JP | 06-039085 | | 2/1994 |
| JP | 06-047150 | A | 2/1994 |
| JP | 1994-142279 | | 5/1994 |
| JP | 07-016340 | | 1/1995 |
| JP | 07-031728 | A | 2/1995 |
| JP | 07-100241 | A | 4/1995 |
| JP | 07-124290 | | 6/1995 |
| JP | 07-299189 | | 11/1995 |
| JP | 08-010381 | | 1/1996 |
| JP | 08-080364 | | 3/1996 |
| JP | 08-103541 | | 4/1996 |
| JP | 2531253 | | 1/1997 |
| JP | 09-207625 | | 8/1997 |
| JP | 10-071228 | | 3/1998 |
| JP | 10-091076 | | 4/1998 |
| JP | 10-290856 | A | 11/1998 |
| JP | 10-305130 | | 11/1998 |
| JP | 10-328398 | | 12/1998 |
| JP | 11-090017 | | 4/1999 |
| JP | 11-099240 | | 4/1999 |
| JP | 11-114136 | A | 4/1999 |
| JP | 11-137774 | | 5/1999 |
| JP | 11-153970 | | 6/1999 |
| JP | 11-206960 | | 8/1999 |
| JP | 11-221313 | A | 8/1999 |
| JP | 11-244451 | | 9/1999 |
| JP | 11-253610 | | 9/1999 |
| JP | 2000-011725 | | 1/2000 |
| JP | 2000-098962 | A | 4/2000 |
| JP | 2000-140262 | A | 5/2000 |
| JP | 2000-189554 | | 7/2000 |
| JP | 2000-262738 | | 9/2000 |
| JP | 2000-300729 | | 10/2000 |
| JP | 2000-300731 | | 10/2000 |
| JP | 2000-350805 | | 12/2000 |
| JP | 2001-025546 | | 1/2001 |
| JP | 2001-058046 | | 3/2001 |
| JP | 2001-062032 | | 3/2001 |
| JP | 2001-083927 | A | 3/2001 |
| JP | 2001-087532 | | 4/2001 |
| JP | 2001-087592 | | 4/2001 |
| JP | 2001-120715 | A | 5/2001 |
| JP | 2001-134244 | A | 5/2001 |
| JP | 2001-137461 | | 5/2001 |
| JP | 2001-142452 | A | 5/2001 |
| JP | 2001-161892 | | 6/2001 |

| | | | |
|---|---|---|---|
| JP | 2001-198289 | A | 7/2001 |
| JP | 2001-204891 | A | 7/2001 |
| JP | 2001-238995 | | 9/2001 |
| JP | 2001-252393 | | 9/2001 |
| JP | 2001-252394 | | 9/2001 |
| JP | 2002-113150 | | 4/2002 |
| JP | 2002-116729 | A | 4/2002 |
| JP | 2002-136652 | | 5/2002 |
| JP | 2002-272903 | A | 9/2002 |
| JP | 2002-290997 | A | 10/2002 |
| JP | 2002-291979 | A | 10/2002 |
| JP | 2003-236037 | | 8/2003 |
| JP | 2003-260184 | | 9/2003 |
| JP | 2004-008705 | | 1/2004 |
| JP | 2002-186735 | A | 7/2007 |
| RU | 2000128696 | | 10/2002 |
| RU | 2001103774 | | 1/2003 |
| WO | WO 98/03962 | A1 | 1/1998 |
| WO | WO 99/53454 | A1 | 10/1999 |
| WO | WO 99/64997 | A1 | 12/1999 |
| WO | WO 00/32286 | A1 | 6/2000 |
| WO | WO 01/28647 | A1 | 4/2001 |
| WO | WO 01/72387 | A1 | 10/2001 |
| WO | WO-03/039699 | | 5/2003 |
| WO | WO 2006/036948 | A2 | 4/2006 |
| WO | WO 2006/124976 | A1 | 11/2006 |
| WO | WO 2007/011717 | A2 | 1/2007 |

OTHER PUBLICATIONS

Office Action from Japanese Patent Office for 2002-337132, dated Dec. 7, 2004.
Office Action from Japanese Patent Office for 2002-337133, dated Dec. 7, 2004.
European Search Report.
Notification of Reasons for Refusal, Doc. No. 147921, Apr. 26, 2005.
Reference Sheet re: Information Statement issued by third party on June 5. (1 page).
Information Statement, App. No. 2002-337135, Jun. 5, 2007 (6 pages).
JPO Office Action, App. No. 2002-337135, Jul. 25, 2007 (2 pages) with English translation of Decision of Rejection, 9024 2N00 (1 page).
JPO Inquiry, App. No. 2002-337132, Trans. No. 032757, Trans. Date: Apr. 1, 2008 (3 pages).
JPO Inquiry, App. No. 2002-337133, Trans. No. 032760, Trans. Date: Apr. 1, 2008 (3 pages).
JPO Inquiry, App. No. 2003-054664, Trans. No. 032762, Trans. Date: Apr. 1, 2008 (3 pages).
JPO Inquiry, App. No. 2003-054665, Trans. No. 032763, Trans. Date: Apr. 1, 2008 (3 pages).
JPO Notice of Reasons for Rejection, App. No. 2003-54665, Trans. No. 122246, Trans. Date: Nov. 11, 2008 (4 pages).
JPO Appeal Decision, App. No. 2003-54664, Trans. No. 017648, Trans Date Mar. 24, 2009 (7 pages).
JPO Appeal Decision, App. No. 2003-54665, Trans. No. 017619, Trans Date Mar. 24, 2009 (8 pages).
"Bigfoot" Product Sheet, Shuffle Master, Inc., 1 page (2000).
"Big Games Safari" Product Sheet, IGT, 24 pages (2000).
"Cabby Cash™" Product Sheet, Anchor Gaming, 2 pages (2000).
"Congo Quest™" Product Sheet, Anchor Gaming, 2 pages (2000).
"Fishin' Buddies™" Product Sheet, Anchor Gaming, 2 pages (2000).
Legato, Frank, "The Full Monty," Strictly Slots, pp. 48-50 (Jun. 1999).
"Goooaal!" Product Sheet, Bally Gaming, Inc., 2 pages (2000).
"Great Whites" Product Sheet, VLC, Inc., 2 pages (2000).
"Jackpot Stampede Deluxe™" Product Sheet, WMS Gaming Inc., 2 pages (1997).
"Loaded Dice" Product Sheet, Konami Gaming, 2 pages (2000).
"Neptune's Pearls" Product Sheet, Unidesa Gaming, 4 pages (1998).
"Penguin Pays" Product Sheet, Aristocrat Incorporated, 2 pages (1998).
"Stroke of Luck™" Product Sheet, WMS Gaming Inc., 2 pages (1997).
"Wild Cougar" Article, Strictly Slots, p. 44 (Feb. 1999).
"Yahtzee® Brand Video Game" Product Brochure, Hasbro, Inc., 2 pages (2000).
JPO Office Action, Ref. No. P02-0956, Transmission No. 071369, Feb. 20, 2007 (3 pages).

* cited by examiner

30

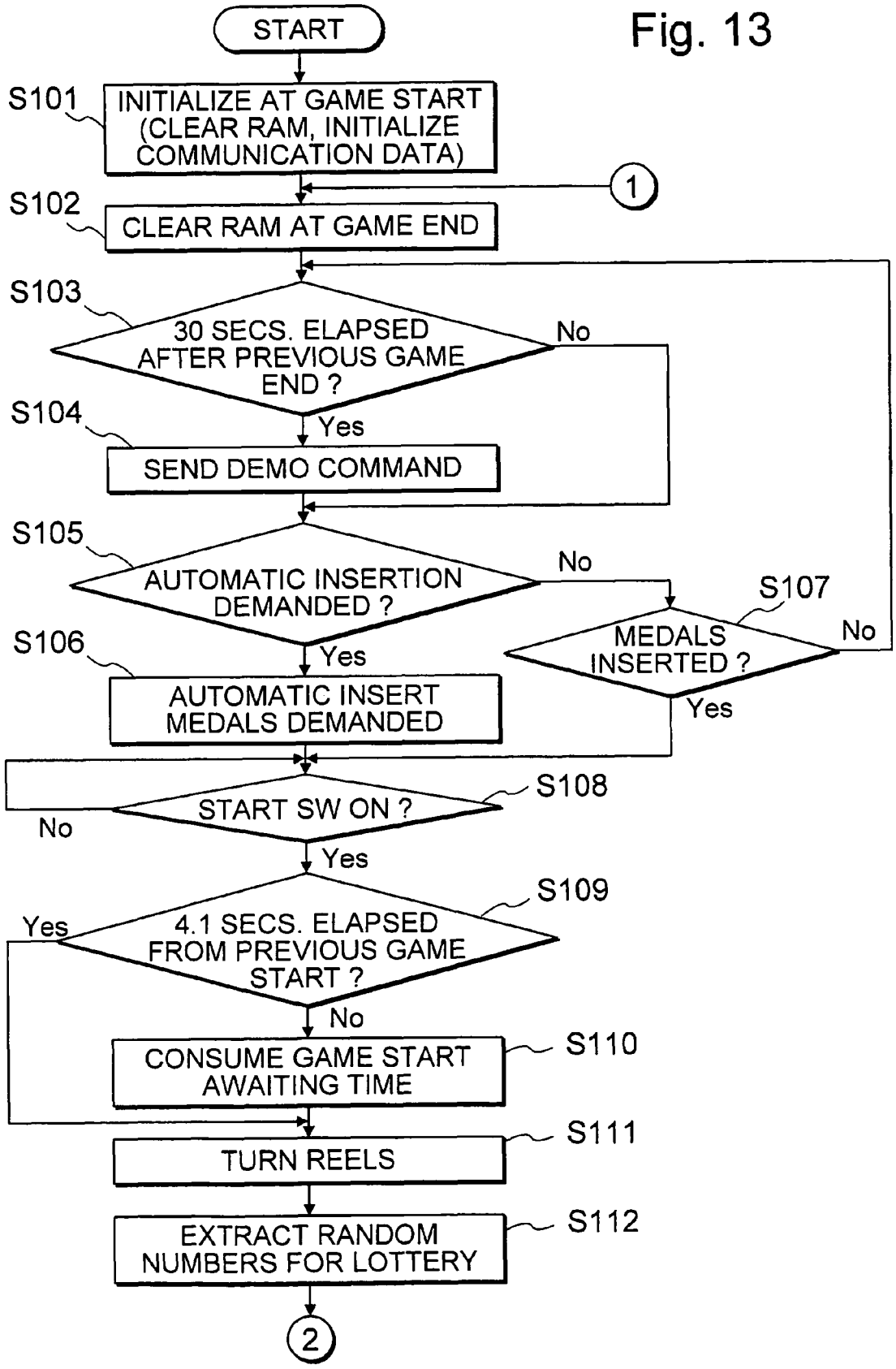
Fig. 13
START
S101
INITIALIZE AT GAME START (CLEAR RAM, INITIALIZE COMMUNICATION DATA)
1
S102
CLEAR RAM AT GAME END
S103
30 SECS. ELAPSED AFTER PREVIOUS GAME END ?
No
Yes
S104
SEND DEMO COMMAND
S105
AUTOMATIC INSERTION DEMANDED ?
No
Yes
S107
MEDALS INSERTED ?
No
Yes
S106
AUTOMATIC INSERT MEDALS DEMANDED
S108
START SW ON ?
No
Yes
S109
4.1 SECS. ELAPSED FROM PREVIOUS GAME START ?
Yes
No
S110
CONSUME GAME START AWAITING TIME
S111
TURN REELS
S112
EXTRACT RANDOM NUMBERS FOR LOTTERY
2

GAMING MACHINE AND DISPLAY DEVICE WITH FAIL-TOLERANT IMAGE DISPLAYING

FIELD OF TECHNOLOGY

The present invention relates to a gaming machine and a display device for a gaming machine.

DESCRIPTION OF RELATED ART

In the related art, public favor has been gained by a gaming machine, which is intended to continue the interest of a player without getting the player tired of it by displaying rotatable reels having a plurality of symbols drawn on their peripheries in motion or still so that pin balls, game medals or game media may be paid out on the basis of the combination of the symbols displayed still.

Of these gaming machines, there is a slot machine for displaying the reels in a stationary state on the basis of the stopping operation. This slot machine is recognized as a superior technical intervention of the player to that of the pin ball machine.

Specifically, it is probably "observation push," in which the player must perform the stop operation in a predetermined timing so as to stop the reel to show a predetermined symbol on the surface in a stationary state, that has made the slot machine so popular. (See Japanese examined patent publication No. JP-B-H3-72313)

In recent years, a gaming machine such as a pinball gaming machine or a pachi-slot machine spreads widely, and various types of gaming machines are developed and sold by each gaming machine maker.

This gaming machine is provided in its cabinet with a display unit, in which there are displayed various images such as an image indicating the play contents or an effect image for making effects. This display unit is indispensable for such gaming machines.

In this display unit, there may be used various liquid crystal displays, a CRT (Cathode Ray Tube), STN (Super-Twisted Transistor), and TFT (Thin Film Transistor) type of displays. This display unit may be mounted in inside the cabinet of the gaming machine such that a display panel appears in a bulging shape from the outside. In order to reduce the size of the gaming machine, therefore, a thin type liquid crystal display has become in the mainstream. (See Japanese unexamined patent publication No. JP-A-2002-272903.)

SUMMARY OF THE INVENTION

However, it is not easy with this gaming machine for the player to visually recognize symbols being displayed in a motion state and to stop the reel so as to show the desired symbol in a still state. Therefore, a beginner especially may not be able to perform such stop operation. Even if an enjoyable game is provided, therefore, it may not be enjoyed by some people because they cannot stop and make the reel show the desired symbol due to lack of their skills.

Here, the gaming machine is provided with symbol illuminating lamps for illuminating the reel from the front face so that the reels may be easily visually recognized. However, only the pattern illuminating lamps are not sufficient.

On the other hand, some gaming machine is provided with reel backlights for illuminating the reels from the back. These backlights may be turned ON for making various effects.

However, these backlights are lit only for the effects but are not lit in case the effects are not made, so that they cannot be the to be sufficient.

There has also been proposed a gaming machine, which flashes such reel backlights to promote the stopping operation in response to the lighting operation. However, this gaming machine cannot suffice the joy of the "observation push", in which the stop and display are done in response to the notice from the gaming machine, and the technical intervention to attain the senses of fulfillment and satisfaction to be attained by the stopping and displaying operations of the player himself.

According to the present invention, it is an object to provide a gaming machine, which enables more players to enjoy the "observation push" by making the patterns easily visible.

In this gaming machine, however, an uncomfortable image may be displayed due to a trouble in the liquid crystal display thereby to obstruct the interest of the player.

This uncomfortable image is caused by noises or static electricity, for example. It has been desired to eliminate such uncomfortable image as much as possible.

In some gaming machine, on the other hand, such liquid crystal display is arranged on the front faces of the reels. In case a circuit for feeding the liquid crystal display with image signals becomes abnormal, however, the liquid crystal display disables the display of the reel patterns in motion to be visually recognized. This failure of the visual recognition is not favorable.

This liquid crystal display is fed with the power source from a circuit or the feed source of its image signals through the same connection cables as those for feeding the image signals. In case no power source is fed to the circuit or the image signal feed source, therefore, the aforementioned may be caused by the disconnection or the like of the connection cables.

According to the present invention, it is an object to provide a gaming machine, which can continue the interest of the player even in case the power source is not fed to a board having display control means.

According to the present invention, it is an object to provide a gaming machine.

According to the present invention, it is an object to provide a gaming machine, which can continue the interest of the player even in case the power source is not fed to the display control means.

In some gaming machine, on the other hand, such liquid crystal display is arranged on the front faces of the reels. In case the image signals to be fed to the liquid crystal display are abnormal or in case a circuit for feeding the liquid crystal display with the image signals becomes abnormal, however, the liquid crystal display disables the display of the reel patterns in motion to be visually recognized. This failure of the visual recognition is not favorable.

In some gaming machine, on the other hand, such liquid crystal display is arranged on the front faces of the reels. In case a circuit for feeding the liquid crystal display with image signals becomes abnormal, however, the liquid crystal display disables the display of the reel patterns in motion to be visually recognized. This failure of the visual recognition is not favorable.

In order to achieve the aforementioned object, in the gaming machine of the invention, the reel illuminating means has a function to illuminate the reels in case the power source is turned ON.

More specifically, the invention provides the following.

(1) A gaming machine may comprise rotatable reels having a plurality of symbols drawn on their outer peripheries, and reel illuminating means for illuminating the reels, and the reel illuminating means may have a function to illuminate the reels in case the power source is turned ON.

According to (1), "the reel illuminating means has a function to illuminate the reels in case the power source is turned ON". Since the function to illuminate the reels is enabled by turning ON the power source, it is possible provide a game, which can make the reels easily visible and can continue the interest of the player for a long time. Since this visibility is made easier, moreover, the game makes the player hardly tired to keep the interest of the player for a long time.

Especially in case the patterns are displayed in motion because the reels are rotated, they are harder to be visually recognized than in case they are displayed still. According to this gaming machine, it is possible to provide a game, which can recognize the reels visually more easily than the related art and which can continue the interest of the player. Since this visibility is made easier, moreover, it is possible to provide a game, which can make the player hardly tired and can keep the interest of the player for a long time. Since the contents of the game are frequently determined according to the stopping mode of the reels, the game capable of continuing the interest of the player for a long time can be provided by such gaming machine.

Here, the aforementioned "case of the power ON" is a concept including the case, in which the power source is merely turned ON, and the case in which the power source is turned ON again. In the included case, for example, the power source may be turned ON on the basis of the operation of the power button, and the power source may be turned ON again on the basis of the operation of the reset button.

(2) The gaming machine of the invention may comprise rotatable reels having a plurality of symbols drawn on their outer peripheries, and reel illuminating means for illuminating the reels, and the reel illuminating means may have a function to illuminate the reels at all times while the power source is ON.

According to (2), "the reel illuminating means has a function to illuminate the reels at all times while the power source is ON". In case the gaming machine is powered, i.e., in case the gaming machine may be played, therefore, it is possible to provide a game, which can make the reels easily visible and can continue the interest of the player for a long time. Since this visibility is made easier, moreover, it is possible to provide a game, which can make the player hardly tired and can keep the interest of the player for a long time.

(3) A gaming machine may comprise rotatable reels having a plurality of symbols drawn on their outer peripheries, and reel illuminating means for illuminating the reels, and the reel illuminating means may have a function not to illuminate the reels, in case the effects are to be made, but to illuminate the reels in case no effect is to be made.

According to (3), "the reel illuminating means has a function not to illuminate the reels, in case the effects are to be made, but to illuminate the reels in case no effect is to be made". Therefore, the effects may be made by extinguishing the reels, but the reels are illuminated at all times, in case the effects are not made. In other words, the reels are made ordinarily visible, and the effects are made by not illuminating the reels. As a result, it is possible to provide a game, which makes the effects with the brightness of the reels, which can make the reels easily visible and which can continue the interest of the player for a long time. Since this visibility is made easier, moreover, it is possible to provide a game, which can make the player hardly tired and can keep the interest of the player for a long time.

(4) The gaming machine of the invention may further comprise: a display device mounted on the front faces of the reels for displaying an image; and display control means for displaying an image relating to a game on the display device, and the display control means may have a function to display an image of a relatively high transparency on the display device.

According to (4), "the gaming machine further comprises: a display device mounted on the front faces of the reels for displaying an image; and display control means for displaying an image relating to a game on the display device, and the display control means has a function to display an image of a relatively high transparency on the display device". Therefore, the invisibility is eliminated by displaying an image of a relatively high transparency. Thus, it is possible provide a game, which can make the reels more visible and can continue the interest of the player for a long time. Since this visibility is made easier, it is also possible to provide the game, which can make the player hardly tired and can keep the interest of the player for a long time.

(5) There is provided a gaming machine comprising a display unit for displaying an image, and display control means for displaying an image relating to a game on the display unit, further comprising: an image display unit having the display control means; and power source feeding means for feeding the power source independently to the display device and the image display unit.

According to (5), "there are provided the image display unit having the display control means, and the power source feeding means for feeding the power source independently to the display device and the image display unit". Even in case the power source is not fed to the image display unit, it is still fed independently of the power source feeding means for the display device so that the display device itself is not disconnected from the power source. By eliminating one factor which may give an uncomfortable feel during playing the game, therefore, it is possible to provide a gaming machine which can continue the interest of the player for a long time.

The aforementioned concept of "feed the power source independently" contains not only the mere use of a separate power source device but also the feed of the power source to one board even in case the power source device is shared and in case the other board is not fed with the power source.

(6) There is provided a gaming machine according to (6), further comprising an image state keeping board having image state keeping means for accepting the image signals fed from the display control means to display the image on the display device and for controlling the display device into a constant state in case the image signals are abnormal.

According to (6), "the gaming machine comprises the image state keeping board having the image state keeping means for accepting the image signals fed from the display control means to display the image on the display device and for controlling the display device into the constant state in case the image signals are abnormal". Even in case the power source is not fed to the image display unit, it is still fed independently of the power source feeding means for the display device so that the display device itself is not disconnected from the power source. By eliminating one factor, which may give an uncomfortable feel during playing the game, therefore, it is possible to provide a gaming machine, which can continue the interest of the player for a long time.

By providing such image state keeping means, moreover, the predetermined image is displayed in case the image is abnormal. By eliminating one factor, which may give an uncomfortable feel during playing the game, therefore, it is possible to provide a gaming machine, which can continue the interest of the player for a long time.

(7) A gaming machine according to (5) or (6), further comprises rotatable reels having a plurality of symbols drawn on their outer peripheries, wherein the display device is mounted on the front faces of the reels.

According to (7), "the gaming machine comprises the rotatable reels having the symbols drawn on their outer peripheries, and the display device is mounted on the front faces of the reels". The gaming machine having the display device on the reel front face to be most noted by the player can provide a game having dynamic effects but may give the more uncomfortable image influences to the player as the place is more noted. Especially in case the display device is disposed on the reel front face, it may give a relatively serious uncomfortable feeling to the player. By eliminating one cause for the uncomfortable feeling during the play, therefore, it is possible to provide the game, which can continue the interest of the player for a longer time.

(8) According to any one of (5) to (7), the gaming machine further comprises power source relay means for relaying the power source fed from the power source feeding means to branch the power source fed from the power source feeding means, to the image display unit and the display device.

According to (8), "the gaming machine further comprises the power source relay means for relaying the power source fed from the power source feeding means to branch the power source fed from the power source feeding means, to the image display unit and the display device". Therefore, the number of cables to be wired from the power source feeding means can be reduced, and many cables need not be bundled in the manufacturing process. At the reusing and recycling steps, moreover, the many cables need not be unbundled to offer conveniences.

For example, the gaming machine of the related art is constructed of: a main body having a recess; a door for covering the recess; and a device (including a board) disposed in those insides. The aforementioned power source feeding means is generally disposed in the recess of the main body. On the other hand, the device to be fed with various power sources is disposed in the recess of the main body or in the door. Therefore, not the device disposed in the main body but the device disposed in the door is disposed at a place relatively far from the power source feeding means. In order to feed the power source to those devices, it needs troublesome works to wire the many power source cables. In addition, the cables for feeding the power source are clamped by the door, when this door is opened/closed, to cause disconnections.

By providing the power source relay means, therefore, the number of power source cables to the power source relay means can be reduced to make the works easier in the manufacturing process.

Especially by providing the door with the power source relay unit having that power source relay means, the wiring works can be made efficient. In the multi-function gaming machine of recent years, moreover, many devices are disposed on the door. Therefore, the number of power source cables for feeding the power source to those devices can be reduced and efficiently wired.

(9) According to any of (5) to (8), there is provided a gaming machine, wherein the image display unit is built in the upper portion of the gaming machine.

According to (9), "the image display unit is built in the upper portion of the gaming machine". Therefore, the image display unit is built not in the lower portion, which may contact with the player but in the upper portion of the gaming machine under consideration. Therefore, the image display unit is hardly influenced by the static electricity, as might otherwise be generated by the contact with the player.

On the other hand, the static electricity may occur frequently especially in dry areas other than those of Japan. Even in case the static electricity occurs, the image state keeping board is disposed in the upper portion of the gaming machine so that the static electricity generated does not reach the image state keeping board but may highly possibly flow into the earth attached to the cabinet. Thus, the construction is effective for the countermeasures against the static electricity.

(10) There is provided a display device for a gaming machine comprising a display device for displaying an image, and display control means for displaying an image relating to a game on the display device. The display device further comprises: an image display unit having the display control means; and power source feeding means for feeding the power source independently to the display device and the image display unit.

According to (10), "the display device comprises the image display unit having the display control means; and the power source feeding means for feeding the power source independently to the display device and the image display unit". Even in case the power source is not fed to the image display unit, therefore, the power source is fed independently of the power source feeding means for the display device so that the display device itself is not disconnected from the power source. By eliminating one factor, which may give an uncomfortable feel during playing the game, therefore, it is possible to provide a gaming machine which can continue the interest of the player for a long time.

Thus, "the display device comprises the image display unit having the display control means; and the power source feeding means for feeding the power source independently to the display device and the image display unit". Even in case the power source is not fed to the image display unit, therefore, the power source is fed independently of the power source feeding means for the display device so that the display device itself is not disconnected from the power source. By eliminating one factor, which may give an uncomfortable feel during playing the game, therefore, it is possible to provide a gaming machine which can continue the interest of the player for a long time.

In order to achieve the aforementioned object, the gaming machine of the invention comprises: an image display unit having the display control means; an image state keeping unit having image state keeping means for accepting the image signals fed from the display control means, and for controlling the display device in a predetermined state in case the image signals are abnormal; and power source feeding means for feeding the power source independently to the image state keeping unit and the image display unit.

More specifically, the invention provides the following.

(11) There is provided a gaming machine comprising a display device for displaying an image, and display control means for displaying an image relating to a game on the display device. The gaming machine further comprises: an image display unit having the display control means; an image state keeping unit having image state keeping means for accepting the image signals fed from the display control means, and for controlling the display device in a predetermined state in case the image signals are abnormal; and power source feeding means for feeding the power source independently to the image state keeping unit and the image display unit.

According to (11), "the gaming machine further comprises: the image display unit having the display control means; the image state keeping unit having image state keeping means for accepting the image signals fed from the display control means, and for controlling the display device in a predetermined state in case the image signals are abnormal; and the power source feeding means for feeding the power source independently to the image state keeping unit and the image display unit". Even in case the power source is not fed to the image display unit, therefore, the power source is fed independently of the power source feeding means so that the state of the image can be kept without displaying any disturbed image. By eliminating one cause for an uncomfortable feeling during the play, therefore, it is possible to provide a game capable of continuing the interest of the player for a long time.

The aforementioned concept of "feed the power source independently" contains not only the mere use of different power source devices but also the feed of the power source to not one but the other even in case the power source device is shared.

(12) There is provided a gaming machine according to (11), wherein the image state keeping unit has not only the image state keeping means but also image enlarging conversion means for converging the accepted image signals into enlarged image signals.

According to (12), "the image state keeping unit has not only the image state keeping means but also image enlarging conversion means for converging the accepted image signals into enlarged image signals". Even in case the power source is not fed to the display control unit, therefore, the power source is fed independently of the power source feeding means so that the state of the image can be kept without displaying any disturbed image. By eliminating one cause for an uncomfortable feeling during the play, therefore, it is possible to provide a game capable of continuing the interest of the player for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image state keeping unit with the image state keeping means and the image enlarging conversion means, moreover, it is possible not only to invite no size enlargement but also to spare the space and to receive less influence of the noises.

(13) In a gaming machine according to (11) or (12), the image state keeping unit is built in the upper portion of the gaming machine.

According to (13), "the image state keeping unit is built in the upper portion of the gaming machine". Namely, the image state keeping unit is built in the upper portion of the gaming machine, not in the lower portion of the gaming machine that might be contacted the player. Therefore, the image display unit is hardly influenced by the static electricity, as might otherwise be generated by the contact with the player.

On the other hand, the static electricity may occur frequently especially in dry areas other than those of Japan. Even in case the static electricity occurs, the image state keeping unit is disposed in the upper portion of the gaming machine so that the static electricity generated does not reach the image state keeping unit but may highly possibly flow into the earth attached to the cabinet. Thus, the construction is effective for the countermeasures against the static electricity.

(14) According to any one of (11) to (13), the gaming machine further comprises rotatable reels having a plurality of symbols drawn on their outer peripheries, and the display device is mounted on the front faces of the reels.

According to (14), "the gaming machine further comprises the rotatable reels having a plurality of symbols drawn on their outer peripheries, and the display device is mounted on the front faces of the reels". The gaming machine having the display device on the reel front face to be most noted by the player can provide a game having dynamic effects but may give the more uncomfortable image influences to the player as the place is more noted. Especially in case the display device is disposed on the reel front face, it may give a relatively serious uncomfortable feeling to the player. By eliminating one cause for the uncomfortable feeling during the play, therefore, it is possible to provide the game, which can continue the interest of the player for a longer time.

On the other hand, not the uncomfortable image, as might otherwise be formed by various troubles, but the image of a relatively high transparency is displayed on the display device. In case the abnormality is detected, therefore, it is possible to make the reels visible to the player.

It is, therefore, possible to provide a game, which can continue the interest of the player without displaying the image, as might otherwise become uncomfortable during the play, unless the image signal monitoring unit becomes abnormal.

Since the reels are made visible, moreover, the game is hardly interrupted even in the abnormal case of the monitoring unit. Therefore, it is possible to provide a game, which not only can be continued but also is hardly distrusted by the player as if an improper treatment were done, so that it can continue the interest of the player.

(15) According to any one of (11) to (14), the gaming machine further comprises power source relay means for relaying the power source fed from the power source feeding means to branch the power source fed from the power source feeding means, to the image state keeping unit and the image display unit.

According to (15), "the gaming machine further comprises the power source relay means for relaying the power source fed from the power source feeding means to branch the power source fed from the power source feeding means, to the image state keeping unit and the image display unit". Therefore, the number of cables to be wired from the power source feeding means can be reduced, and many cables need not be bundled in the manufacturing process. At the reusing and recycling steps, moreover, the many cables need not be unbundled to offer conveniences.

For example, the gaming machine of the related art is constructed of: a main body having a recess; a door for covering the recess; and a device (including a board) disposed in those insides. The aforementioned power source feeding means is generally disposed in the recess of the main body. On the other hand, the device to be fed with various power sources is disposed in the recess of the main body or in the door. Therefore, not the device disposed in the main body but the device disposed in the door is disposed at a place relatively far from the power source feeding means. In order to feed the power source to those devices, it needs troublesome works to wire the many power source cables. In addition, the cables for feeding the power source are clamped by the door, when this door is opened/closed, to cause disconnections.

By providing the power source relay means, therefore, the number of power source cables to the power source relay means can be reduced to make the works easier in the manufacturing process.

Especially by providing the door with the power source relay unit having that power source relay unit, the wiring works can be made efficient. In the multi-function gaming machine of recent years, moreover, many devices are disposed on the door. Therefore, the number of power source cables for feeding the power source to those devices can be reduced and efficiently wired.

(16) There is provided a display device for a gaming machine comprising a display device for displaying an image, and display control means for displaying an image relating to a game on the display device. The display device further comprises: an image display unit having the display control means; an image state keeping unit having image state keeping means for accepting the image signals fed from the display control means, and for controlling the display device in a predetermined state in case the image signals are abnormal; and power source feeding means for feeding the power source independently to the image state keeping unit and the image display unit.

According to (16), "the display device further comprises: the image display unit having the display control means; the image state keeping unit having image state keeping means for accepting the image signals fed from the display control means, and for controlling the display device in a predetermined state in case the image signals are abnormal; and the power source feeding means for feeding the power source independently to the image state keeping unit and the image display unit". Even in case the power source is not fed to the display control unit, therefore, the power source is fed independently so that the state of the image can be kept without displaying any disturbed image. By eliminating one cause for an uncomfortable feeling during the play, therefore, it is possible to provide a game capable of continuing the interest of the player for a long time.

Thus, "the display device further comprises: the image display unit having the display control means; the image state keeping unit having image state keeping means for accepting the image signals fed from the display control means, and for controlling the display device in a predetermined state in case the image signals are abnormal; and the power source feeding means for feeding the power source independently to the image state keeping unit and the image display unit". Even in case the power source is not fed to the image display unit, therefore, the power source is fed independently so that the state of the image can be kept without displaying any disturbed image. By eliminating one cause for an uncomfortable feeling during the play, therefore, it is possible to provide a game capable of continuing the interest of the player for a long time.

In order to achieve the aforementioned object, the gaming machine of the invention comprises: an image displaying board having the display control means; and image signal control means for accepting image signals from the display control means to display an image on the display device and for detecting abnormality of the image signals, and transparent image display means for displaying an image of a relatively high transparency on the display device in case the abnormality of the image signals is detected by the image signal control means.

More specifically, the invention provides the following items.

(17) There is provided a gaming machine comprising: rotatable reels having a plurality of symbols drawn on their outer peripheries; a display device mounted on the front faces of the reels for displaying an image; and display control means for displaying an image relating to a game on the display device. The gaming machine further comprises: an image displaying board having the display control means; and image signal control means for accepting image signals from the display control means to display an image on the display device and for detecting abnormality of the image signals, and transparent image display means for displaying an image of a relatively high transparency on the display device in case the abnormality of the image signals is detected by the image signal control means.

According to (17), "the gaming machine further comprises: the image displaying board having the display control means; and the image signal control board including image signal control means for accepting image signals from the display control means to display an image on the display device and for detecting abnormality of the image signals, and transparent image display means for displaying an image of a relatively high transparency on the display device in case the abnormality of the image signals is detected by the image signal control means". Therefore, not the uncomfortable image, as might otherwise be formed by various troubles, but the image of a relatively high transparency is displayed on the display device. In case the abnormality is detected, therefore, it is possible to make the reels visible to the player.

It is, therefore, possible to provide a game, which can continue the interest of the player without displaying the image, as might otherwise become uncomfortable during the play, unless the image signal control board becomes abnormal.

Since the reels are made visible, moreover, the game is hardly interrupted even in the abnormal case of the monitoring unit. Therefore, it is possible to provide a game, which not only can be continued but also is hardly distrusted by the player as if an improper treatment were done, so that it can continue the interest of the player.

(18) In the gaming machine according to (17), the image signal control board includes not only the image signal control means and the transparent image display means but also image enlarging conversion means for converging the accepted image signals into enlarged image signals.

According to (18), "the image signal control board includes not only the image signal control means and the transparent image display means but also image enlarging conversion means for converging the accepted image signals into enlarged image signals". Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game, which can continue the interest of the player for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image signal monitoring board with the image state keeping means and the image enlarging conversion means, moreover, it is possible to reduce the number of boards, and not only to invite no size enlargement but also to spare the space. Moreover, signals are fed through the wires formed on the board so that less influence of the noises is received.

(19) In the gaming machine according to (17) or (18), the display control means has a function to display a colored image on the display unit so that the colored image may be invisible to a player.

According to (19), "the display control means has a function to display a colored image on the display unit so that the colored image may be invisible to a player". Therefore, not the uncomfortable image, as might otherwise be formed by various troubles, but the image of a relatively high transparency is displayed on the display device. In case the abnormality is detected, therefore, it is possible to make the reels visible to the player.

It is, therefore, possible to provide a game, which can continue the interest of the player without displaying the image, as might otherwise become uncomfortable during the play, unless the image signal control board becomes abnormal.

Since the reels are made visible, moreover, the game is hardly interrupted even in the abnormal case of the monitoring unit. Therefore, it is possible to provide a game, which not only can be continued but also is hardly distrusted by the player as if an improper treatment were done, so that it can continue the interest of the player.

(20) In the gaming machine according to any of (17) to (19), the image signal control board is built in the upper portion of the gaming machine.

According to (20), "the image signal control board is built in the upper portion of the gaming machine". Therefore, the image signal control board is built not in the lower portion, which may contact with the player but in the upper portion of the gaming machine. Therefore, the gaming machine is hardly influenced by the static electricity, as might otherwise be generated by the contact with the player.

On the other hand, the static electricity may occur frequently especially in dry areas other than those of Japan. Even in case the static electricity occurs, the image signal control board is disposed in the upper portion of the gaming machine so that the static electricity generated does not reach the image signal control board but may highly possibly flow into the earth attached to the cabinet. Thus, the construction is effective for the countermeasures against the static electricity.

(21) There is provided a display device for a gaming machine comprising: rotatable reels having a plurality of symbols drawn on their outer peripheries; a display device mounted on the front faces of the reels for displaying an image; and display control means for displaying an image relating to a game on the display device. The display device further comprises: an image displaying board having the display control means; and an image signal control board including image signal control means for accepting image signals from the display control means to display an image on the display device and for detecting abnormality of the image signals, and transparent image display means for displaying an image of a relatively high transparency on the display device in case the abnormality of the image signals is detected by the image signal control means.

According to (21), "the display device further comprises: the image displaying board having the display control means; and the image signal control board including the image signal control means for accepting image signals from the display control means to display an image on the display device and for detecting abnormality of the image signals, and transparent image display means for displaying an image of a relatively high transparency on the display device in case the abnormality of the image signals is detected by the image signal control means". Therefore, not the uncomfortable image, as might otherwise be formed by various troubles, but the image of a relatively high transparency is displayed on the display device. In case the abnormality is detected, therefore, it is possible to make the reels visible to the player.

It is, therefore, possible to provide a game, which can continue the interest of the player without displaying the image, as might otherwise become uncomfortable during the play, unless the image signal control board becomes abnormal.

Since the reels are made visible, moreover, the game is hardly interrupted even in the abnormal case of the monitoring unit. Therefore, it is possible to provide a game, which not only can be continued but also is hardly distrusted by the player as if an improper treatment were done, so that it can continue the interest of the player.

In order to achieve the aforementioned object, the gaming machine of the invention comprises: an image display unit having the display control means; and an image state keeping unit having image state keeping means for accepting the image signals fed from the display control means to display image on the image display unit, and for controlling the display device in a predetermined state in case the image signals are abnormal.

More specifically, the invention provides the following.

(22) There is provided a gaming machine comprising a display device for displaying an image, and display control means for displaying an image relating to a game on the display device. The gaming machine further comprises: an image display unit having the display control means; and an image state keeping unit having image state keeping means for accepting the image signals fed from the display control means to display an image on the image display unit, and for controlling the display device in a predetermined state in case the image signals are abnormal.

According to (22), "the gaming machine further comprises: the image display unit having the display control means; and the image state keeping unit having the image state keeping means for accepting the image signals fed from the display control means, and for controlling the display device in a predetermined state in case the image signals are abnormal". Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game, which can continue the interest of the player for a long time.

By displaying disturbed images formed due to failures in the display device, the display control means and the power feed, for example, the game provided makes the player feel uncomfortable. By eliminating one cause for the uncomfortable feeling, therefore, it is possible to provide a game capable of continuing the interest of the player for a long time.

(23) The image state keeping unit has not only the image state keeping means but also image enlarging conversion means for converging the image signals accepted from the display control means into enlarged image signals.

According to (23), "the image state keeping unit has not only the image state keeping means but also image enlarging conversion means for converging the image signals accepted from the display control means into enlarged image signals". Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game, which can continue the interest of the player for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image state keeping unit with the image state keeping means and the image enlarging conversion means, moreover, it is possible not only to invite no size enlargement but also to spare the space and to receive less influence of the noises.

(24) The gaming machine according to (22) or (23) further comprises rotatable reels having a plurality of symbols drawn on their outer peripheries, and the display device has transparent image display means mounted on the front faces of the reels for displaying an image of relatively high transparency.

According to (24), "the gaming machine according to (22) or (23) further comprises rotatable reels having a plurality of symbols drawn on their outer peripheries, and the display device has transparent image display means mounted on the front faces of the reels for displaying an image of relatively high transparency". The gaming machine having the display device on the reel front face to be most noted by the player can provide a game having dynamic effects but may give the more uncomfortable image influences to the player as the place is more noted. Especially in case the display device is disposed on the reel front face, it may give a relatively serious uncomfortable feeling to the player. By eliminating one cause for the uncomfortable feeling during the play, therefore, it is possible to provide the game, which can continue the interest of the player for a longer time.

(25) In the gaming machine according to any one of (22) to (24), the image state keeping unit is built in the upper portion of the gaming machine.

According to (25), "the image state keeping unit is built in the upper portion of the gaming machine". Therefore, the image state keeping unit is built not in the lower portion which may contact with the player but in the upper portion of the gaming machine, so that it is hardly influenced by the static electricity to be generated by the contact with the player.

On the other hand, the static electricity may occur frequently especially in dry areas other than those of Japan. Even in case the static electricity occurs, the image state keeping unit is disposed in the upper portion of the gaming machine so that the static electricity generated does not reach the image state keeping unit but may highly possibly flow into the earth attached to the cabinet. Thus, the construction is effective for the countermeasures against the static electricity.

(26) There is provided a display device for a gaming machine comprising a display device for displaying an image, and display control means for displaying an image relating to a game on the display device. The display device further comprises: an image display unit having the display control means; and an image state keeping unit having image state keeping means for accepting the image signals fed from the display control means to display an image on the image display unit, and for controlling the display device in a predetermined state in case the image signals are abnormal.

According to (26), "the display device further comprises: an image display unit having the display control means; and an image state keeping unit having image state keeping means for accepting the image signals fed from the display control means to display an image on the image display unit, and for controlling the display device in a predetermined state in case the image signals are abnormal". Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game, which can continue the interest of the player for a long time.

By displaying disturbed images formed due to failures in the display device, the display control means and the power feed, for example, the game provided makes the player feel uncomfortable. By eliminating one cause for the uncomfortable feeling, therefore, it is possible to provide a game capable of continuing the interest of the player for a long time.

In order to achieve the aforementioned object, the gaming machine of the invention further comprises: an image display unit having the display control means; and an image state keeping unit having image state keeping means for accepting the image signals fed from the display control means to display an image on the display unit, and for controlling the display device in a predetermined state in case the image signals are abnormal.

More specifically, the invention provides the following.

(27) There is provided a gaming machine comprising: a display device for displaying an image relating to a game; and an image state keeping unit for controlling the image to be displayed. The gaming machine is characterized in that the image state keeping unit controls the display device into a predetermined state, when it determines that image signals fed to the display device and relating to the image fail to satisfy a predetermined condition.

According to (27), "the display device further comprises: an image display unit having the display control means; and an image state keeping unit having image state keeping means for accepting the image signals fed from the display control means to display an image on the image display unit, and for controlling the display device in a predetermined state in case the image signals are abnormal". Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game, which can continue the interest of the player for a long time.

If the image is displayed with the disturbance caused by the abnormality of the display device or the display control means or by the failure in the power source feed, for example, the player may feel uncomfortable. Unless the disturbed image is displayed, therefore, the interest of the player can be continued for a long time.

The aforementioned "display device" is specified by the display device (designated by 30) to be explained in the later-described embodiment. More specifically, the display device is constructed to include the liquid crystal display device (designated by 54), the liquid crystal drive circuit (designated by 291) and the liquid crystal backlights (designated by 292). On the other hand, the aforementioned "display control means" is specified by the image control circuit (designated by 250) to be explained in the later-described embodiment. On the other hand, the aforementioned "image display unit" is specified by the subsidiary control circuit (designated by 200) to be explained in the later-described embodiment. On the other hand, the "image state keeping unit" is specified by the scale circuit (designated by 400) to be explained in the later-described embodiment.

(28) In the gaming machine according to (27), the image state keeping unit has not only the image state keeping means but also image enlarging conversion means for converging the image signals accepted from the display control means into enlarged image signals.

According to (28), "the image state keeping unit has not only the image state keeping means but also image enlarging conversion means for converging the image signals accepted from the display control means into enlarged image signals". Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game, which can continue the interest of the player for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image state keeping unit with the image state keeping means and the image enlarging conversion means, moreover, it is possible not only to invite no size enlargement but also to spare the space and to receive less influence of the noises.

(29) The gaming machine according to (27) or (28) further comprises rotatable reels having a plurality of symbols drawn on their outer peripheries, and the display device has transparent image display means mounted on the front faces of the reels for displaying an image of relatively high transparency.

According to the invention (29), "the gaming machine according to (27) or (28) further comprises rotatable reels having a plurality of symbols drawn on their outer peripheries, and the display device has transparent image display means mounted on the front faces of the reels for displaying an image of relatively high transparency". The gaming machine having the display device on the reel front face to be most noted by the player can provide a game having dynamic effects but may give the more uncomfortable image influences to the player as the place is more noted. Especially in case the display device is disposed on the reel front face, it may give a relatively serious uncomfortable feeling to the player. By eliminating one cause for the uncomfortable feeling during the play, therefore, it is possible to provide the game, which can continue the interest of the player for a longer time.

(30) In the gaming machine according to any one of (27) to (29), the image state keeping unit is built in the upper portion of the gaming machine.

According to (30), "the image state keeping unit is built in the upper portion of the gaming machine". Therefore, the image state keeping unit is built not in the lower portion which may contact with the player but in the upper portion of the gaming machine, so that it is hardly influence by the static electricity to be generated by the contact with the player.

On the other hand, the static electricity may occur frequently especially in dry areas other than those of Japan. Even in case the static electricity occurs, the image state keeping unit is disposed in the upper portion of the gaming machine so that the static electricity generated does not reach the image state keeping unit but may highly possibly flow into the earth attached to the cabinet. Thus, the construction is effective for the countermeasures against the static electricity.

(31) There is provided a display device for a gaming machine comprising a display device for displaying an image, and display control means for displaying an image relating to a game on the display device. The display device further comprises: an image display unit having the display control means; and an image state keeping unit having image state keeping means for accepting the image signals fed from the display control means to display an image on the image display unit, and for controlling the display device in a predetermined state in case the image signals are abnormal.

According to (31), "the display device further comprises: an image display unit having the display control means; and an image state keeping unit having image state keeping means for accepting the image signals fed from the display control means to display an image on the image display unit, and for controlling the display device in a predetermined state in case the image signals are abnormal". Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game, which can continue the interest of the player for a long time.

By displaying disturbed images formed due to failures in the display device, the display control means and the power feed, for example, the game provided makes the player feel uncomfortable. By eliminating one cause for the uncomfortable feeling, therefore, it is possible to provide a game capable of continuing the interest of the player for a long time.

In order to achieve the aforementioned object, the gaming machine of the invention further comprises: an image display unit having the display control means; and power source feeding means for feeding the power source independently to the display device and the image display unit.

BRIEF DESCRIPTION OF THE DRAWINGS

FIG. 13 is a flow chart showing a control process to be executed in the slot machine according to the invention;

DETAILED DESCRIPTION OF THE INVENTION

The invention will be described in connection with its embodiment with reference to the accompanying drawings. In this embodiment to be described, the invention is applied to a slot machine, and a plurality of mechanically rotatable reels are used as variable display devices for variably displaying a plurality of kinds of discrimination information images necessary for a game. However, the invention should not be limited thereto but could be adopted in various gaming machines such as a pinball gaming machine, a medal gaming machine or a card gaming machine.

[Construction of Gaming Machine]

Figure 1:
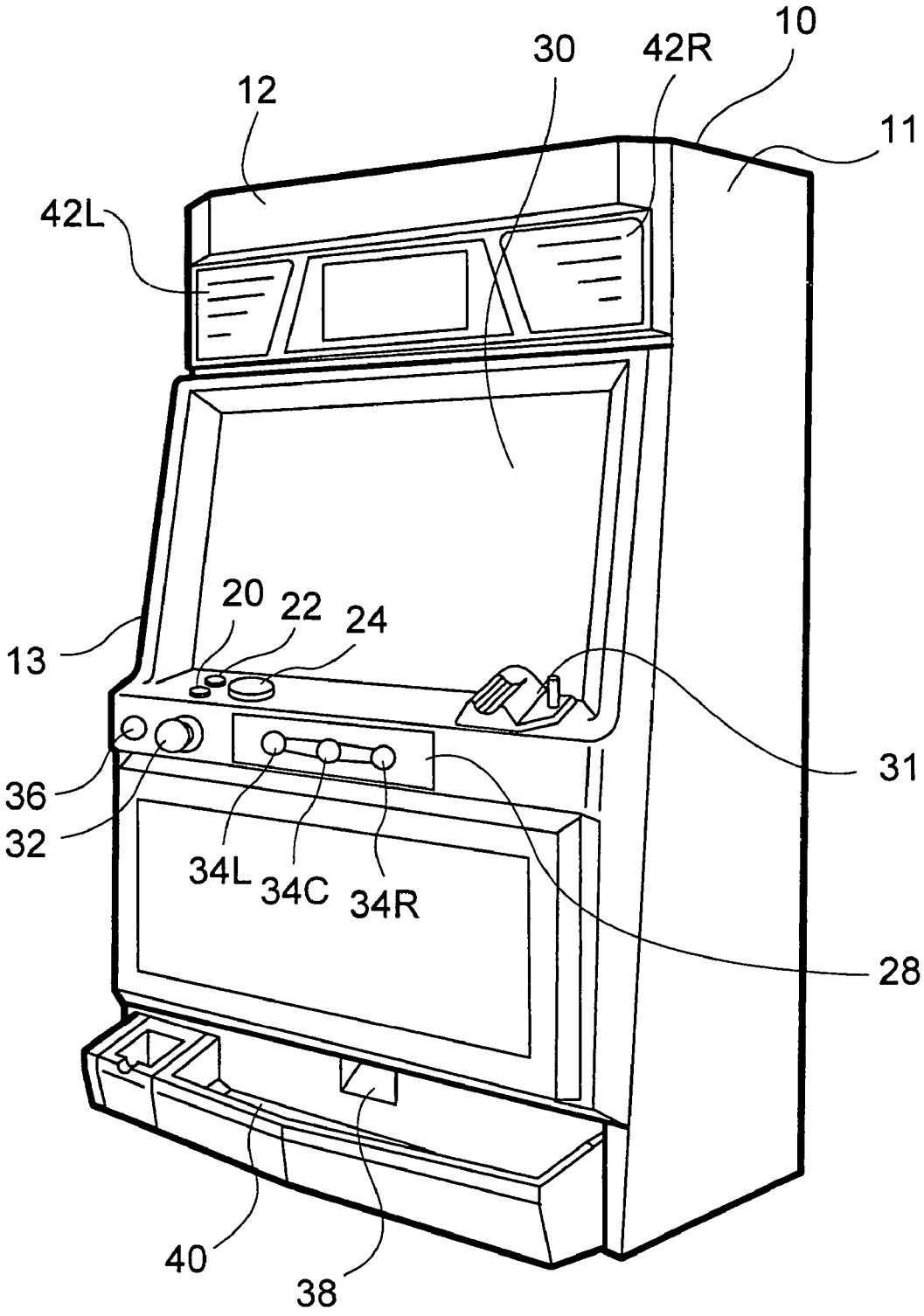
FIG. 1 is a perspective view showing an outline of a slot machine according to the invention.

A slot machine 10 is schematically shown in FIG. 1.

A cabinet 12 enclosing the slot machine 10 is constructed of a main body 11 and a door 13.

The cabinet 12 forming the entirety of the slot machine 10 is provided on its front face with a rectangular display device 30. This display device 30 is a liquid crystal display for displaying various images such as images for informing the game contents or effect images for pleasing the player.

Moreover, this display device 30 can display images of XGA type, 1,024 bits wide and 768 bits high, red data, green data and blue data of 8 bits, as will be detailed.

Moreover, this display device 30 can control the display images into images of relatively high transparency so that they can make reels 26L, 26C and 26R (as referred to FIG. 2), as mounted on the back of the display device 30, visible to the player.

Moreover, this display device 30 is provided with a touch panel 51 (as referred to FIG. 6) so that the player can perform various operations.

Figure 2:
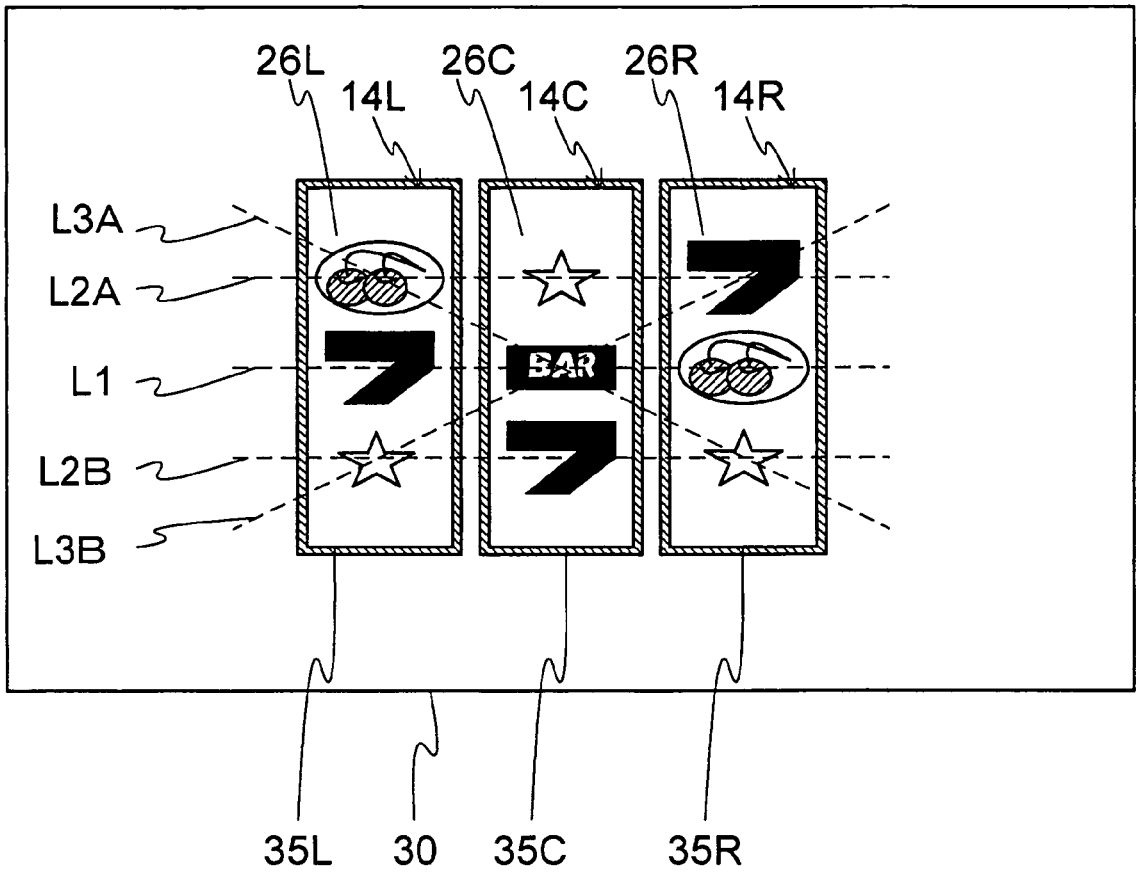
FIG. 2 is a schematic diagram showing a display screen of the slot machine according to the invention.

On the other hand, this display device 30 is provided on its back with rectangular display windows 14 (14L, 14C and 14R), as shown in FIG. 2. This display device 30 is provided on its peripheral edge with a later-described frame member 33 (as referred to FIG. 4), so that the reels 26L, 26C and 26R may be exclusively viewed by the player from the display windows 14 in case the images are displayed with the display device 30 being in the state of relatively high transparency.

Inside of the cabinet 12, there are rotatably provided the three reels 26L, 26C and 26R, on the individual outer peripheries of which a plurality of kinds of description information images are drawn. These reels 26L, 26C and 26R can be viewed individually through the aforementioned display windows 14.

Moreover, the reels 26L, 26C and 26R are so rotatably driven that the discrimination information images drawn on the outer peripheries of the reels 26L, 26C and 26R may move downward through the display windows 14. When the individual rotations of the reels 26L, 26C and 26R stop, moreover, the discrimination information images drawn on the three outer peripheries are visible for each reel through the display windows 14.

As shown in FIG. 1, moreover, a generally horizontal pedestal portion 28 is disposed below the display device 30, and a medal insertion opening 31 is formed on the right side of the upper face of the pedestal portion 28.

On the left side on the upper face of the pedestal portion 28, moreover, there are disposed: a 1-BET switch 20 for betting only one of medals inserted; a 2-BET switch 22 for betting only two of medals inserted; and a MAX-BET switch 24 for betting the inserted medals in the maximum number allowed for one play.

When the player operates the 1-BET switch 20, as shown in FIG. 2, of the three visible discrimination information images of the individual three reels, only a winning line L1 composed of a combination of three central discrimination information images is activated (that is, the combination of the discrimination information images active for the decision of the game result will be called the "activated line") for the decision of the game result.

When the 2-BET switch 22 is operated, on the other hand, there are activated the totally three winning lines: the aforementioned activated line; and such winning lines L2A and L2B of the three visible discrimination information images of the individual three reels as composed of a combination of the upper discrimination information images and a combination of the lower discrimination information images, respectively.

When the MAX-BET switch 24 is operated, moreover, if the medals inserted are three or more, there are activated all the five winning lines L1, L2A, L2B, L3A and L3B: the aforementioned activated lines; a winning line L3A composed of a combination of the upper discrimination information image on the reel 26L, the central discrimination information image on the reel 26C and the lower discrimination information image on the reel 26R; and a winning line L3B composed of a combination of the lower discrimination information image on the reel 26L, the central discrimination information image on the reel C and the upper discrimination information image on the reel 26R.

In case the remainder of the inserted medals is two, however, only three L1, L2A and L2B of the five winning lines are activated. In case the remainder of the inserted medals is one, on the other hand, only one line L1 of the five winning lines is activated. The winning lines thus activated are reported to the player by displaying the activations on the side of the display windows 14.

By pushing one of these BET switches 20, 22 and 24, the aforementioned winning line is activated according to the BET switch pushed. The game starting state is established, when the aforementioned 1-BET switch 20, 2-BET switch 22 or MAX-BET switch 24 is pushed by the player.

On the left side of the front face of the pedestal portion 28, as shown in FIG. 1, there is disposed a tiltable start lever 32. When this start lever 32 is tilted by the player, the rotations of the aforementioned three reels 26L, 26C and 26R are started all at once. When these three reels 26L, 26C and 26R are rotated, the discrimination information images drawn on the individual outer peripheries of the reels 26L, 26C and 26R are displayed in motion in the display windows 14. When the rotating speeds of the three reels 26L, 26C and 26R reach a predetermined level, the operations of later-described stop buttons 34L, 34C and 34R by the player are activated.

The pedestal portion 28 is provided at the center of its front face with the three stop buttons 34L, 34C and 34R. Of these: the stop button 34L corresponds to the reel 26L; the stop button 34C corresponds to the reel 26C; and the stop button 34R corresponds to the reel 26R. When the player pushes the stop button 34L, the reel 26L is stopped; when the player pushes the stop button 34C, the reel 26C is stopped; and when the player pushes the stop button 34R, the reel 26R is stopped.

On the left side of the start lever 32, there is disposed a stocked medal settling button 36. When the player pushes the stocked medal settling button 36, the medals inserted are paid out from a medal payout opening 38 disposed in the lower portion of the front face, and the medals paid out are accumulated in a medal receiving tray 40.

On the upper side of the slot machine 10, moreover, there are disposed sound openings 42 (42L and 42R) for passing the sounds emitted from speakers (as referred to FIG. 8) housed in the cabinet 12, to the outside of the cabinet 12.

A predetermined number of, e.g., 21 discrimination information images are drawn on the outer peripheries of the aforementioned individual reels 26L, 26C and 26R. Depending on the arrangements of those discrimination information images visible through the display windows 14 at the time when the reels 26L, 26C and 26R are individual by stopped, the medals are paid out, or the game is transferred to a more advantageous state for the player.

[Display Mode of Gaming Machine]

The aforementioned display device 30 will be described with reference to FIG. 2 to FIG. 4.

This display device 30 can display not only the various images but also the highly transparent images. These highly transparent images are the images, which are formed in highly transparent color tones of the liquid crystal display device. In case the highly transparent images are displayed in the display windows 14, the background reel symbols can be viewed although they are different in the color tones used. As these images, the various images and the highly transparent images can be displayed not only all over the screen but also on local areas.

By displaying the display device 30 highly transparently along the display windows 14, for example, the reels 26L, 26C and 26R disposed actually on the back face can be made visible to the player, as shown in FIG. 2. On the peripheral edges of the reels 26L, 26C and 26R, moreover, there are displayed border images 35 (35L, 35C and 35R).

Figure 3:
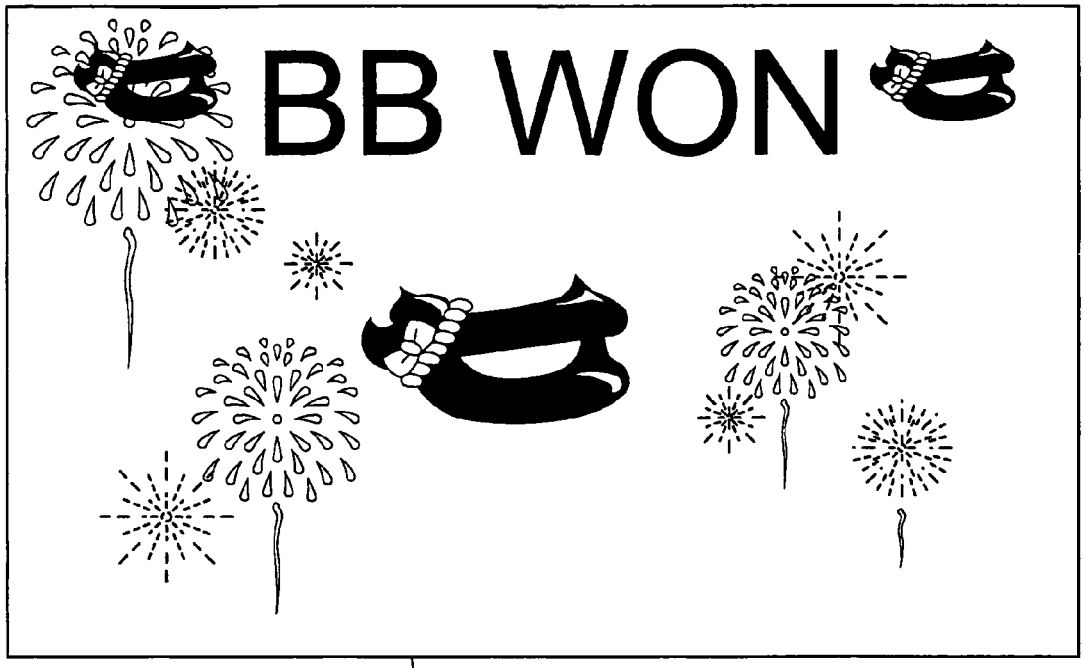
FIG. 3 is a schematic diagram showing a display screen of the slot machine according to the invention.

In addition to this highly transparent display of the display device 30, moreover, the various effect images using the low transparent color tones (i.e., the so-called "black outputs") can be displayed to make their background invisible to the player, as shown in FIG. 3, so that the reels 26L, 26C and 26R on the back face may become invisible.

Figure 4:
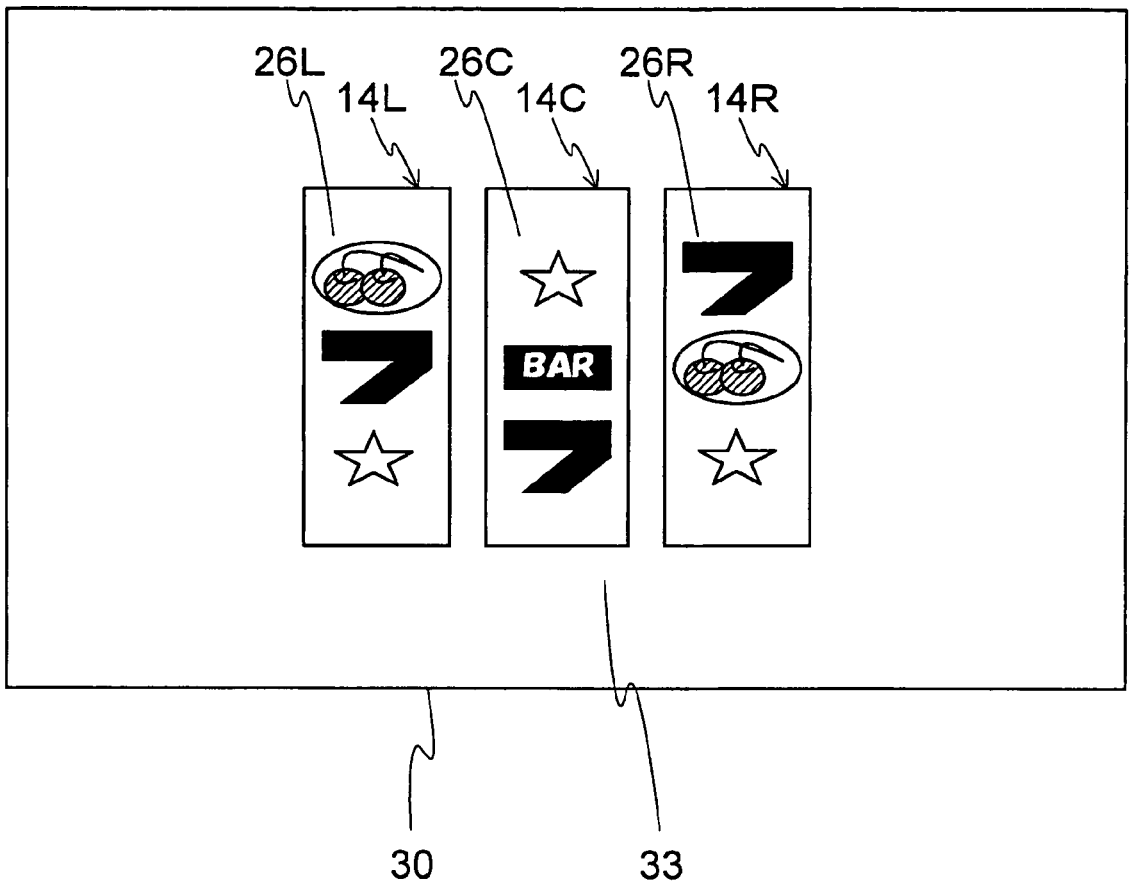
FIG. 4 is a schematic diagram showing a display screen of the slot machine according to the invention.

Moreover, the whole face of the display device 30 can be displayed highly transparently so that the reels 26L, 26C and 26R from the display windows 14 and the frame member 33 on the peripheral edges of the display windows 14 can be viewed by the player, as shown in FIG. 4. The frame member 33 is thus formed so that only the necessary minimum portion but not the remaining portion is visible to the player.

[Board Construction of Gaming Machine]

Figure 5:
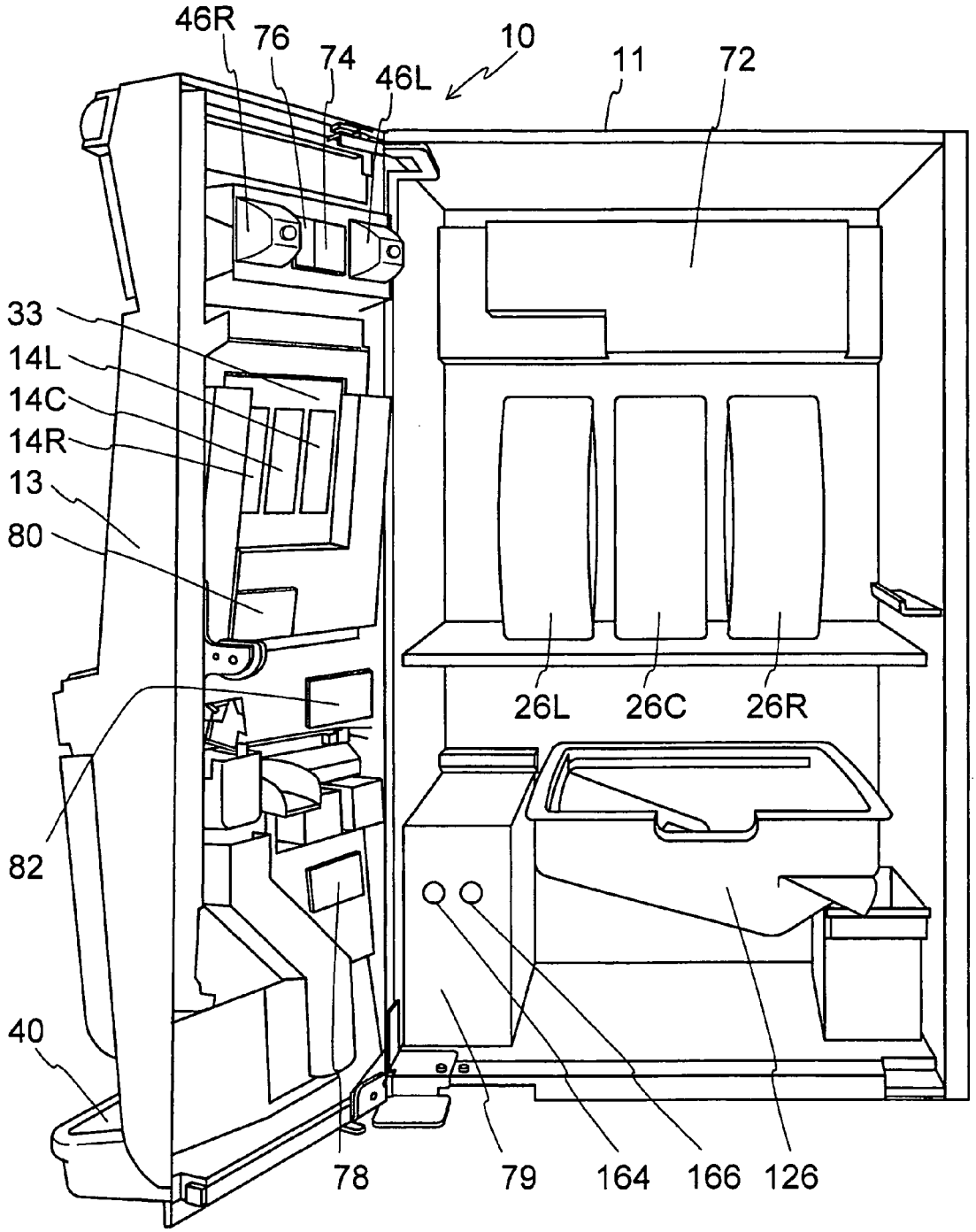
FIG. 5 is a perspective view showing an outline of the slot machine according to the invention.

A schematic diagram showing the cabinet inside of the slot machine is shown in FIG. 5. Here in FIG. 5, the door 13 is opened from the slot machine 10.

In the slot machine 10, as shown in FIG. 5, there are mounted various devices and various control boards.

The slot machine 10 is provided on the side of the main body 11, as shown in FIG. 5, with the reels 26L, 26C and 26R, a hopper 126 for stocking game media, and a power source device 79 for feeding the electric power to the slot machine 10 as a whole. Moreover, there are arranged various boards and devices, such as a main control board 72, on which there is packaged a main control circuit 100 (as referred to FIG. 8) including a random number generator 116 (as referred to FIG. 8) for generating a random number for drawing lots on whether or not an advantageous state is established for the player and a main CPU 102 (as referred to FIG. 8).

On the side of the door 13 of the slot machine 10, on the other hand, there are arranged various devices and various control boards, as including a subsidiary control board 74, a scale board 76, a lamp control board 78, an image display subsidiary board 80 and a power source relay board 82.

On these boards, there are packaged various circuits.

On the subsidiary control board 74, there is packaged a subsidiary control circuit 200 (as referred to FIG. 8) for determining various effect modes either on the basis of signals and instructions from the main control circuit 100, or not.

On the scale board 76, there is packaged a scale circuit 400 (as referred to FIG. 8) for enlarging and converting the image signals fed from the subsidiary control board 74, to display the image in the enlarged state on the display device 30 and for monitoring the signal fed from the subsidiary control board 74, to make various controls on the display device 30 in case abnormality is determined.

On the lamp control board 78, there is packaged a lamp control circuit 300 (as referred to FIG. 8) for making lamp effects and sound effects on the basis of the effect signal fed from the subsidiary control board 74.

On the image display subsidiary board 80, there is packaged an image display subsidiary circuit (although not shown), which forms part of the display device 30 for driving the image signals fed from the scale board 76 and for controlling liquid crystal backlights 292 (as referred to FIG. 11) of the display device 30.

On the other hand, the power source relay board 82 has functions to accept the power source concentratedly from the power source device 79 and to distribute it independently to the aforementioned boards and devices.

On the other hand, the aforementioned subsidiary control board 74 and scale board 76 are arranged in the upper portion of the door 13.

In short, the image state keeping unit thus far described is built in the upper portion of the gaming machine under consideration. Therefore, the image state keeping unit is not located in such a lower portion of the gaming machine as might otherwise be contacted by the player, so that it is hardly influenced by the static electricity to be generated by the contact with the player.

On the other hand, the image signal control unit thus far described is built in the upper portion of the gaming machine under consideration. Therefore, the image signal control unit is not in the lower portion, as might be contacted by the player, of the gaming machine but in the upper portion of the gaming machine so that it is hardly influenced by the static electricity, as might otherwise be generated by the contact with the player.

Moreover, the image display unit is built in the upper portion of the gaming machine under consideration and has little contact with the player so that it is hardly influenced by the static electricity, as might otherwise be generated by the contact with the player.

With the construction thus far described, on the other hand, the static electricity may occur frequently especially in dry areas other than those of Japan. Even in case the static electricity occurs, the image state keeping unit is disposed in the upper portion of the gaming machine so that the static electricity generated does not reach the image state keeping area but may highly possibly flow into the earth attached to the cabinet. Thus, the construction is effective for countermeasures against the static electricity.

On the other hand, the lamp control board 78 is arranged in the lower portion of the door 13. As compared with the subsidiary control board 74 and the scale board 76, however, the lamp control board 78 is more hardly influenced by the output of the static electricity. Therefore, the lamp control board 78 is arranged at that position because of the arrangement space.

Here in the slot machine 10 according to this embodiment: the main control board 72 is arranged in the main body 11; the subsidiary control board 74 and the remaining boards are arranged in the door 13. However, the arrangement of the invention should not be limited thereto, but it is arbitrary to arrange the subsidiary control board 74 and the remaining boards in the main body 11 and the main control board 72 in the door 13.

Moreover, the power source device 79 is provided with a reset switch 164, a set switch 166 and so on.

[Structure of Display Device]

Figure 6:
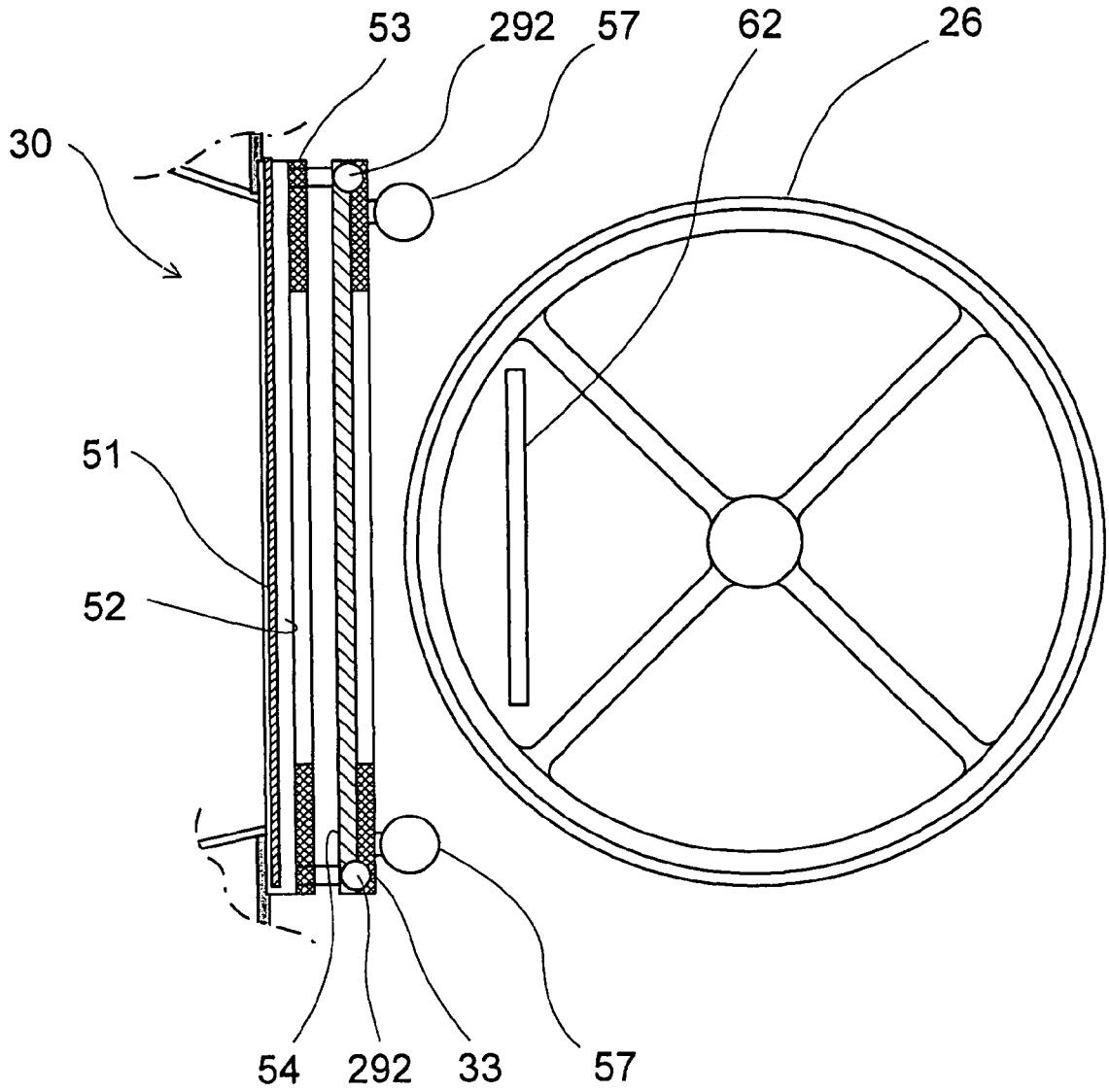
FIG. 6 is an explanatory view showing a display device of the slot machine according to the invention.

On the other hand, the detail of the display device 30 in the slot machine 10 will be described with reference to FIG. 6.

The door 13 is provided with the display device 30, on which the various effect images are displayed.

In this display device 30, on the inner side of the touch panel 51 for detecting the coordinate position contacted by the player and a transparent acryl plate 52 acting as a protective cover, there are laminated a picture sheet 53, in which various symbols are printed on a transparent film member, and a liquid crystal display device 54 which is constructed of a transparent liquid crystal display device such as an ITO.

In the upper and lower portions of the liquid crystal display device 54, moreover, there are disposed the liquid crystal backlights 292 for playing the role of an illuminating device as backlights for the liquid crystal display device 54. Moreover, the liquid crystal backlights 292 are so controlled that they are turned ON at the power source feeding time. By driving the liquid crystal backlights 292 always at the power supply feeding time, therefore, the images to be displayed in the liquid crystal display device 54 are made clearly visible to the player. In these liquid crystal backlights 292, there are mainly adopted the cold-cathode tubes, to which the invention should not be limited.

In the upper portion and lower portion on the inner face side of the display device 30, moreover, there are disposed symbol illuminating lamps 57, which play the role of an illuminating device for illuminating the symbols on the reels 26. Moreover, these symbol illuminating lamps 57 are controlled to be turned ON when they are fed with the power source. By driving these symbol illuminating lamps 57 at all times, therefore, the symbols can be clearly viewed. In these symbol illuminating lamps 57, there are mainly adopted the cold-cathode tubes, to which the invention should not be limited.

In the actions of the individual display elements, the symbols drawn on the picture sheet 53 are not influenced by the effect control state of the slot machine 10 so that they can always be viewed by the player. The liquid crystal display device 54 is a display region for image effects such as the bit hit effect or various advance notice effects.

In the vicinity of the front faces of the reels 26, moreover, there are provided lamp housings 62 (62L, 62C and 62R) having reel back lamps 63 (63L, 63C and 63R) (as referred to FIG. 7) mounted thereon.

[Structure of Reel Back Lamps]

These reel back lamps 63 will be described with reference to FIG. 7.

Figure 7:
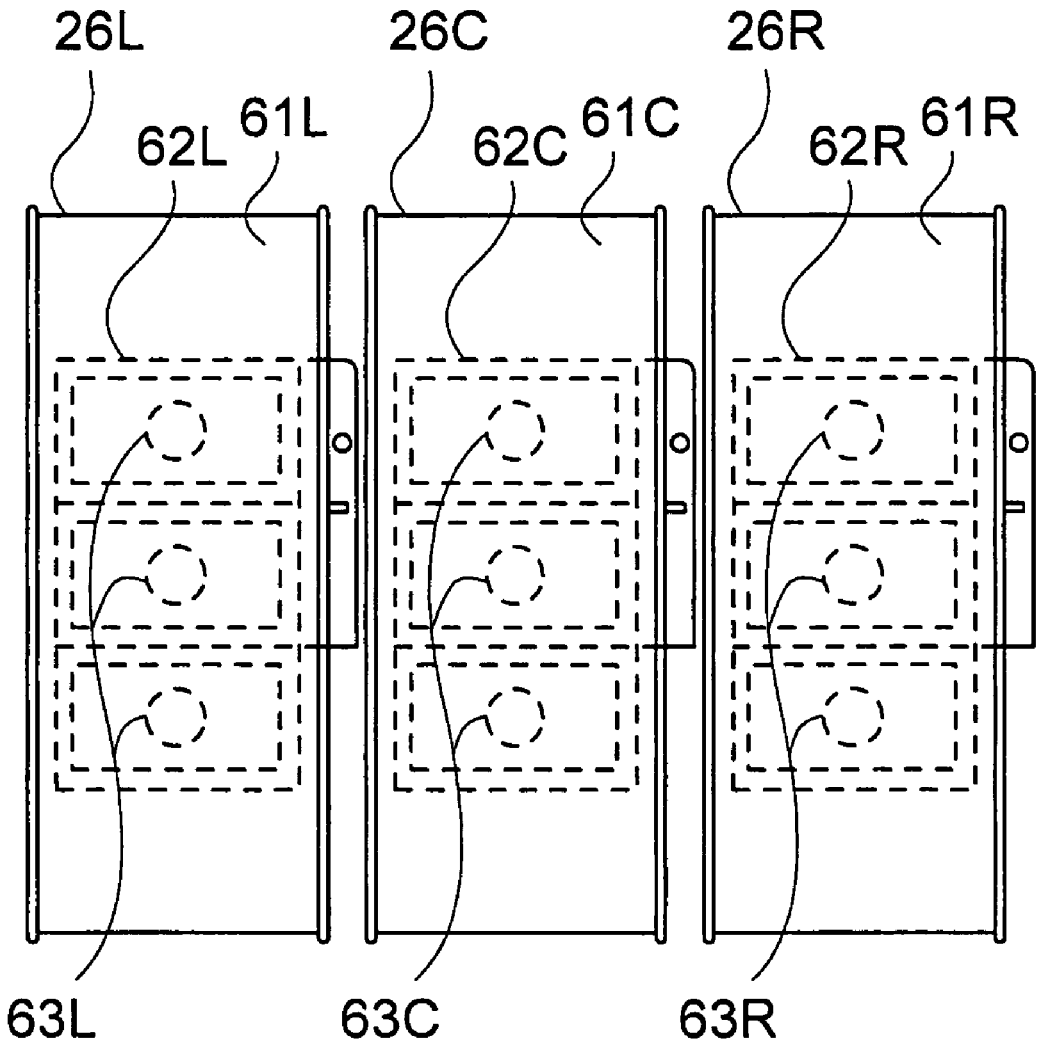
FIG. 7 is an explanatory view showing the display device of the slot machine according to the invention.

FIG. 7 is an enlarged view of the reels 26L, 26C and 26R.

These reels 26L, 26C and 26R have reel bands 61L, 61C and 61R made of a semitransparent film material, on which individual symbols such as a symbol "cherry" or a symbol "7" are printed in optically transparent color inks while the remaining regions being masked with shielding ink.

On the backs of the reel bands 61L, 61C and 61R, there are disposed the lamp housings 62L, 62C and 62R, which shield the beams of the individual lamps so that the beams may not interfere with the other symbol regions. The reel back lamps 63L, 63C and 63R are packaged in the individual compartments of the lamp housings 62L, 62C and 62R.

The lamp control circuit 300 controls the reel back lamps 63L, 63C and 63R so that they may flash on the basis of the parameters determined by a sub-microcomputer 210.

At the medal payout times, for example, there are prepared the flashing control for flashing the reel back lamps 63L, 63C and 63R of the symbols on the winning lines, and the flashing modes different for the internal winning combinations. The player is hinted what winning symbol to be aimed at, by the effect display made when each winning flag is satisfied.

Moreover, the reel back lamps 63L, 63C and 63R are usually kept in the lighting state so as to make the symbols easily visible. At the power ON time and at the reset time, moreover, the reel back lamps are activated to keep the lighting state of the lighting/extinguishing states.

As described above, moreover, the effects on the symbols may be made by extinguishing the lights. In this embodiment, on the other hand, the effects are made on the symbols. However, the invention should not be limited thereto and may not make effects on the symbols. In this case, at the power ON time and at the reset time, the lighting/extinguishing states are turned to the lighting state by activating the reel back lamps 63L, 63C and 63R and by lighting them at all times.

In this embodiment, moreover, the effects on the symbols may be made by the extinguishing operations. However, the invention should not be limited thereto, but the effects may be made with various color lights. In this case, at the power ON time and at the reset time, the lighting/extinguishing states are turned to the lighting state by activating the reel back lamps 63L, 63C and 63R and by lighting them at all times.

The reel illuminating means such as the reel back lamps may illuminate the aforementioned reels in case the power source is turned ON. On the basis of the operation of the power ON, the function to illuminate the reels is activated to make the reels easily visible. Therefore, it is possible to continue the interest of the player for a long time. Since this visibility is made easier, moreover, the game makes the player hardly tired to keep the interest of the player for a long time.

Moreover, the reel illuminating means may have a function to illuminate the reels at all times when the power source is ON. In case the gaming machine is powered, i.e., in case the gaming machine may be played, therefore, the reels are made easily visible to continue the interest of the player for a long time. If this visibility is made easier, moreover, the game makes the player hardly tired to keep the interest of the player for a long time.

In case the effects are made, moreover, the reel illuminating means may be turned OFF. In case the effects are not made, however, the reels are illuminated. In other words, the reels can be made easily visible by the illumination means. Even in case the reels are not illuminated by the illumination means, they can be made visible with or without the effects.

Still moreover, "the gaming machine further comprises: a display device mounted on the front faces of the reels for displaying an image; and display control means for displaying an image relating to a game on the display device, and the display control means has a function to display an image of a relatively high transparency on the display device". Therefore, the invisibility is eliminated by displaying an image of a relatively high transparency. Thus, it is possible provide a game, which can make the reels more visible and can continue the interest of the player for a long time. Since this visibility is made easier, it is also possible to provide the game, which can make the player hardly tired and can keep the interest of the player for a long time.

Especially in case the symbol is displayed in motion by rotating the reels, it is harder to view than in case the symbol is displayed still. The image of the display device is enabled to continue the interest of the player for a long time if it is made to make the reels more visible than the related art. If this visibility is made easier even in the motion display, moreover, it can hardly make the player tired so as to continue the interest of the player. If the gaming machine is provided which frequently determines the contents of the game with the reel stopping mode so that the passage from the motion display to the still display of the symbol can be easily viewed, it can keep the interest the player for a longer time.

Here, the aforementioned case of the power ON may include the case, in which the power source is turned ON at first, and the case in which the power source is turned ON again after turned OFF. In the included case, for example, the power source may be turned ON again on the basis of the operation of the power button, and the power source may be turned ON again on the basis of the operation of the reset button.

[Construction of Control Unit of Gaming Machine]

Figure 8:
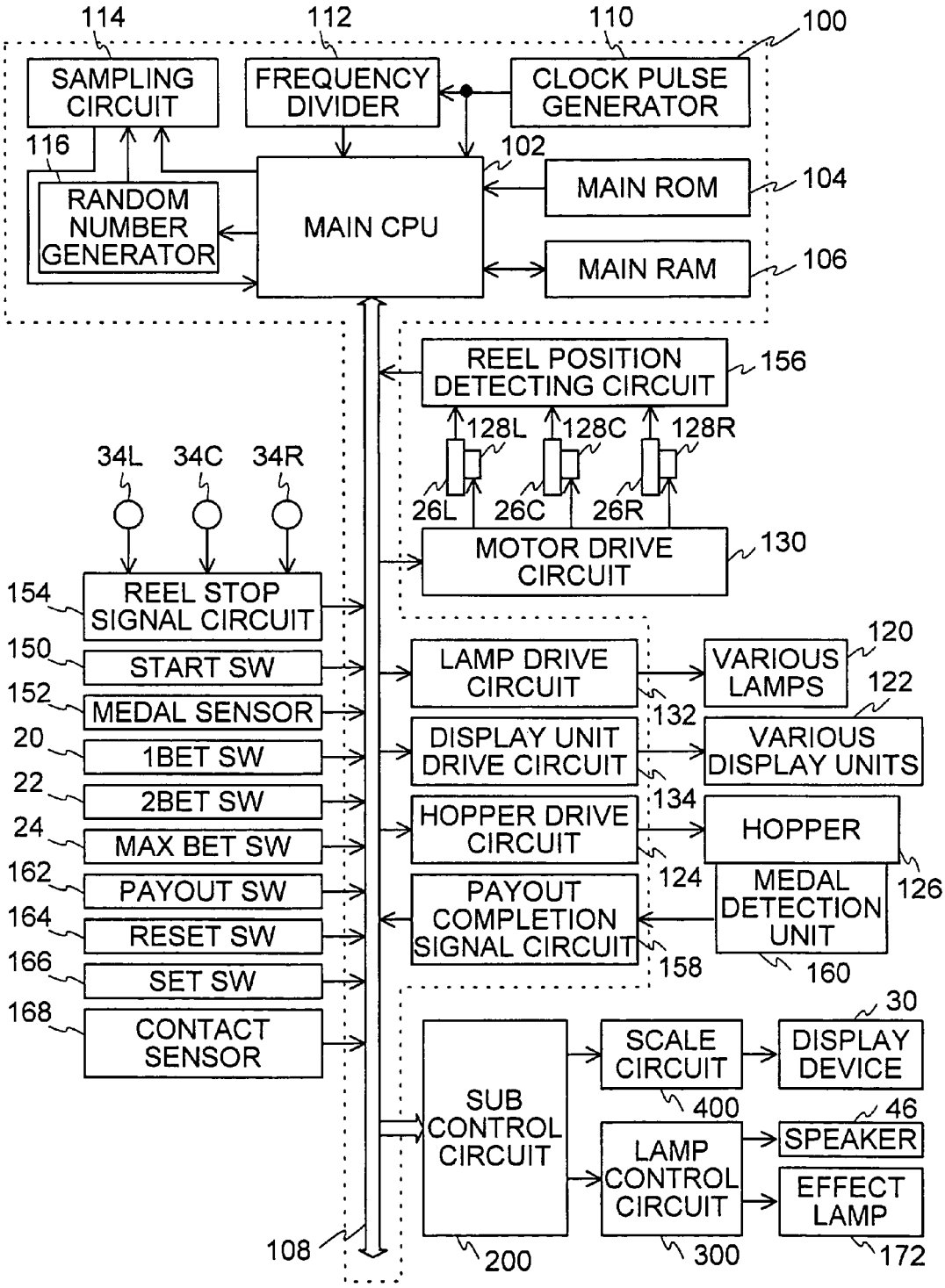
FIG. 8 is a block diagram showing a circuit construction of the slot machine according to the invention.

FIG. 8 shows a circuit construction including: the main control circuit 100 for controlling the gaming operations in the slot machine 10; peripheral devices connected electrically with the main control circuit 100; and the subsidiary control circuit 200, the lamp control circuit 300 and the scale circuit 400 for controlling the display device 30, the speakers 46 and the effect lamps 172 on the basis of the control instructions sent from the main control circuit 100.

The main control circuit 100 is provided with the main CPU 102, a main ROM 104, a main RAM 106, an input-output bus 108, a clock pulse generator 110, a frequency divider 112, a sampling circuit 114 and the random number generator 116, which are arranged over the circuit board.

The main CPU 102 can control the various peripheral devices in accordance with the programs stored in the main ROM 104 and in accordance with the data signal or address signal inputted/outputted from the input-output bus 108. Moreover, the main CPU 102 is provided therein with the timer (although not shown).

With the main CPU 102, there is connected the main ROM 104. This main ROM 104 is stored with the various programs such as the control program for controlling the flow of the entire game of the slot machine 10, or the initial data for executing the control programs.

For example, there are stored: a probability lottery table to be used for determining the random number sampling, which is done each time the start lever 32 is operated (for the start operation); a stop control table for determining the stop mode of the reels in response to the operations of the stop buttons; a winning symbol combination table corresponding to the symbol displayed still by the stop control table, for determining the number of game medals to be paid out; and various control instructions (or commands) to be transmitted to the subsidiary control circuit 200. Here, the details of these probability lottery table, stop control table and winning symbol combination table will be described hereinafter.

Moreover, the various control instructions are "demonstration display commands", "start commands", "all reel stop commands" and "winning combination commands". Here, the subsidiary control circuit 200 does not input the commands or the like to the main control circuit 100, but the communications are done only unidirectionally from the main control circuit 100 to the subsidiary control circuit 200. The main control circuit 100 and the subsidiary control circuit 200 are connected through sixteen data signal lines and one signal line. And, these commands are composed of 2 bytes, 4 bytes and six bytes, and one command is sent in 1, 2 or 3 sequences through the sixteen data signal lines.

With the main CPU 102, moreover, there is connected the main RAM 106, which is stored with the values of flags or variables to be used in the aforementioned programs.

With the main CPU 102, moreover, there are connected the clock pulse generator 110 for generating reference clock pulses, the frequency divider 112, the random number generator 116 for generating a random number to be sampled, and the sampling circuit 114.

Moreover, the random number generator 116 generates random numbers belonging to a predetermined numerical range, and the sampling circuit 114 samples one random number at a suitable timing after the start lever 32 was operated.

The internal winning combination is determined on the basis of the random number thus sampled and the probability lottery table stored in the main ROM 104. After the internal winning combination was determined, moreover, the random number sampling is done to select the "stop control table" and the "stop table" contained in the former.

Here, the random number generator 116 generates the random numbers contained within the numerical values of a predetermined range, such as 0 to 65535 (i.e., 16th powers of 2). Moreover, the invention should not be limited to the random numbers generated by the random number generator 116 but may be constructed to execute the random number sampling on the operation program of the main CPU 102. In this case, the random number generator 116 and the sampling circuit 114 can be omitted but can be left for the backup of the random number sampling operation.

As main input signal generating means for generating input signals necessary for the main CPU 102 to generate control signals, there are provided a start switch 150, the 1-BET switch 20, the 2-BET switch 22, the MAX-BET switch 24, the stocked medal settling button 36, a medal sensor 152, a reel stop signal circuit 154, a reel position detecting circuit 156, a payout completion signal circuit 158, a payout switch 162, the reset switch 164, the setting switch 166 and a contact sensor 168. These elements are also connected with the main CPU 102 through the input-output bus 108.

The reel stop signal circuit 154 detects the operations of the individual stop buttons 34L, 34C and 34R and feeds the main CPU 102 with the stop signal through the input-output bus 108 when it makes the detection.

The start switch 150 detects the operation of the start lever 32 and feeds the main CPU 102 with the start signal through the input-output bus 108 when it detects the operation of the start lever 32.

The medal sensor 152 detects the game medals inserted into the medal insertion opening 31 and feeds the main CPU 102 with the medal insertion signal through the input-output bus 108 when it detects the game medal inserted into the medal insertion opening 31.

The 1-BET switch 20 detects its own operation and feeds the main CPU 102 with the 1-BET signal through the input-output bus 108 when the 1-BET switch 20 detects its own operation.

The 2-BET switch 22 detects its own operation and feeds the main CPU 102 with the 2-BET signal through the input-output bus 108 when the 2-BET switch 22 detects its own operation.

The MAX-BET switch 24 detects its own operation and feeds the main CPU 102 with the MAX-BET signal through the input-output bus 108 when the MAX-BET switch 24 detects its own operation.

The payout switch 162 detects the operation of the stocked medal settling button 36 and feeds the main CPU 102 with the stocked medal settling signal when it detects the operation of the stocked medal settling button 36.

The reset switch 164 is disposed in the slot machine 10, and feeds the main CPU 102 with the reset signal through the input-output bus 108 when it detects the operation of the slot machine 10.

The set switch 166 detects the operation of the set button (although not shown) disposed in the slot machine 10 and feeds the main CPU 102 with the set signal through the input-output bug 108 when it detects the operation of the set button.

The reel position detecting circuit 156 feeds the main CPU 102 through the input-output bus 108 with the reel position signal for detecting the positions of the individual reels 26L, 26C and 26R in response to the pulse signals from the reel rotation sensor.

The payout completion signal circuit 158 detects the game medal payout completion, when the counted value (i.e., the number of game medals paid out from the hopper 126) of a medal detection unit 160 reaches designated number data, and feeds the main CPU 102 through the input-output bus 108 with a payout completion signal indicating that detection.

The major devices, as controlled in operations with the control signals from the main control circuit 100, are: various lamps 120; various display units 122; the hopper (including the drive unit for the payout) 126 for stocking the game medals and for paying out a predetermined number of game medals in response to the instruction of a hopper drive circuit 124; and stepping motors 128L, 128C and 128R for driving the reels 26L, 26C and 26R rotationally. Here, the various lamps 120 include the symbol illuminating lamps 57.

With the output unit of the main CPU 102 through the input-output bus 108, moreover, there are connected: a motor drive circuit 130 for controlling the drives of the stepping motors 128L, 128C and 128R; the hopper drive circuit 124 for controlling the drive of the hopper 126; a lamp drive circuit 132 for controlling the drives of the various lamps; and a display unit drive circuit 134 for controlling the drives of the various display units. In response to the individual control signals such as the drive signal outputted from the main CPU 102, those drive circuits control the operations of the individual devices.

Moreover, the subsidiary control circuit 200 is included in the device, which is controlled in operation with the control signal from the main control circuit 100.

With this subsidiary control circuit 200, moreover, there are connected the lamp control circuit 300, the scale circuit 400, the display device 30, the speakers 46 (46L and 46R) and the effect lamps 172.

The display device 30 accepts the image signals fed from the subsidiary control circuit 200 and the scale circuit 400, and displays the images.

The speakers 46 accept the sound signals fed from the subsidiary control circuit 200 and the lamp control circuit 300, and make sounds.

The effect lamps 172 accept the effect signals fed from the subsidiary control circuit 200 and the lamp control circuit 300, and perform the effects. Here, these effect lamps 172 include the reel back lamps 63.

[Electric Construction of Subsidiary Control Circuit]

Figure 9:
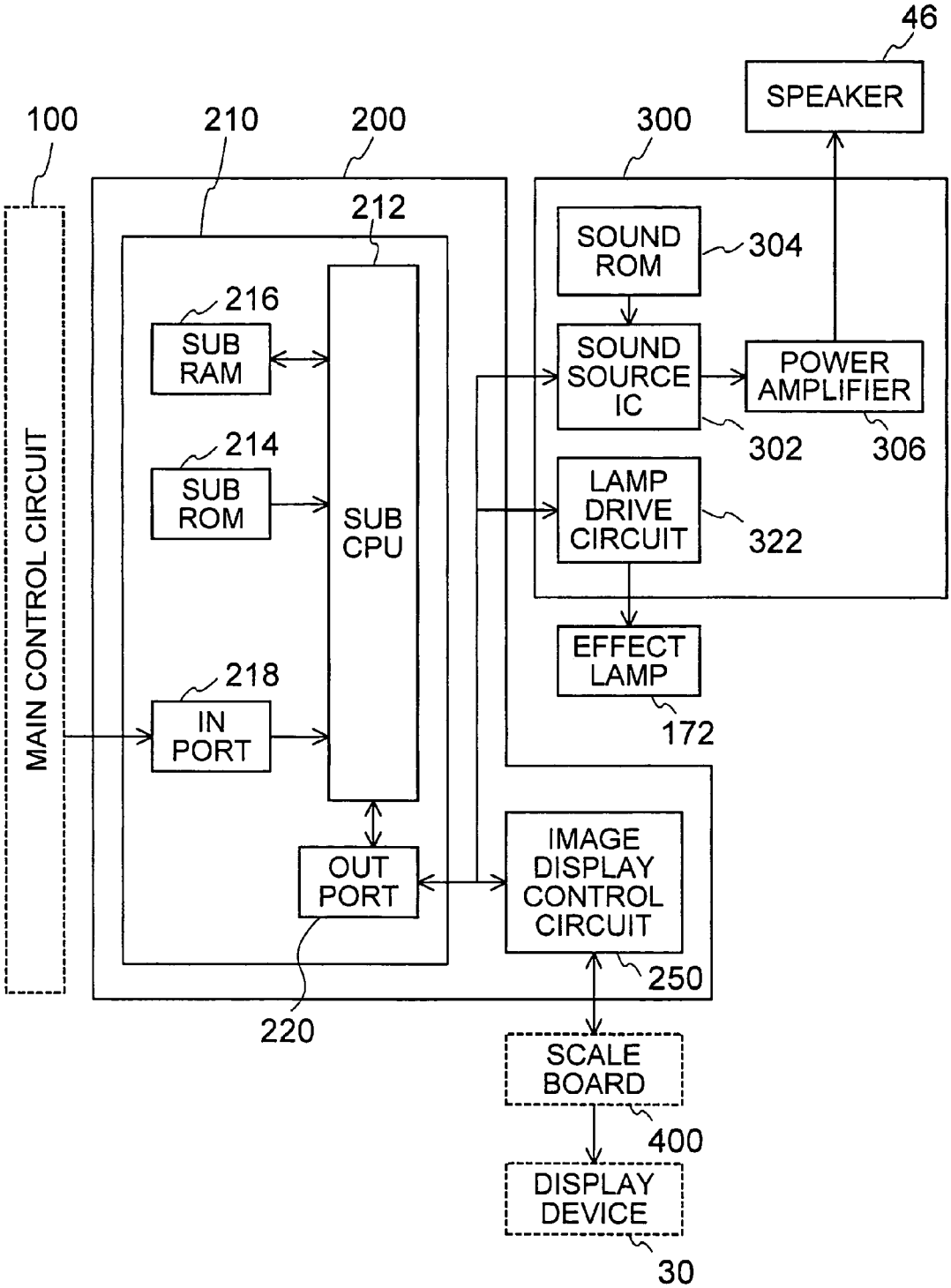
FIG. 9 is a block diagram showing the circuit construction of the slot machine according to the invention.
Figure 10:
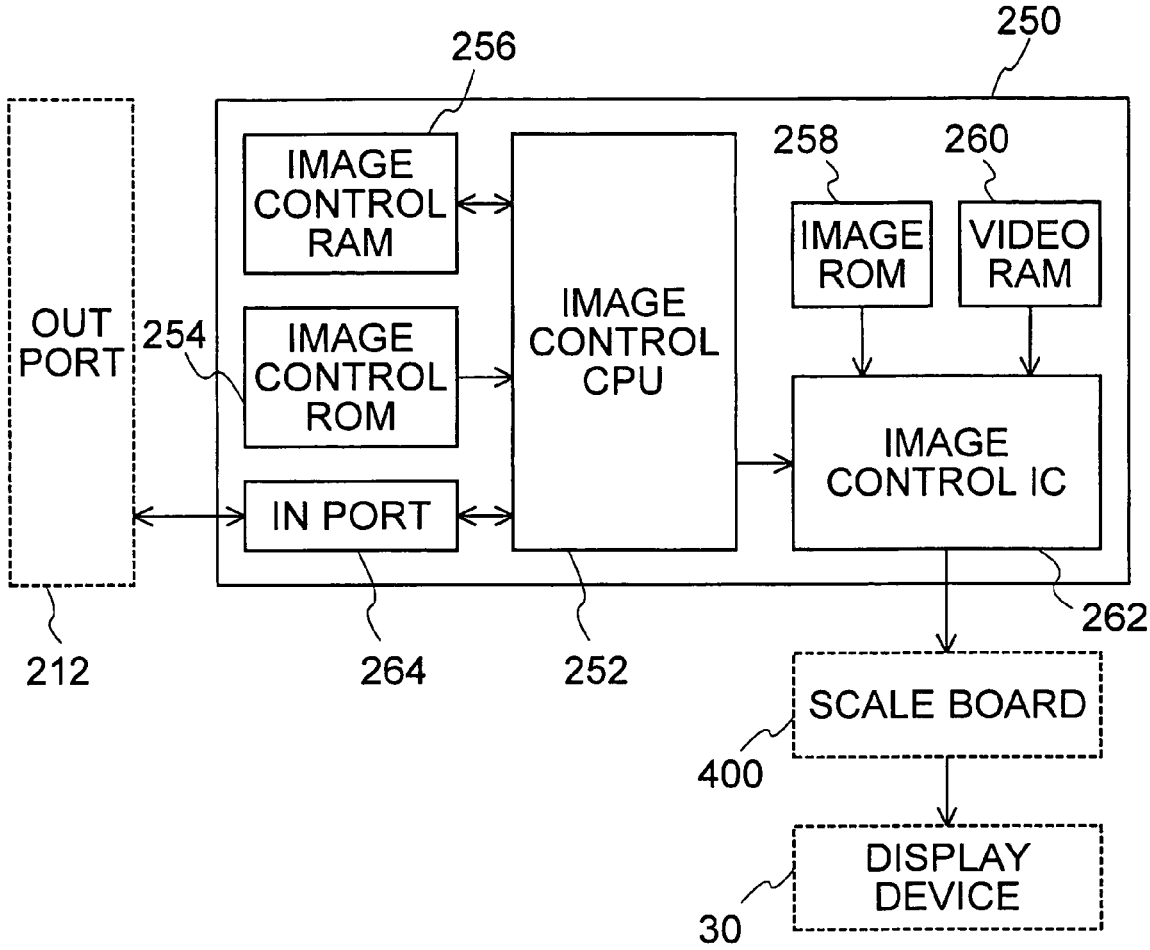
FIG. 10 is a block diagram showing the circuit construction of the slot machine according to the invention.

This subsidiary control circuit 200 will be described with reference to FIG. 9 and FIG. 10. The block diagrams of FIG. 9 and FIG. 10 show the construction of the subsidiary control circuit 200.

On the basis of the control instructions (or commands) from the main control circuit 100 or automatically, the subsidiary control circuit 200 performs the display control of the display device 30, the output control of the sounds from the speakers 46, and the effect control of the effect lamps 172.

This subsidiary control circuit 200 is so constructed over a circuit board other than that constructing the main control circuit 100 as to include the sub-microcomputer 210 as its major component and to include an image control circuit 250 for controlling the display of the display device 30.

The sub-microcomputer 210 includes: a sub-CPU 212 for performing the control operations in accordance with the control instruction sent from the main control circuit 100; a sub-ROM 214 stored with the control program of the sub-microcomputer 210; a sub-RAM 216; an IN port 218 and an OUT port 220.

On the other hand, the subsidiary control circuit 200 is not provided with the clock pulse generator, the frequency divider, the random number generator and the sampling circuit, but is constructed to execute the random number sampling over the operation program of the sub-CPU 212.

On the basis of the game information command sent from the main control circuit 100, the sub-CPU 212 determines what effect is done by the various effect control circuits, and sends the determined contents to the individual effect control circuits.

The sub-ROM 214 is stored with the communication sequence program with the main control circuit 100, the effect selecting table for selecting the various effects on the basis of the game information accepted, the sound sequence program and so on.

The sub-RAM 216 is used as a working area for executing those control programs.

The IN port 218 has functions to accept the game information of images or sounds fed from the main control circuit 100 and to feed the game information to the sub-CPU 212.

Here, this IN port 218 only feeds the game information from the main control circuit 100 to the sub-CPU 212 but not any signal from the sub-CPU 212 to the main control circuit 100. Even if a malfunction occurs in the subsidiary control circuit 200, therefore, it does not transfer to the main control circuit 100.

The OUT port 220 has a function to feed the image display signal to the image control circuit 250, a function to feed a sound generation signal to a sound source IC 302 in the lamp control circuit 300 and a function to feed an effect lamp signal to the lamp control circuit 300 so as to turn ON and OFF the effect lamps 172.

As shown in FIG. 10, the image control circuit 250 is constructed of an image control CPU 252, an image control ROM 254, an image control RAM 256, an image ROM 258, a video RAM 260, an image control IC 262 and an IN port 264.

The image control CPU 252 receives the parameters determined in the sub-microcomputer 210 through the IN port 264, and determines the display contents in the display device 30 in accordance with the image control sequence program stored in the image control ROM 254.

The image control ROM 254 is stored with the reception sequence program of the image effect command sent from the sub-microcomputer 210, and the image control sequence program for controlling the image control IC 262.

The image control RAM 256 is used as a working area at the time of executing the image control program.

The image control IC 262 forms the image according to the display contents determined by the image control CPU 252, by using the graphic data stored in the image ROM 258, stores the image temporarily in the video RAM 260, and feeds the image at a suitable timing to the scale circuit 400 through the image control IC 262.

[Electric Construction of Lamp Control Circuit]

Moreover, the lamp control circuit 300 will be described with reference to FIG. 9.

The lamp control circuit 300 is constructed of: the sound source. IC 302 for controlling the sounds emitted from the speakers 46; a sound ROM 304 stored with the sound data; a power amplifier 306 acting as an amplifier; and a lamp drive circuit 322 for driving the effect lamps 172.

Figure 19:
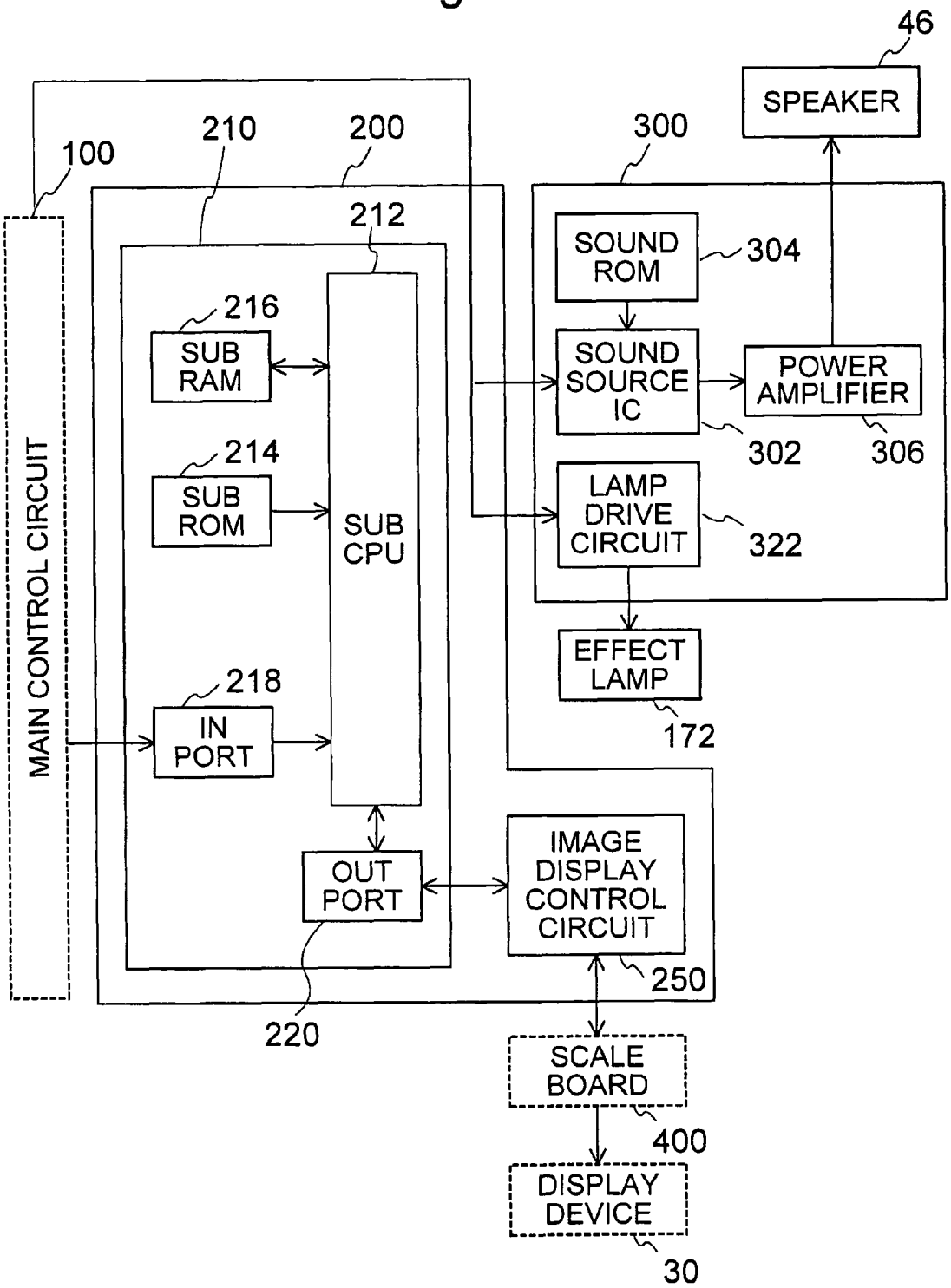
FIG. 19 is a block diagram showing a circuit construction of the slot machine according to the invention.

With the above configuration, the lamp control circuit 300 is controlled by the sub-control circuit 200. As shown in FIG. 19, the lamp control circuit 300 may be configured to be controlled by the main control circuit 100. With such configuration, since the main control circuit 100 controls the lamp drive circuit 322 even if the sub-control circuit 200 becomes unperative due to power outage or hung-up the reel back lamp 63L, 63C, 63R can be turned ON because the main control circuit 100 controls the drive circuit 322. Therefore, the amount of light for illuminating discrimination information images drawn on respective outer peripheries of the reels 26L, 26C, 26R can be adjusted arbitrarily in accordance with the game situations such that the game may proceed steadily.

[Electric Construction of Scale Circuit]

Moreover, the scale circuit 400 will be described with reference to FIG. 11.

The scale circuit 400 is constructed of a signal conversion CPU 272, a signal conversion ROM 274, a video RAM 276, an IN port 278 and an OUT port 280.

In accordance with the signal conversion sequence program stored in the signal conversion ROM 274, the signal conversion CPU 272 receives the image signals generated in the image control circuit 250, through the IN port 278, converts the image signals into a display type, in which they can be properly displayed in the display device 30, and store them in the video RAM 276.

Moreover, the signal conversion CPU 272 feeds the image data stored in the video RAM 276, as the enlarged image signals suitable for the display device 30 to the display device 30 through the OUT port 280.

Specifically, the signal conversion CPU 272 converts the image signals such as the VGA into the enlarged image signals such as the XGA of the type, which can correspond to the large display size.

In this embodiment, the image data of the display size VGA are enlarged for every bit and converted into the display size XGA. However, this invention should not be limited thereto, but the image data of the VGA size may be received and synthesized into the image data of the display size XGA.

Here in this embodiment, the conversion is made as the enlarged image signals of the XGA type, 1,024 bits wide and 768 bits high, red data, green data and blue data of 8 bits. In this invention, however, the enlarged image signals may display an image of a larger size, and the conversion type, the width and height bit sizes, and the gradation bits of the individual colors should not be limited to the aforementioned values.

Moreover, the signal conversion CPU 272 is designed to receive the image signals fed from the subsidiary control circuit 200, at a predetermined period. In case the normal image signals are not received at the predetermined period, the image data are so stored in the video RAM 276 as to display the predetermined image.

In short, the signal conversion CPU 272 monitors whether or not the image signals fed from the subsidiary control circuit 200 is normal. In case the monitoring result determines the image signals not normal, i.e., abnormal, a predetermined image is displayed, and this image state displayed in the display device 30 is kept. In case the synchronous signal inputted is monitored to reveal that the synchronous signal is absent or out of definition, the display device 30 is subjected to the transparent control (i.e., the "white output").

On the other hand, this signal conversion CPU 272 is constructed to display the predetermined image, as described hereinbefore. The image data are stored in the video RAM 276 so that the predetermined image may be such an image of relatively high transparency as to allow the player to view the reels 26L, 26C and 26R.

The signal conversion ROM 274 is stored with: the communication sequence program with the image control circuit 250; the sequence program for converting the received image signals into the enlarged image signals; and the communication sequence program for feeding the enlarged image signals converted, to the display device 30 through the OUT port 280.

The IN port 278 has a function to accept the image signals fed from the image control circuit 250 and to feed the image signals to the signal conversion CPU 272. On the other hand, the OUT port 280 performs the image display effects by feeding the enlarged image signals converted in the image signal conversion circuit 270, to the display device 30.

Here, in this embodiment, the LVDS (Low Voltage Differential Signaling) is adopted for the image signals to be fed to the image signal conversion circuit 270. This invention should not be limited thereto but may use various types. Preferably, by using the differential type such as the LVDS, for example, the image signals are hardly subject to the influences of noises so that the images are displayed without deterioration.

In this embodiment, moreover, the image signals to be fed to the image signal conversion circuit 270 are of the VGA (Video Graphics Array) size so that they are converted into the enlarged image signals of the XGA (eXtended Graphics Array) size by the operations of the image signal conversion circuit 270. Here in this embodiment, the image signals of the VGA size are fed to the image signal conversion circuit 270. However, the invention should not be limited thereto but may feed image signals of various sizes.

[Board Construction of Display Device]

The electric construction in the display device 30 will be described with reference to FIG. 11.

Figure 11:
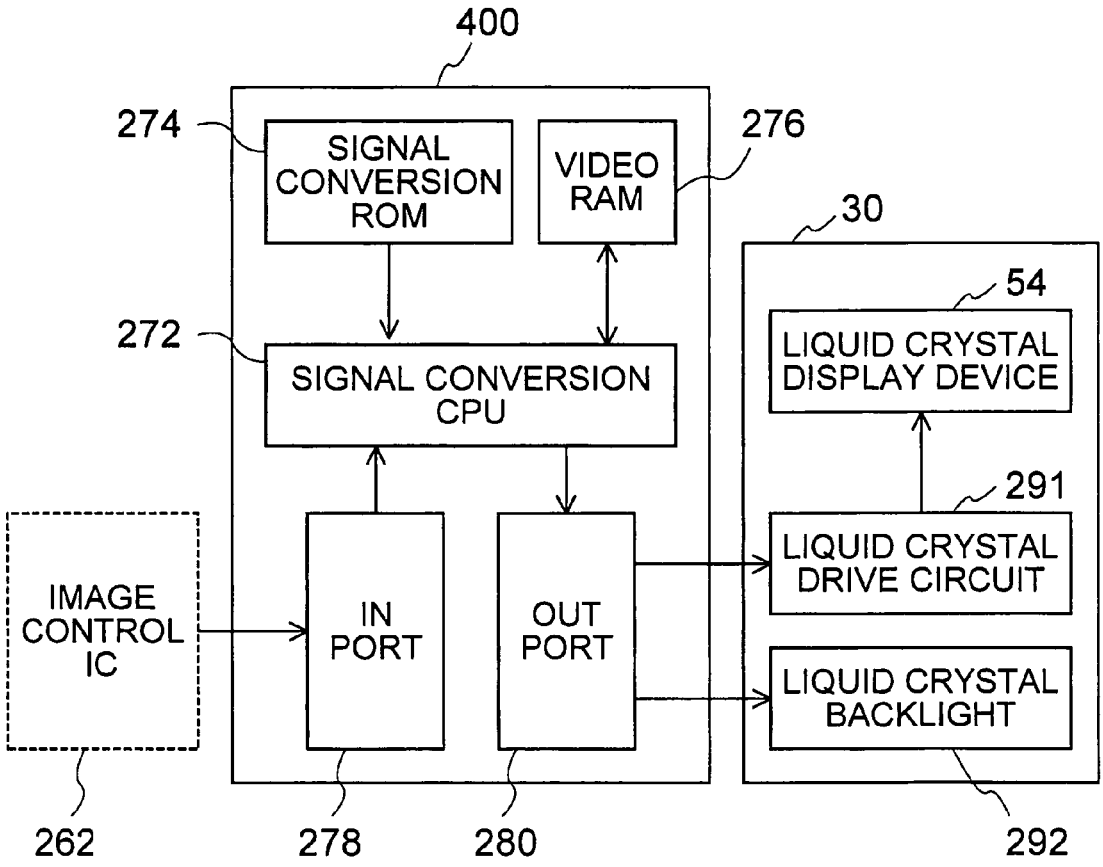
FIG. 11 is a block diagram showing the circuit construction of the slot machine according to the invention.

As shown in FIG. 11, the display device 30 is constructed to include the liquid crystal display device 54, a liquid crystal drive circuit 291 and the liquid crystal backlights 292.

The liquid crystal display device 54 displays the various images on the basis of the image signals fed from the aforementioned scale circuit 400.

The liquid crystal drive circuit 291 accepts the image signals fed from the aforementioned scale circuit 400, and displays the images on the liquid crystal display device 54 on the basis of those image signals.

The liquid crystal backlights 292 display the liquid crystal clearly by illuminating the liquid crystal display device 54 from the back.

[Power Source Feeding Construction Using Power Source Relay Board]

The electric construction of the power source to be fed from the power source device 79 is described with reference to FIG. 12.

Figure 12:
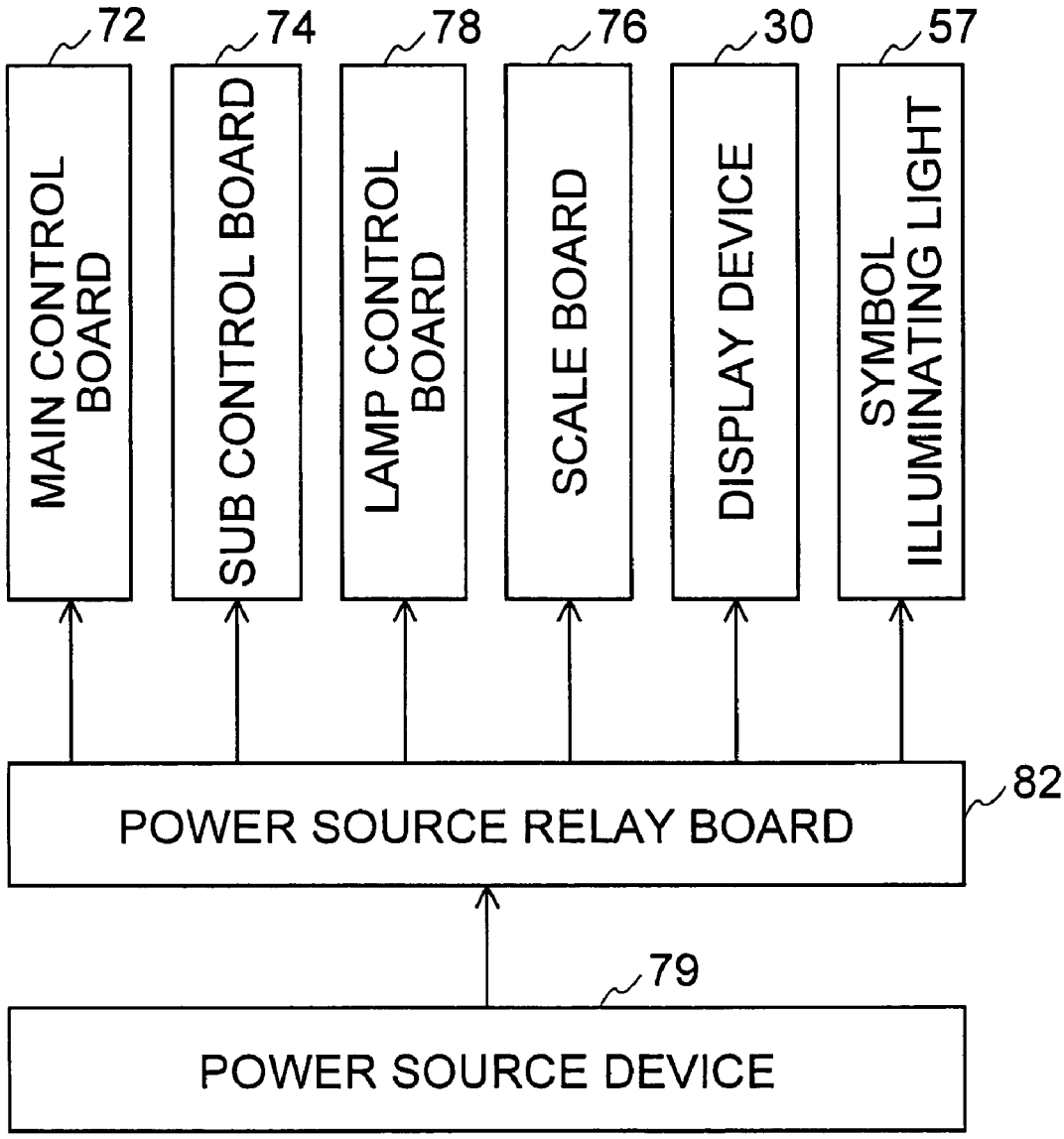
FIG. 12 is a block diagram showing the circuit construction of the slot machine according to the invention.

As shown in FIG. 12, the power of the power source device 79 is fed to the power source relay board 82 and then to the connection cable (although not shown) for the power source feed, the main control board 72, the subsidiary control board 74, the lamp control board 78, the scale board 76, the display device 30 and the symbol illuminating lamps 57.

As described hereinbefore, there are provided: the display device having the display control means; the image state keeping unit having the image state keeping means for receiving the image signals and for controlling the image-displaying display device in a predetermined state in case the image signals fed from the display control means are abnormal; and the power source feeding means for feeding the image state keeping unit and the display device independently with the power source. Even in case the power source is not fed to the display device, therefore, the power source is independently fed from the power source feeding means to the image state keeping unit so that the state of the image can be kept without displaying any disturbed image.

Moreover, there are provided the display device having the display control means, and the power source feeding means for feeding the power source independently of the display device. Even in case the power source is not fed to the display device, the power source is fed independently of the power source feeding means for the display device.

Moreover, the image signal control unit is constructed to include the image signal control means, the transparent image display means and the image enlarging conversion means for converging the received image signals into the enlarged image signals. Therefore, the uncomfortable image, as might otherwise be formed by various troubles, can be kept in the predetermined state without being displayed in the display device. By eliminating one factor, which may give an uncomfortable feel during playing the game, therefore, the interest of the player can be continued for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image signal monitoring unit with the image state keeping means and the image enlarging conversion means, moreover, it is possible not only to invite no size enlargement but also to spare the space and to receive less influence of the noises.

Still moreover, "the image state keeping unit is provided with not only the image state keeping means but also the image enlarging conversion means for converting the image signals received into the enlarged image signals". Even in case the power source is not fed to the display control unit, therefore, the power source is fed independently of the power source feeding means so that the state of the image can be kept without displaying any disturbed image. By eliminating one cause for an uncomfortable feeling during the play, therefore, it is possible to provide a game capable of continuing the interest of the player for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image state keeping unit with the image state keeping means and the image enlarging conversion means, moreover, it is possible not only to invite no size enlargement but also to spare the space and to receive less influence of the noises.

Still moreover, there may be provided power source relay means for relaying the power source fed from the power source feeding means to branch the power source fed from the power source feeding means, to the image state keeping unit and the display device. Therefore, the number of cables to be wired from the power source feeding means can be reduced, and many cables need not be bundled in the manufacturing process. At the reusing and recycling steps, moreover, the many cables need not be unbundled so that their manufacturing process can be simple and convenient.

For example, the gaming machine of the related art is constructed of: a main body having a recess; a door for covering the recess; and a device (including a board) disposed in those insides. The aforementioned power source feeding means is generally disposed in the recess of the main body. On the other hand, the device to be fed with various power sources is disposed in the recess of the main body or in the door. Therefore, not the device disposed in the main body but the device disposed in the door is disposed at a place relatively far from the power source feeding means. In order to feed the power source to those devices, it needs troublesome works to wire the many power source cables. In addition, the cables for feeding the power source are clamped by the door, when this door is opened/closed, to cause disconnections.

By providing the power source relay means, therefore, the power source cables to the power source relay means can be reduced to make the works easier in the manufacturing process.

Especially by providing the door with the power source relay unit having that power source relay means, the wiring works can be made efficient. In the multi-function gaming machine of recent years, moreover, many devices are disposed on the door. Therefore, the number of power source cables for feeding the power source to those devices can be reduced and efficiently wired.

Still moreover, there may be provided power source relay means for relaying the power source fed from the power source feeding means to branch the power source fed from the power source feeding means, to the image state keeping unit and the display device. Therefore, the number of cables to be wired from the power source feeding means can be reduced, and many cables need not be bundled in the manufacturing process. At the reusing and recycling steps, moreover, the many cables need not be unbundled to provide a simple and convenient manufacturing process.

For example, the gaming machine of the related art is constructed of: a main body having a recess; a door for covering the recess; and a device (including a board) disposed in those insides. The aforementioned power source feeding means is generally disposed in the recess of the main body. On the other hand, the device to be fed with various power sources is disposed in the recess of the main body or in the door. Therefore, not the device disposed in the main body but the device disposed in the door is disposed at a place relatively far from the power source feeding means. In order to feed the power source to those devices, it needs troublesome works to wire the many power source cables. In addition, the cables for feeding the power source are clamped by the door, when this door is opened/closed, to cause disconnections.

By providing the power source relay means, therefore, the number of power source cables to the power source relay means can be reduced to make the works easier in the manufacturing process.

Especially by providing the door with the power source relay unit having that power source relay means, the wiring works can be made efficient. In the multi-function gaming machine of recent years, moreover, many devices are disposed on the door. Therefore, the number of power source cables for feeding the power source to those devices can be reduced and efficiently wired.

[Operations of Gaming Machine]

Figure 14:
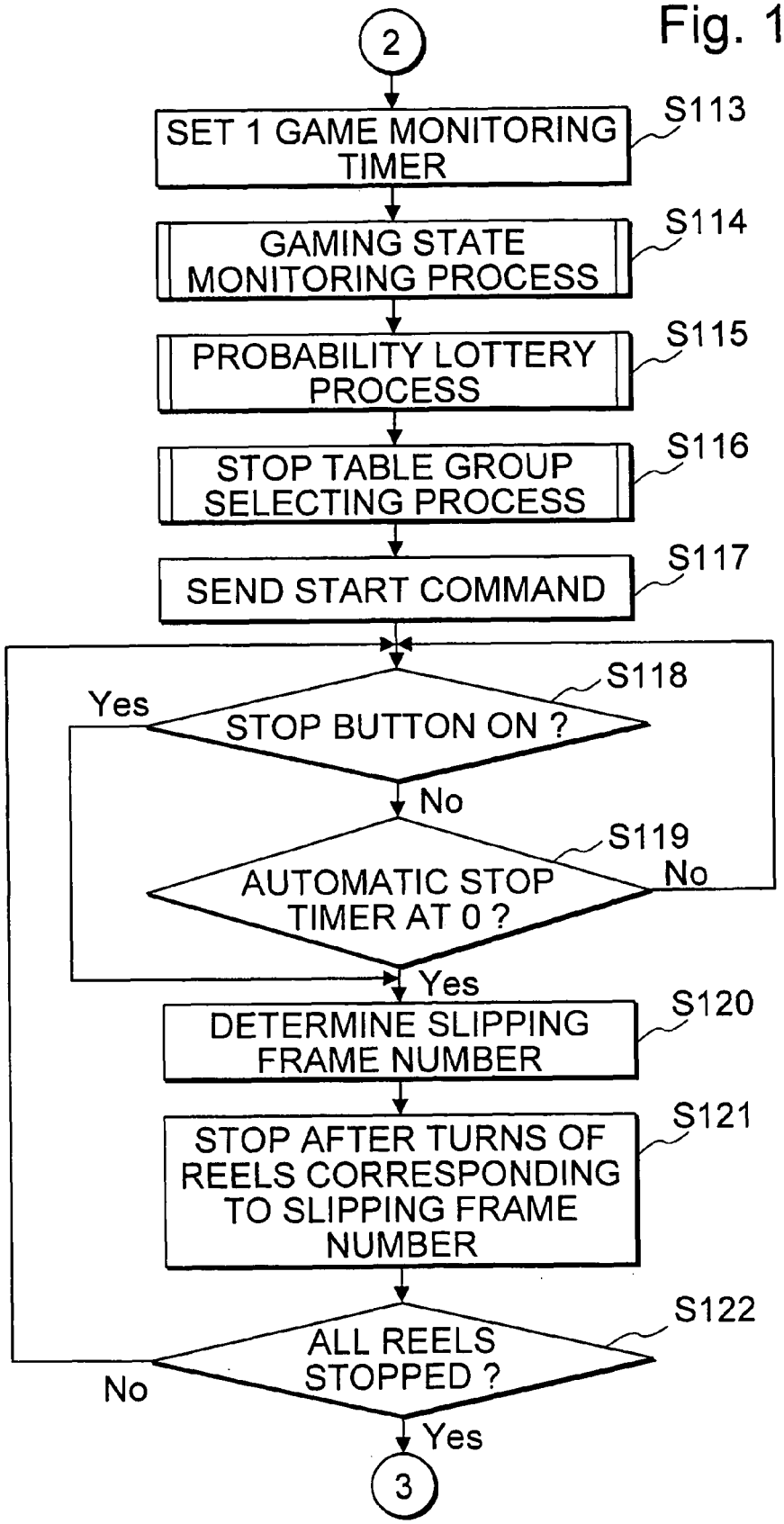
FIG. 14 is a flow chart showing a control process to be executed in the slot machine according to the invention.
Figure 15:
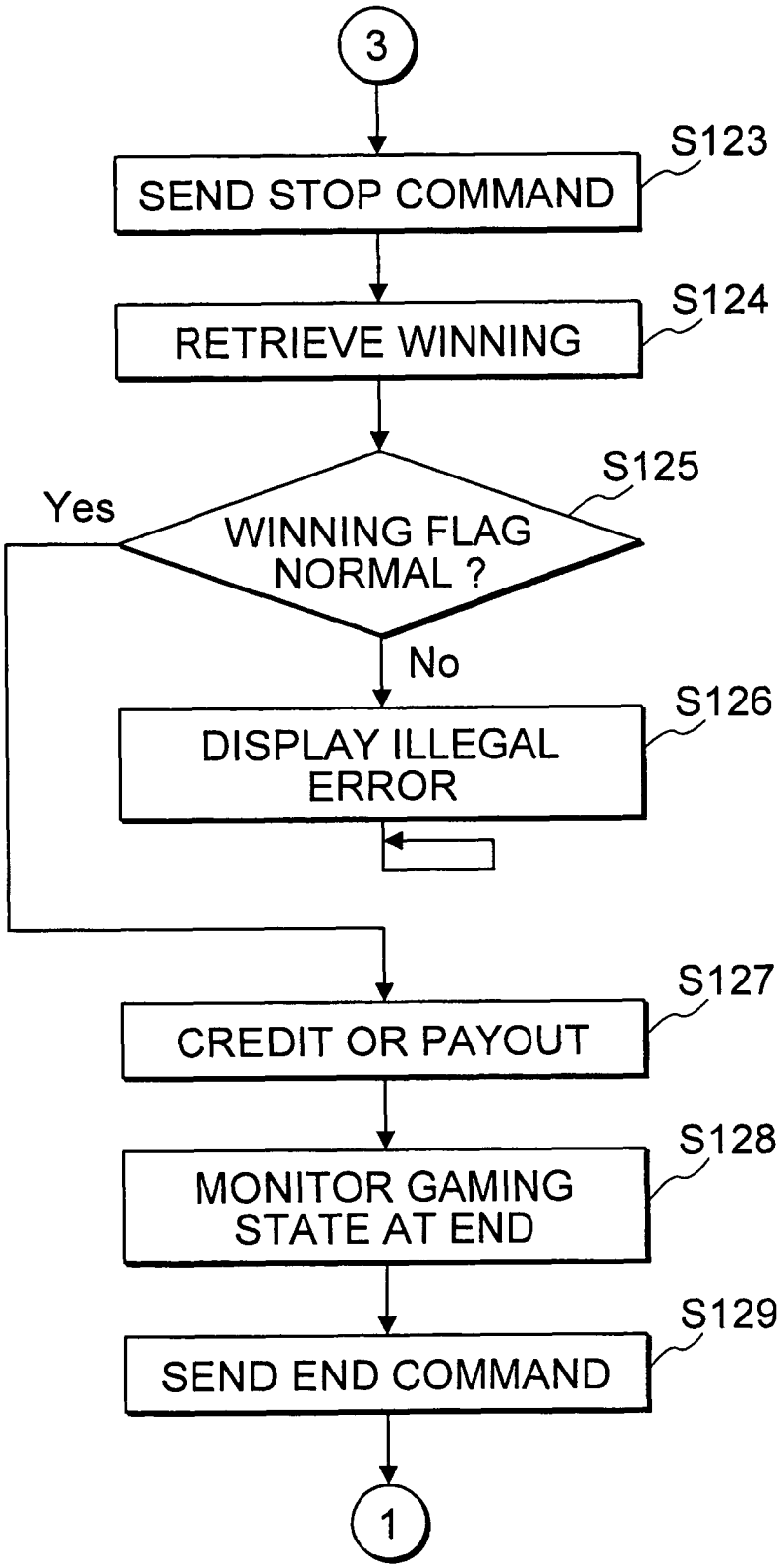
FIG. 15 is a flow chart showing a control process to be executed in the slot machine according to the invention.
Figure 16:
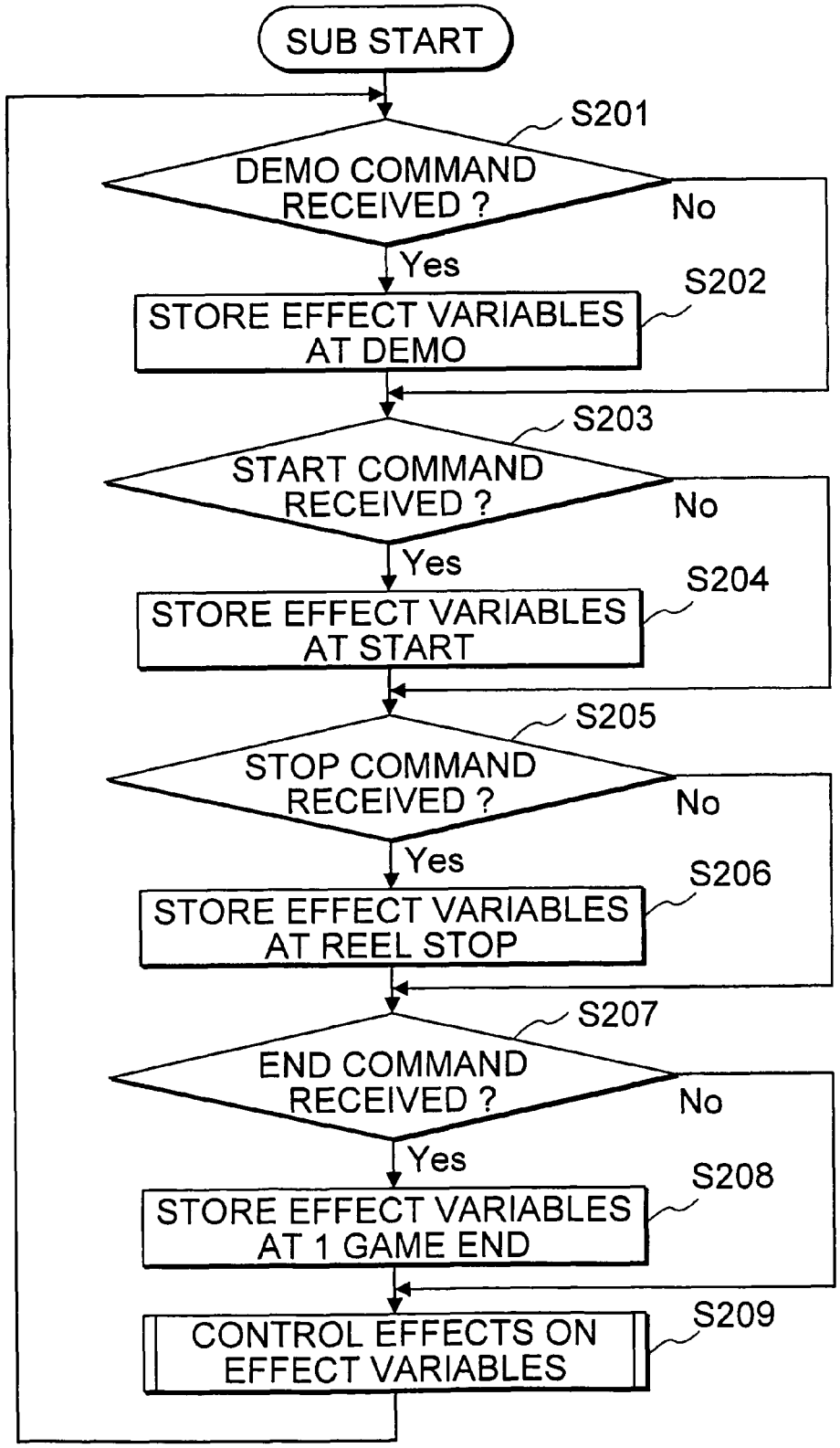
FIG. 16 is a flow chart showing a control process to be executed in the slot machine according to the invention.
Figure 17:
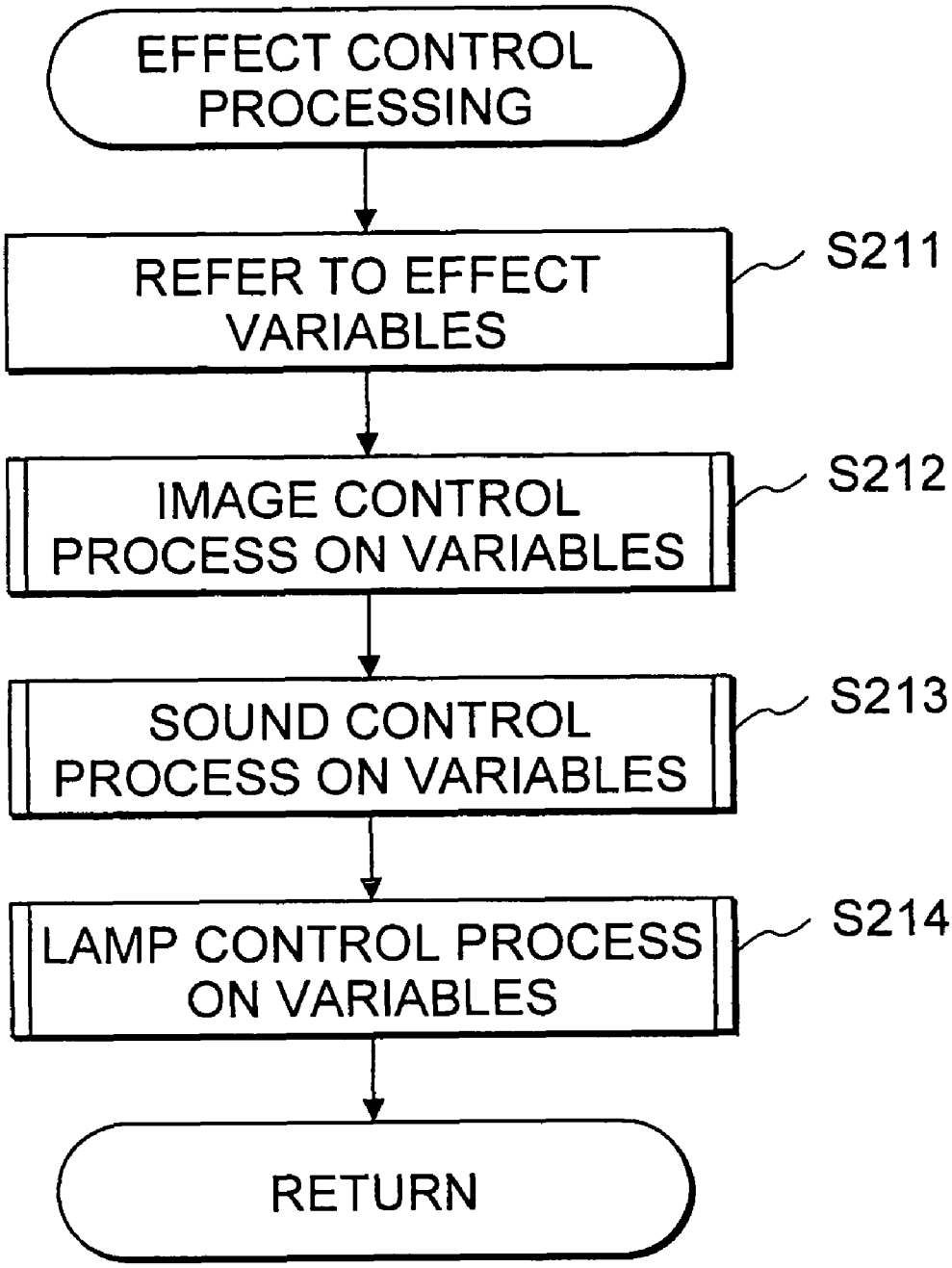
FIG. 17 is a flow chart showing a control process to be executed in the slot machine according to the invention.
Figure 18:
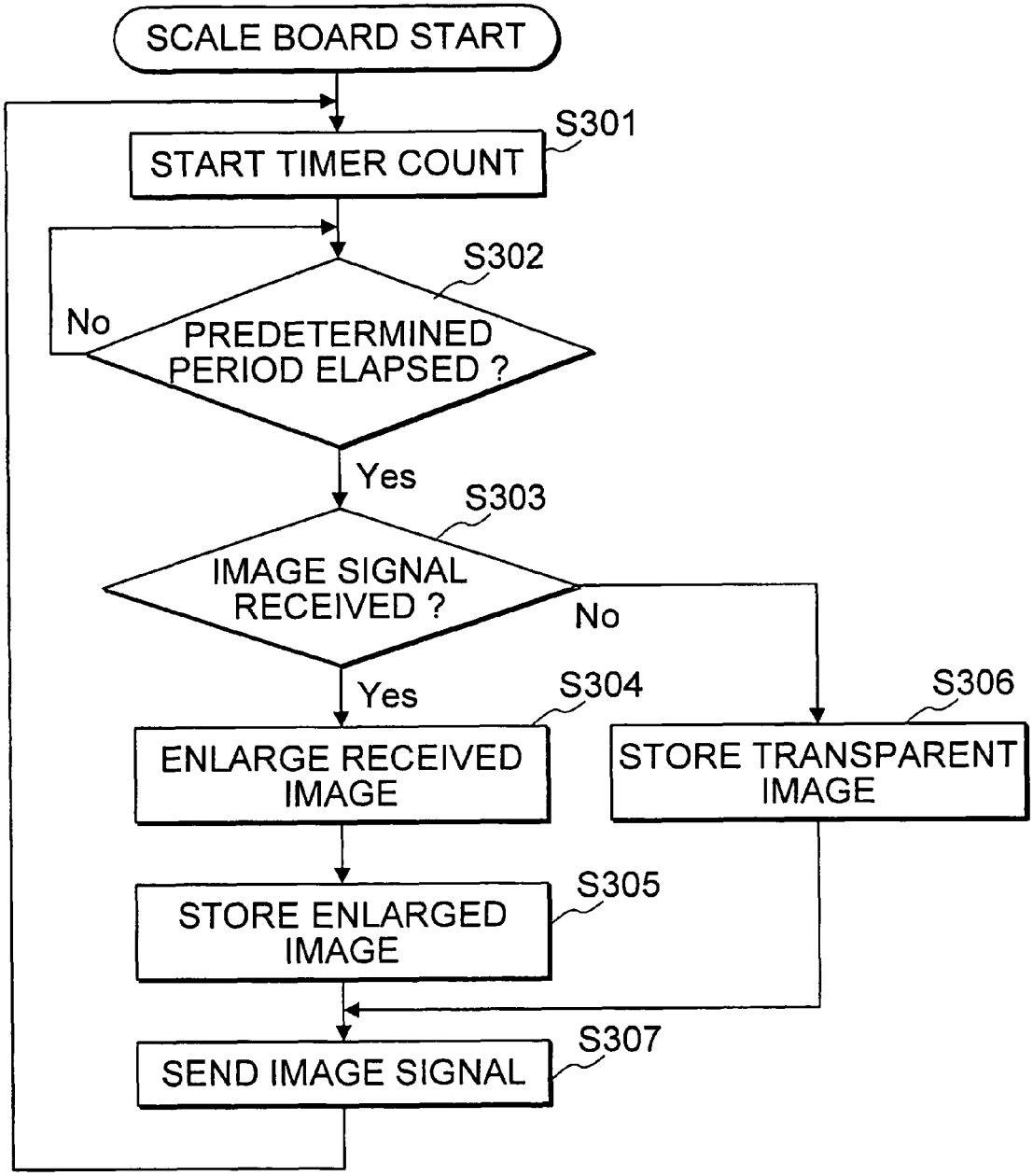
FIG. 18 is a flow chart showing a control process to be executed in the slot machine according to the invention.

Subroutines to be executed in various circuits such as the aforementioned main control circuit 100 and the subsidiary control circuit 200 so as to control the slot machine 10 are shown in FIG. 13 to FIG. 18. Here, the subroutines, as shown in FIG. 13, FIG. 16 and FIG. 18, are called and executed at a predetermined timing from the main program having been executed in advance.

In the following, it is assumed that the slot machine 10 is started in advance, that the variables to be used in the aforementioned main CPU 102, sub-CPU 212, image control CPU 252 and signal conversion CPU 272 are initialized to predetermined values, and that the slot machine 10 is steadily operating.

[Operations of Main Control Circuit]

First of all, an initialization is executed (at Step S101) in the slot machine 10, as shown in FIG. 13. Specifically, the main CPU 102 initializes the stored contents of the main RAM 106, the communication data and so on. The initialization of the stored contents of the main RAM 106 is done by turning ON the slot machine 10 so as to clear an indefinite value stored in the main RAM 106.

Here, the main CPU 102 can also be left not to initialize the whole area or a portion of the main RAM 106. As a result, the interest of the game can be raised by changing the situations of the games at the slot machine 10 randomly when the power source is turned ON.

Moreover, effective signals are so sent to the reel back lamps 63 as to turn ON the back lamps 63 at a normal time. In case this processing is ended, the routine advances to Step S102.

Next, the erasure of the stored contents at the game end is executed (at Step S102). In this processing, the main CPU 102 erases the data in the writable region, as used in the previous game, of the main RAM 106, stores the parameters necessary for the next game in the writable region of the main RAM 106, and stores the starting address of the sequence program to be used in the next game. In case this processing is ended, the routine advances to Step S103.

Next, it is determined (at Step S103) whether or not 30 seconds have elapsed after the end of the previous game. In this processing, the main CPU 102 determines whether or not the counted value, as started from the end of the previous game, of a timer packaged in the main CPU 102 is a predetermined time period, e.g., 30 seconds or longer in this embodiment. The main CPU 102 shifts the processing to Step S104, in case it discriminates that the counted value of the timer is 30 seconds or longer, but shifts the processing to Step S105, in case it does not discriminate that the counted value of the timer is 30 seconds or longer.

Next, a demo command is sent (at Step S104). In this processing, the main CPU 102 feeds the subsidiary control circuit 200 through the input-output bus 108 with a display instruction to display the demo screen. In response to this instruction, the sub-CPU 212 in the subsidiary control circuit 200 displays the demo screen in the display device 30 through the image control circuit 250, as will be described hereinafter. This processing is shifted, after ended, to Step S105.

Next, it is determined (at Step S105) whether or not an automatic insertion is demanded. In this processing, the main CPU 102 determines whether or not the general gaming state was in the previous game and whether or not a replay combination was won. The main CPU 102 reads out the data indicating the winning state in the previous game, as positioned in the main RAM 106. In case it is discriminated that the read data are those indicating that the replay combination was won, the processing is shifted to Step S106. In case it is not discriminated that the read data are those indicating that the replay combination was won, the processing is shifted to Step S107.

Next, an automatic insertion of the game medals demanded is executed (at Step S106). In this processing, the main CPU 102 reads out the data indicating the previous insertion number from the main RAM 106, and stores the BET number in the main RAM 106 and turns ON BET lamps 18 on the basis of those data. In case this processing is ended, it is shifted to Step S108.

Next, it is determined (at Step S107) whether or not the game medals have been inserted. In this processing, the medal sensor 152 feeds the main CPU 102 with the medal insertion signal, and the main CPU 102 thus having accepted the medal insertion signal stores it as the BET number in the main RAM 106. In case the BET number is the maximum, moreover, the main CPU 102 stores the signal not as the BET number but as the credit number.

And, the main CPU 102 reads out the BET number from the RAM 106, and shifts the processing to Step S108, in case it discriminates that the BET number is counted or stored as the data other than 0, but to Step S103 in case it does not discriminate that the BET number is stored as the data other than 0.

Next, it is determined (at Step S108) whether or not the start switch has been turned ON. In this processing, the start switch 150 feeds the main CPU 102 with the start signal, in case the operation of the start lever 32 has been detected, and the main CPU 102 having accepted the start signal determines whether or not the start switch has been turned ON. The main CPU 102 accepts the start signal and shifts the processing to Step S109, in case it discriminates that the start switch has been turned ON, but shifts the processing again to the Step S108, in case it neither accepts the start signal nor discriminates that the start switch has been turned ON.

Next, it is determined (at Step S109) whether or not 4.1 seconds have elapsed from the previous game start. In this processing, the main CPU 102 determines whether or not the counted value, as started from the start of the previous game, of the timer packaged in the main CPU 102 is a predetermined time period, e.g., 4.1 seconds or longer in this embodiment. The main CPU 102 shifts the processing to Step S111, in case it discriminates that the counted value of the timer is 4.1 seconds or longer, but shifts the processing to Step S110, in case it does not discriminate that the counted value of the timer is 4.1 seconds or longer.

Next, the consumption of the game start awaiting time is executed (at Step S110). In this processing, the main CPU 102 consumes the game awaiting time without shifting to the next processing till the counted time by the processing of Step S109 reaches 4.1 seconds. In case it discriminates at Step S109 that the counted time reaches 4.1 seconds, the main CPU 102 shifts the processing to Step S111.

Next, the reels are turned (at Step S111). In this processing, the main CPU 102 feeds the drive signal to the motor drive circuit 130 for controlling the drives of the stepping motors 128L, 128C and 128R the stepping motors 128L, 128C and 128R are driven so that the reels 26L, 26C and 26R are rotationally driven. After this processing was ended, the processing is shifted to Step S112.

Next, the random numbers for lottery are extracted (at Step S112). In this processing, the main CPU 102 feeds the sampling signal to the sampling circuit 114, and the sampling circuit 114 having accepted the sampling signal feeds the random number generator 116 with the data for producing the random numbers. And, the random number generator 116 feeds the random numbers to the main CPU 102. Moreover, the main CPU 102 stores the random numbers fed from the random number generator 116 in the main RAM 106.

On the basis of these random numbers, the stop control positions of the reels 26L, 26C and 26R, which have been rotationally driven by the processing of Step S111, are determined. In this processing, the main CPU 102 extracts the random numbers for the lottery. Specifically, the random numbers are extracted from the range of 0 to 16383. In case this processing is ended, it is shifted to Step S112.

Next, the random numbers for the lottery are extracted (at Step S112). In this processing, the main CPU 102 feeds the random number generator 116 with the signal to generate the random numbers. In response to the signal fed from the main CPU 102 to generate the random numbers, moreover, the random number generator 116 generates the random numbers and feeds them to the main CPU 102. The main CPU 102 accepts the random numbers and stores them in the main RAM 106. In case this processing is ended, the processing is shifted to Step S113.

Next, the 1-game monitoring timer is set (at Step S113), as shown in FIG. 14. In this processing, the main CPU 102 sets the timer built therein. This timer includes an automatic stop timer for stopping the reels 26L, 26C and 26R automatically not on the basis of the stopping operation of the player. In case this processing is ended, the processing is shifted to Step S114.

Next, a gaming state is monitored (at Step S114). In this processing, the main CPU 102 monitors the playing state in the slot machine 10, as will be described hereinafter. In case this processing is ended, it is shifted to Step S115.

Next, a probability lottery is executed (at Step S115). In this processing, the main CPU 102 executes the processing on the internal lottery on the basis of the random numbers, which are stored in the main RAM 106 by the processing of Step S112. In case this processing is ended, it is shifted to Step S116.

Next, a stop table group is selected (at Step S116). The main CPU 102 selects the stop table on the basis of the gaming state or the like, as will be described hereinafter. In case this processing is ended, it is shifted to Step S117.

Next, the start command is sent (at Step S117). In this processing, the main CPU 102 feeds pieces of information such as the information on an internal winning combination, the selection result of the stop table group, the gaming state, the kinds of probability lottery table stored, and the stock number, as the data for starting the game to the subsidiary control circuit 200. In case this processing is ended, it is shifted to Step S118.

Next, it is determined (at Step S118) whether or not the stop buttons have been turned ON. In this processing; the reel stop signal circuit 154 feeds the stop signal to the main CPU 102, in case the operations of the individual stop buttons 34L, 34C and 34R are detected. The main CPU 102 accepts the stop signal to discriminate that the stop buttons are turned ON, and shifts the processing to Step S120. The main CPU 102 does not accept the stop signal not to discriminate that the stop buttons are turned ON, and shifts the processing to Step S119.

Next, it is determined (at Step S119) whether or not the value of the automatic stop timer is at "0". In this processing, the main CPU 102 makes this determination on the basis of the count, which is started by the processing of Step S113. The main CPU 102 shifts the processing to Step S120, in case it determines that the value of the automatic stop timer is at "0", but to Step S118 in case it does not determine that the value of the automatic stop timer is at "0".

Next, the slipping frame number is determined (at Step S120). In this processing, the main CPU 102 determines the slipping frame number on the basis of the stop positions having detected the operations of the individual stop buttons 34L, 34C and 34R and the stop table contained in the stop table group selected, and stores it in the main RAM 106. In case this processing is ended, it is shifted to Step S121.

Next, the reel corresponding to the slipping frame number is turned and is then stopped (at Step S121). In this processing, the main CPU 102 reads out the data indicating the slipping frame number stored in the main RAM 106 by the processing of Step S120, and feeds the stop signal to the motor drive circuit 130 for controlling the stops of the stepping motors 128L, 128C and 128R, on the basis of those data, so that the stepping motors 128L, 128C and 128R are stopped to stop and display the reels 26L, 26C and 26R. In case this processing is ended, it is shifted to Step S122.

Next, it is determined (at Step S122) whether or not all the reels have been stopped. In this processing, the main CPU 102 shifts the processing to Step S123, in case it discriminates that all the reels are stopped, but to Step S118 in case it does not discriminate that all the reels are stopped.

Next, the stop command is sent (at Step S123), as shown in FIG. 15. In this processing, the main CPU 102 feeds the subsidiary control circuit 200 with a command indicating that all the reels are stopped. In case this processing is ended, it is shifted to Step S124.

Next, a prize is retrieved (at Step S124). In this processing, the main CPU 102 retrieves the prize on the basis of the stop positions of the individual reels 26L, 26C and 26R, the BET number data and the winning symbol combination table, and stores the winning flag in the main RAM 106. In case this processing is ended, it is shifted to Step S125.

Next, it is determined (at Step S125) whether or not the winning flag is normal. In this processing, the main CPU 102 shifts the processing to Step S127, in case it discriminates that the winning flag is normal, but to Step S126 in case it does not discriminate that the winning flag is normal.

Next, the illegal error is displayed (at Step S126). In this processing, the main CPU 102 feeds the subsidiary control circuit 200 through the input-output bus 108 with the display instruction to display the illegal error frame. In response to this instruction, the sub-CPU 212 in the subsidiary control circuit 200 displays the illegal error frame in the display device 30 through the image control circuit 250. In case this processing is ended, the game is interrupted.

Next, the game medals are credited or paid out (at Step S127). In this processing, on the basis of the winning flag stored in the main RAM 106 by the processing of Step S124, the main CPU 102 either increases, updates and stores the credit number of the game medals positioned at the main RAM or feeds the payout instruction signal to the hopper drive circuit 124 so that a predetermined number of game medals are paid out from the hopper 126. In case this processing is ended, it is shifted to Step S128.

Next, the gaming state at the ending time is monitored (at Step S128). In this processing, the main CPU 102 reads out the data stored in the main RAM 106 and indicating the gaming state, and determines the gaming state at the next and later times on the basis of those data. Moreover, the main CPU 102 may set the various data and flags, when it determines the next and subsequent gaming states, on the basis of the result of the determinations. In case this processing is ended, it is shifted to Step S129.

Next, the end command is sent (at Step S129). In this processing, the main CPU 102 feeds the subsidiary control circuit 200 with the command indicating the end of one game. In case this processing is ended, it is shifted to Step S102.

[Operations of Subsidiary Control Circuit]

In subsidiary control circuit 200, as shown in FIG. 16, it is determined (at Step S201) whether or not the demo command has been received. In this processing, the sub CPU 212 shifts the processing to Step S202, in case it discriminates that the demo command has been received through the IN port 218, but to Step S203 in case it does not discriminate that the demo command has been received.

In case it is discriminated at Step S201 that the demo command has been received, the effect variables at the demo time are stored (at Step S202). In this processing, the sub CPU 212 stores the variable indicating the demo time in the sub RAM 216. In case this processing is ended, it is shifted to Step S203.

Next, it is determined (at Step S203) whether or not the start command has been received. In this processing, the sub CPU 212 shifts the processing to Step S204, in case it discriminates that the start command has been received through the IN port 218, but to Step S205 in case it does not discriminate that the start command has been received.

In case it is discriminated that the start command has been received by the processing of Step S203, the effect variables at the starting time are stored (at Step S204). In this processing, the sub CPU 212 sores the variables indicating the starting time in the sub RAM 216. In case this processing is ended, it is shifted to Step S205.

Next, it is determined (at Step S205) whether or not the stop command has been received. In this processing, the sub CPU 212 shifts the processing to Step S206, in case it discriminates that the stop command has been received, but to Step S207 in case it does not discriminate that the stop command has been received.

In case it is discriminated that the stop command has been received by the processing of Step S205, the effect variables at the stop time are stored (at Step S206). In this processing, the sub CPU 212 stores the variables indicating the stop time in the sub RAM 216. In case this processing is ended, it is shifted to Step S207.

Next, it is determined (at Step S207) whether or not the end command has been received. In this processing, the sub CPU 212 shifts the processing to Step S208, in case it discriminates that the end command has been received through the IN port 218, but to Step S209 in case it does not discriminate that the end command has been received.

In case it is discriminated at Step S207 that the end command has been received, the effect variables at the ending time are stored (at Step S208). In this processing, the sub CPU 212 stores the variables indicating the ending time in the sub RAM 216. In case this processing is ended, it is shifted to Step S209.

Next, the effects are controlled on the effect variables (at Step S209). In this processing, the sub CPU 212 reads out the variables indicating the game situations, as positioned in the sub RAM 216, such as the demo time, the start time, the stop time or the ending time, and makes effects on the basis of those variables. In case this processing is ended, it is shifted to Step S201.

On the other hand, the effect controls to be executed by the processing of Step S209 will be described with reference to FIG. 17.

First of all, the effect variables are referred to (at Step S211), as shown in FIG. 17. In this processing, the sub CPU 212 reads out the variables indicating the game situations, as positioned in the sub RAM 216, such as the demo time, the start time, the stop time or the ending time. In case this processing is ended, it is shifted to Step S212.

Next, the image control is executed on the basis of the effect variables (at Step S212). In this processing, the sub CPU 212 feeds the image display instruction to the image display control circuit 250 through the OUT port 220 on the basis of the effect variables referred to by the processing of Step S211.

In the image display control circuit 250, the image control CPU 252 accepts the image display instruction, as fed from the sub-microcomputer 210, through the IN port 264, and feeds the image display instruction to the image control IC on the basis of the image display instruction.

The image control IC 262 reads out the predetermined image data from the image ROM 258 on the basis of the image display instruction, and stores the image data in a superposing manner in the video RAM 260. And, the image control IC 262 reads out the image data stored in the video RAM 260, and feeds them to the scale circuit 400. In case this processing is ended, it is shifted to Step S213.

Next, the sounds are controlled on the basis of the effect variables (at Step S213). In this processing, the sub CPU 212 feeds the sound effect instruction to the lamp control circuit 300 through the OUT port 220 on the basis of the effect variables referred to by the processing of Step S211.

The sound source IC 302 accepts the sound effect instruction, and reads out the predetermined sound data from the sound ROM 304. The sound source IC 302 feeds the sound data to the power amplifier 306 so that the sounds are emitted for the sound effects from the speakers 46. In case this processing is ended, it is shifted to Step S214.

Next, the lamp control is executed on the basis of the effect variables (at Step S214). In this processing, the sub CPU 212 feeds the lamp effect instruction to the lamp control circuit 300 through the OUT port 220 on the basis of the effect variables referred to by the processing of Step S211.

The lamp drive circuit 322 accepts the lamp effect instruction to turn ON/OFF the effect lamps 172.

Here in this processing, the lamp effects can be made on the various lamps, but the lamp effects on the reel back lamps 63 are restricted. Usually, the reel back lamps 63 are turned ON, and they are turned OFF or another color lamp is turned ON, in case the effects are to be made. In case this processing is ended, the present subroutine is ended.

[Operations of Scale Circuit]

At the scale circuit 400, as shown in FIG. 18, the timer count is started (at Step S301). In this processing, the signal conversion CPU 272 starts the count of the timer built therein. In case this processing is ended, it is shifted to Step S302.

Next, it is determined (at Step S302) whether or not a predetermined period has elapsed. In this processing, the signal conversion CPU 272 shifts the processing to Step S303, in case it discriminates that the count of the timer built therein has elapsed the predetermined period, but again to Step S302 in case it does not discriminate that the count of the timer has elapsed the predetermined period.

In case it is discriminated at Step S302 that the predetermined period has elapsed, it is determined (at Step S303) whether or not the image signals or the synchronous signals have been received. In this processing, the signal conversion CPU 272 shifts the processing to Step S304, in case it discriminates that the image signals have been received through the IN port 278, but to Step S306 in case it does not discriminate that the image signals have been received.

In case it is discriminated by the processing of Step S303 that the image signals have been received, the received image signals are enlarged (at Step S304). In this processing, the signal conversion CPU 272 enlarges and converges the accepted image signals as the enlarged and converged image signals. In case this processing is ended, it is shifted to Step S305.

Next, the enlarged image is stored (at Step S305). In this processing, the signal conversion CPU 272 stores the video RAM 276 with the image data enlarged and converged by the processing of Step S304. In case this processing is ended, it is shifted to Step S307.

In case it is not discriminated by the processing of Step S303 that the image signals have been accepted, the transparent image is stored (at Step S306). In this processing, the signal conversion CPU 272 stores the video RAM 276 in the image of relatively high transparency. In case this processing is ended, it is shifted to Step S307.

Next, the image signals are sent (at Step S307). In this processing, the signal conversion CPU 272 reads out the image data stored in the video RAM 276 and feeds the image data through the OUT port 280 to the display device 30.

In case the signal conversion CPU 272 feeds the image signals, on the other hand, it feeds the liquid crystal backlights 292 with an effective signal to emit the lights.

The liquid crystal drive circuit 291 having accepted the image data converts the image data and displays the image based on the image data, in the liquid crystal display device 54.

Moreover, the liquid crystal backlights 292 accept the aforementioned effective signal and illuminate the liquid crystal display device 54 from the back. In case this processing is ended, it is shifted to Step S301.

Thus, "the reel illuminating means has a function to illuminate the reels in case the power source is turned ON". On the basis of the operation of the power ON, the function to illuminate the reels is activated to make the reels easily visible. Therefore, it is possible to provide a game, which continue the interest of the player for a long time. Since this visibility is made easier, it is also possible to provide the game, which can make the player hardly tired to keep the interest of the player for a long time.

Especially in case the symbol is displayed in motion by rotating the reels, it is harder to view than in case the symbol is displayed still. According to this gaming machine, it is possible to provide a game, which can make the reels more visible than the related art and can continue the interest of the player for a long time. As the visibility is made easier, it is possible to provide a game which can make the player hardly tired and can continue the interest of the player for a long time. Since the contents of the game are frequently determined in the reel stopping mode, it is possible to provide a game, which can keep the interest the player for a longer time.

Here, the aforementioned "case of the power ON" is a concept including the case, in which the power source is merely turned ON, and the case in which the power source is turned ON again. In the included case, for example, the power source may be turned ON on the basis of the operation of the power button, and the power source may be turned ON again on the basis of the operation of the reset button.

Moreover, "the reel illuminating means has a function to illuminate the reels at all times while the power source is ON". In case the gaming machine is powered, i.e., in case the gaming machine may be played, therefore, it is possible to provide a game, which can make the reels easily visible and can continue the interest of the player for a long time. Since this visibility is made easier, moreover, it is possible to provide a game, which can make the player hardly tired and can keep the interest of the player for a long time.

Moreover, "the reel illuminating means has a function not to illuminate the reels, in case the effects are to be made, but to illuminate the reels in case no effect is to be made". Therefore, the effects may be made by extinguishing the reels, but the reels are illuminated at all times, in case the effects are not made. In other words, the reels are made ordinarily visible, and the effects are made by not illuminating the reels. As a result, it is possible to provide a game, which makes the effects with the brightness of the reels, which can make the reels easily visible and which can continue the interest of the player for a long time. Since this visibility is made easier, moreover, it is possible to provide a game, which can make the player hardly tired and can keep the interest of the player for a long time.

Still moreover, "the gaming machine further comprises: a display device mounted on the front faces of the reels for displaying an image; and display control means for displaying an image relating to a game on the display device, and the display control means has a function to display an image of a relatively high transparency on the display device". Therefore, the invisibility is eliminated by displaying an image of a relatively high transparency. Thus, it is possible provide a game, which can make the reels more visible and can continue the interest of the player for a long time. Since this visibility is made easier, it is also possible to provide the game, which can make the player hardly tired and can keep the interest of the player for a long time.

Here in this embodiment, the display device 30 is disposed on the front faces of the reels 26L, 26C and 26R, and the display device 30 is so constructed that the relatively transparent images can be displayed in the display device 30. However, the invention should not be limited thereto, but the display device 30 need not be disposed on the front faces of the reels 26L, 26C and 26R. Moreover, no trouble arises even if the display device 30 does not have the function to display the relatively transparent images. In this case, the construction is made such that the display device can be controlled to keep the state of the screen by displaying a predetermined image when abnormality is detected.

Moreover, the effects, as described herein, are the mere enumeration of the most proper effects obtained from the invention, and the effects of the invention should not be limited thereto.

In order to achieve the aforementioned object, the gaming machine of the invention is provided with the image display unit having the display control means, and the power source feeding means for feeding the display units and the image display unit independently with the power source.

The aforementioned concept of "feed the power source independently" contains not only the mere use of different power source devices but also the feed of the power source to not one board but the other even in case the power source device is shared.

Moreover, "the display device is provided with an image state keeping unit having image state keeping means for accepting the image signals fed from the display control means, and for controlling the display device in a predetermined state in case the image signals are abnormal". Even in case the power source is not fed to the image display unit, therefore, the power source is fed independently of the power source feeding means for the display device so that the display device itself is not disconnected from the power source. By eliminating one factor which may give an uncomfortable feel during playing the game, therefore, it is possible to provide a gaming machine which can continue the interest of the player for a long time.

By providing such image state keeping means, moreover, the predetermined image is displayed in case the image is abnormal. By eliminating one factor, which may give an uncomfortable feel during playing the game, therefore, it is possible to provide a gaming machine which can continue the interest of the player for a long time.

Moreover, "the gaming machine comprises the rotatable reels having the symbols drawn on their outer peripheries, and the display device is mounted on the front faces of the reels". The gaming machine having the display device on the reel front face to be most noted by the player can provide a game having dynamic effects but may give the more uncomfortable image influences to the player as the place is more noted. Especially in case the display device is disposed on the reel front face, it may give a relatively serious uncomfortable feeling to the player. By eliminating one cause for the uncomfortable feeling during the play, therefore, it is possible to provide the game, which can continue the interest of the player for a longer time.

Here in this embodiment, the display device 30 is disposed on the front faces of the reels 26L, 26C and 26R, and the display device 30 is so constructed that the relatively transparent images can be displayed in the display device 30. However, the invention should not be limited thereto, but the display device 30 need not be disposed on the front faces of the reels 26L, 26C and 26R. Moreover, no trouble arises even if the display device 30 does not have the function to display the relatively transparent images. In this case, the construction is made such that the display device can be controlled to keep the state of the screen by displaying a predetermined image when abnormality is detected.

Moreover, the effects, as described herein, are the mere enumeration of the most proper effects obtained from the invention, and the effects of the invention should not be limited thereto.

The aforementioned concept of "feed the power source independently" contains not only the mere use of different power source devices but also the feed of the power source to not one but the other even in case the power source device is shared.

On the other hand, "the image state keeping unit has not only the image state keeping means but also image enlarging conversion means for converging the accepted image signals into enlarged image signals". Even in case the power source is not fed to the display control unit, therefore, the power source is fed independently of the power source feeding means so that the state of the image can be kept without displaying any disturbed image. By eliminating one cause for an uncomfortable feeling during the play, therefore, it is possible to provide a game capable of continuing the interest of the player for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image state keeping unit with the image state keeping means and the image enlarging conversion means, moreover, it is possible not only to invite no size enlargement but also to spare the space and to receive less influence of the noises.

Moreover, "the gaming machine further comprises the rotatable reels having a plurality of symbols drawn on their outer peripheries, and the display device is mounted on the front faces of the reels". The gaming machine having the display device on the reel front face to be most noted by the player can provide a game having dynamic effects but may give the more uncomfortable image influences to the player as the place is more noted. Especially in case the display device is disposed on the reel front face, it may give a relatively serious uncomfortable feeling to the player. By eliminating one cause for the uncomfortable feeling during the play, therefore, it is possible to provide the game, which can continue the interest of the player for a longer time.

On the other hand, not the uncomfortable image, as might otherwise be formed by various troubles, but the image of a relatively high transparency is displayed on the display device. In case the abnormality is detected, therefore, it is possible to make the reels visible to the player.

It is, therefore, possible to provide a game, which can continue the interest of the player without displaying the image, as might otherwise become uncomfortable during the play, unless the image signal monitoring unit becomes abnormal.

Since the reels are made visible, moreover, the game is hardly interrupted even in the abnormal case of the monitoring unit. Therefore, it is possible to provide a game, which not only can be continued but also is hardly distrusted by the player as if an improper treatment were done, so that it can continue the interest of the player.

Here in this embodiment, the display device 30 is disposed on the front faces of the reels 26L, 26C and 26R, and the display device 30 is so constructed that the relatively transparent images can be displayed in the display device 30. However, the invention should not be limited thereto, but the display device 30 need not be disposed on the front faces of the reels 26L, 26C and 26R. Moreover, no trouble arises even if the display device 30 does not have the function to display the relatively transparent images. In this case, the construction is made such that the display device can be controlled to keep the state of the screen by displaying a predetermined image when abnormality is detected.

Moreover, the effects, as described herein, are the mere enumeration of the most proper effects obtained from the invention, and the effects of the invention should not be limited thereto.

Thus, "the display device further comprises: an image displaying board having the display control means; and an image signal control board including image signal control means for accepting image signals from the display control means to display an image on the display device and for detecting abnormality of the image signals, and transparent image display means for displaying an image of a relatively high transparency on the display device in case the abnormality of the image signals is detected by the image signal control means". Therefore, not the uncomfortable image, as might otherwise be formed by various troubles, but the image of a relatively high transparency is displayed on the display device. In case the abnormality is detected, therefore, it is possible to make the reels visible to the player.

It is, therefore, possible to provide a game, which can continue the interest of the player without displaying the image, as might otherwise become uncomfortable during the play, unless the image signal control board becomes abnormal.

Since the reels are made visible, moreover, the game is hardly interrupted even in the abnormal case of the monitoring unit. Therefore, it is possible to provide a game, which not only can be continued but also is hardly distrusted by the player as if an improper treatment were done, so that it can continue the interest of the player.

On the other hand, "the image signal control board includes not only the image signal control means and the transparent image display means but also image enlarging conversion means for converging the accepted image signals into enlarged image signals". Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game, which can continue the interest of the player for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image signal monitoring board with the image state keeping means and the image enlarging conversion means, moreover, it is possible to reduce the number of boards, and not only to invite no size enlargement but also to spare the space. Moreover, signals are fed through the wires formed on the board so that less influence of the noises is received.

Moreover, "the display control means has a function to display a colored image on the display unit so that the colored image may be invisible to a player". Therefore, not the uncomfortable image, as might otherwise be formed by various troubles, but the image of a relatively high transparency is displayed on the display device. In case the abnormality is detected, therefore, it is possible to make the reels visible to the player.

It is, therefore, possible to provide a game, which can continue the interest of the player without displaying the image, as might otherwise become uncomfortable during the play, unless the image signal control board becomes abnormal.

Since the reels are made visible, moreover, the game is hardly interrupted even in the abnormal case of the monitoring unit. Therefore, it is possible to provide a game, which not only can be continued but also is hardly distrusted by the player as if an improper treatment were done, so that it can continue the interest of the player.

Moreover, the effects thus far described are no more than the enumerations of the most preferred effects obtained from the invention. The effects of the invention should not be limited to those described hereinbefore.

The invention will be described in connection with its embodiment with reference to the accompanying drawings. In this embodiment to be described, the invention is applied to a slot machine, and a plurality of mechanical rotatable reels are used as variable display devices for variably displaying a plurality of kinds of discrimination information images necessary for a game. However, the invention should not be limited thereto but could be adopted in various gaming machines such as a pinball gaming machine, a medal gaming machine or a card gaming machine.

On the image display subsidiary board 80, there is packaged the image display subsidiary circuit (although not shown) 290, which forms part of the display device 30 for driving the image signals fed from the scale board 76 and for controlling liquid crystal backlights 292 (referred to FIG. 11) of the display device 30.

Thus, there are provided the display device having the display control means, and the image state keeping unit having the image state keeping means for accepting the image signals fed from the display control means and for controlling the display device in a predetermined state in case the image signals are abnormal. The uncomfortable image, as might otherwise be formed by various troubles, can be kept in the predetermined state without being displayed in the display device. By eliminating one factor, which may give an uncomfortable feel during playing the game, therefore, the interest of the player can be continued for a long time.

By displaying the disturbed image formed due to the failures in the display device, the display control means, the power supply feed so on, for example, the game provided can make the player feel uncomfortable. By eliminating one cause for such an uncomfortable feeling, therefore, it is possible to provide a game capable of continuing the interest of the player for a long time.

Moreover, the image state keeping unit is provided with the image state keeping means and the image enlarging conversion means for converging the image signals accepted from the display control means into the enlarged image signals. Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game capable of continuing the interest of the player for a long time.

Moreover, the image signals are displayed, after enlarged and converted, as a larger image than that of the related art in the display device. This display can provide a game having dynamic effects but gives the more uncomfortable image influences to the player as the image becomes the larger. Especially in case the image thus enlarged and converted is displayed, it may give a relatively serious uncomfortable feeling to the player. By eliminating one cause for the uncomfortable feeling during the play, therefore, it is possible to provide the game, which can continue the interest of the player for a longer time.

By providing the common image state keeping unit with the image state keeping means and the image enlarging conversion means, moreover, it is possible not only to invite no size enlargement but also to spare the space and to receive less influence of the noises.

Moreover, the display device is provided with the rotatable reels having the plural symbols drawn on their outer peripheries, and the transparent image display means disposed on the front faces of the reels for displaying the images of relatively high transparency. In the gaming machine having the display device disposed on the front faces of the reels to be most noted by the player, therefore, it is possible to provide the game having dynamic effects. For the more notable place, however, the more serious uncomfortable image becomes the more liable to be given to the player. Especially in case the display device is thus disposed on the front faces of the reels, the relatively serious uncomfortable feeling can be given to the player. By eliminating one cause for the uncomfortable feeling during the play, therefore, it is possible to provide the game, which can continue the interest of the player for a longer time.

Here in this embodiment, the display device 30 is disposed on the front faces of the reels 26L, 26C and 26R, and the display device 30 is so constructed that the relatively transparent images can be displayed in the display device 30. However, the invention should not be limited thereto, but the display device 30 need not be disposed on the front faces of the reels 26L, 26C and 26R. Moreover, no trouble arises even if the display device 30 does not have the function to display the relatively transparent images. In this case, the construction is made such that the display device can be controlled to keep the state of the screen by displaying a predetermined image when abnormality is detected.

Moreover, the effects, as described herein, are the mere enumeration of the most proper effects obtained from the invention, and the effects of the invention should not be limited thereto.

Moreover, the reel back lamps 63L, 63C and 63R are usually kept in the lighting state so as to make the symbols easily visible. At the power ON time and at the reset time, moreover, the reel back lamps 63L, 63C and 63R are activated to keep the lighting state of the lighting/extinguishing states.

As main input signal generating means for generating input signals necessary for the main CPU 102 to generate control signals, there are provided a start switch 150, the 1-BET switch 20, the 2-BET switch 22, the MAX-BET switch 24, the stocked medal settling button 36, a medal sensor 152, a reel stop signal circuit 154, a reel position detecting circuit 156, a payout completion signal circuit 158, a payout switch 162, the reset switch 164, the setting switch 166 and a contact sensor 168. These elements are also connected with the main CPU 102 through the input-output bus 108.

The set switch 166 detects the operation of the set button disposed in the slot machine 10 and feeds the main CPU 102 with the set signal through the input-output bus 108 when it detects the operation of the set button.

The lamp control circuit 300 is constructed of: the sound source IC 302 for controlling the sounds emitted from the speakers 46; a sound ROM 304 stored with the sound data; a power amplifier 306 acting as an amplifier; and a lamp drive circuit 322 for driving the effect lamps 172.

Here, in this embodiment, the LVDS (Low Voltage Differential Signaling) is adopted for the image signals to be fed to the scale circuit 400. This invention should not be limited thereto but may use various types. Preferably, by using the differential type such as the LVDS, for example, the image signals are hardly subject to the influences of noises so that the images are displayed without deterioration.

In this embodiment, moreover, the image signals to be fed to the scale circuit 400 are of the VGA (Video Graphics Array) size so that they are converted into the enlarged image signals of the XGA (eXtended Graphics Array) size by the operations of the scale circuit 40. Here in this embodiment, the image signals of the VGA size are fed to the scale circuit 400. However, the invention should not be limited thereto but may feed image signals of various sizes.

Moreover, the image signal control unit is constructed to include the image signal control means, the transparent image display means and the image enlarging conversion means for converging the accepted image signals into the enlarged image signals. Therefore, the uncomfortable image, as might otherwise be formed by various troubles, can be kept in the predetermined state without being displayed in the display device. By eliminating one factor, which may give an uncomfortable feel during playing the game, therefore, the interest of the player can be continued for a long time.

Next, an automatic insertion of the game medals demanded is executed (at Step S106). In this processing, the main CPU 102 reads out the data indicating the previous insertion number from the main RAM 106, and stores the BET number in the main RAM 106 bared on the data. In case this processing is ended, it is shifted to Step S108.

Next, it is determined (at Step S122) whether or not all the reels 26L, 26C and 26R have been stopped. In this processing, the main CPU 102 shifts the processing to Step S123, in case it discriminates that all the reels 26L, 26C and 26R are stopped, but to Step S118 in case it does not discriminate that all the reels are stopped.

Next, the stop command sending processing is executed (at Step S123), as shown in FIG. 15. In this processing, the main CPU 102 feeds the subsidiary control circuit 200 with a command indicating that all the reels are stopped. In case this processing is ended, it is shifted to Step S124.

In the image display control circuit 250, the image control CPU 252 accepts the image display instruction, as fed from the sub-microcomputer 210, through the IN port 264, and feeds the image display instruction to the image control IC on the basis of the image display instruction.

According to the invention, there are provided the display device having the display control means, and the image state keeping unit having the image state keeping means for accepting the image signals fed from the display control means to display the image on the display device and for controlling the display device into the constant state in case the image signals are abnormal. Therefore, the uncomfortable image, as might otherwise be formed by various troubles, can be kept in the predetermined state without being displayed in the display device. By eliminating one factor, which may give an uncomfortable feel during playing the game, therefore, it is possible to provide a game capable of continuing the interest of the player for a long time.

The invention will be described in connection with its embodiment with reference to the accompanying drawings. In this embodiment to be described, the invention is applied to a slot machine, and a plurality of mechanical rotatable reels are used as variable display devices for variably displaying a plurality of kinds of discrimination information images necessary for a game. However, the invention should not be limited thereto but could be adopted in various gaming machines such as a pinball gaming machine, a medal gaming machine or a card gaming machine.

According to the invention, "the reel illuminating means has a function to illuminate the reels in case the power source is turned ON", that is, the function to illuminate the reels is activated on the basis of the operation of the power ON. Therefore, it is possible provide a game, which can make the reels easily visible and can continue the interest of the player for a long time. Since this visibility is made easier, moreover, the game makes the player hardly tired to keep the interest of the player for a long time.

According to the invention, "the display device further comprises: an image display unit having the display control means; and power source feeding means for feeding the power source independently to the display device and the image display unit". Even in case the power source is not fed to the image display unit, therefore, the power source is fed independently of the power source feeding means for the display device so that the display device itself is not disconnected from the power source. By eliminating one factor, which may give an uncomfortable feel during playing the game, therefore, it is possible to provide a gaming machine which can continue the interest of the player for a long time.

According to the invention, "the gaming machine further comprises: an image display unit having the display control means; an image state keeping unit having image state keeping means for accepting the image signals fed from the display control means to display an image on the image display unit, and for controlling the display device in a predetermined state in case the image signals are abnormal; and power source feeding means for feeding the power source independently to the image state keeping unit and the image display unit". Even in case the power source is not fed to the image display unit, therefore, the power source is independently fed from the power source feeding means so that the state of the image can be kept without displaying any disturbed image. By eliminating one cause for an uncomfortable feeling during the play, therefore, it is possible to provide a game capable of continuing the interest of the player for a long time.

According to the invention, "the gaming machine further comprises: an image displaying board having the display control means; and an image signal control board including image signal control means for accepting image signals from the display control means to display an image on the display device and for detecting abnormality of the image signals, and transparent image display means for displaying an image of a relatively high transparency on the display device in case the abnormality of the image signals is detected by the image signal control means". Therefore, not the uncomfortable image, as might otherwise be formed by various troubles, but the image of a relatively high transparency is displayed on the display device. In case the abnormality is detected, therefore, it is possible to make the reels visible to the player.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The co-pending applications including specifications, drawings and claims are expressly incorporated herein by reference in their entirety.

What is claimed is:

1. A gaming machine comprising:

a display device with a variable display adjacent a transmissive display, the variable display being operable to display one or more reels each having symbols associated with an outcome of a wagering game, and at least some portions of the transmissive display being operable to transition between a transparent condition and a non-transparent condition;

a display control device configured to control the display device to display an image relating to a game;

an image control device having the display control device;

an image state keeping device configured to:

monitor a signal of an image fed from the display control device, detect whether the signal is in a normal state thereby rendering the image as a normal image or an abnormal state thereby rendering the image as an abnormal image being different from the normal image, and control the display device such that when the image state keeping device detects that the signal is in the abnormal state, the display device is controlled to display the image as the normal image;

a power source feeding device; and a power source relay device configured to relay power fed from the power source feeding device so as to independently supply the power to the image control device, the image state keeping device, and the display device, wherein, if the power source relay device fails to feed the relayed power to the display device while the power source feeding device remains operative, the power source relay device is operative to feed the relayed power to the image control device and the image state keeping device, and the image control device commands the transmissive display to transition the portions to the transparent condition such that the outcome of the wagering game is visible through the portions of the transmissive display.

2. The gaming machine according to claim 1, wherein the one or more reels include a rotatable reel having a plurality of the symbols drawn on an outer periphery thereof, and wherein the transmissive display is disposed in the front of the rotatable reel.

3. The gaming machine according to claim 1, wherein the image state keeping device further includes an image enlarging conversion device configured to convert the received signal of the image into a signal of an enlarged image.

4. The gaming machine according to claim 1, wherein the transmissive display is configured to display an image of relatively high transparency when the image state keeping device detects abnormality of the signal of the image, wherein the relative high transparency of the image is sufficient to enable a player to see through the image and view at least one of the symbols on the one or more reels.

5. The gaming machine according to claim 4, wherein the display control device has a function to display a colored image on the display device so that a player sees the colored image in lieu of the plurality of symbols drawn on the periphery of the reel.

6. The gaming machine according to claim 1, wherein the image control device and the image state keeping device are connected to an upper portion of the inside of the gaming machine, the upper portion being vertically spaced from a lower portion of the gaming machine to which is attached the display device.

7. The gaming machine according to claim 1, wherein the power source feeding device and the power source relay device are located inside the lower portion of the gaming machine.

8. A display device apparatus for a gaming machine with one or more reels each having symbols associated with an outcome of a wagering game, the display device apparatus comprising:

a transmissive display device adjacent the one or more reels, at least some portions of the transmissive display device being operable to transition between a transparent condition and a non-transparent condition;

a display control device configured to control the transmissive display device to display an image relating to a game;

an image control device having the display control device;

an image state keeping device configured to:

monitor a signal of an image fed from the display control device, detect whether the signal is in a normal state thereby rendering the image as a normal image or an abnormal state thereby rendering the image as an abnormal image being different from the normal image, and control the transmissive display device such that when the image state keeping device detects that the signal is in the abnormal state, the transmissive display device is controlled to display the image as the normal image;

a power source feeding device; and a power source relay device configured to relay power fed from the power source feeding device to supply the power to the transmissive display device, the image state keeping device, and the image control device;

wherein, if the power source relay device fails to feed the relayed power to the display device while the power source feeding device remains operative, the power source relay device is operative to feed the relayed power to the image control device and the image state keeping device, and the portions of the transmissive display device transition to the transparent condition such that the outcome of the wagering game is visible through the portions of the transmissive display device.

9. The display device apparatus according to claim 8, wherein:

the one or more reels include a rotatable reel having a plurality of the symbols drawn on an outer periphery thereof, the transmissive display being disposed in front of the rotatable reel; and the transmissive display is configured to display an image of relatively high transparency on the display device when the image state keeping device detects abnormality of the signal of the image, the relative high transparency of the image being sufficient to enable a player to see through the image and view at least one of the plurality of symbols on a front-most portion of the reel.

10. A display device apparatus for a gaming system with one or more reels each having symbols associated with an outcome of a wagering game, the display device apparatus comprising:

a transmissive display device adjacent the one or more reels, portions of the transmissive display device being operable to transition between a transparent condition and a non-transparent condition;

a display control device configured to control the transmissive display device to display an image relating to a game;

an image control device having the display control device;

an image state keeping device configured to:

monitor a signal of an image fed from the display control device, detect whether the signal is in a normal state thereby rendering the image as a normal image or an abnormal state thereby rendering the image as an abnormal image being different from the normal image, and control the transmissive display device such that when the image state keeping device detects that the signal is in the abnormal state, the transmissive display device is controlled to display the image as the normal image; and a power source feeding device configured to feed power to the transmissive display device, the image state keeping device, and the image control device independently from each other, wherein, if the power source feeding device fails to feed power to the display device while the power source feeding device remains operative, the power source feeding device is operative to feed power to the image control device and the image state keeping device, and the portions of the transmissive display device transition to the transparent condition such that the outcome of the wagering game is visible through the portions of the transmissive display device.

* * * * *